US008845221B2

(12) United States Patent
Fukumoto

(10) Patent No.: US 8,845,221 B2
(45) Date of Patent: Sep. 30, 2014

(54) CLICKING TYPE DISPENSING CONTAINER

(75) Inventor: Takeo Fukumoto, Fujioka (JP)

(73) Assignee: Mitsubishi Pencil Company, Limited, Shinagawa-ku, Tokyo (JP)

( * ) Notice: Subject to any disclaimer, the term of this patent is extended or adjusted under 35 U.S.C. 154(b) by 860 days.

(21) Appl. No.: 12/934,481

(22) PCT Filed: Apr. 13, 2009

(86) PCT No.: PCT/JP2009/057447

§ 371 (c)(1),
(2), (4) Date: Sep. 24, 2010

(87) PCT Pub. No.: WO2009/125868

PCT Pub. Date: Oct. 15, 2009

(65) Prior Publication Data

US 2011/0020048 A1 Jan. 27, 2011

(30) Foreign Application Priority Data

| | | |
|---|---|---|
| Apr. 11, 2008 | (JP) | 2008-103988 |
| May 7, 2008 | (JP) | 2008-121016 |
| Oct. 10, 2008 | (JP) | 2008-264195 |
| Oct. 10, 2008 | (JP) | 2008-264201 |

(51) Int. Cl.

| | |
|---|---|
| ***A45D 34/04*** | (2006.01) |
| ***A45D 40/20*** | (2006.01) |
| ***A46B 11/00*** | (2006.01) |
| ***B43M 11/06*** | (2006.01) |

(52) U.S. Cl.

CPC ..... *A45D 40/20* (2013.01); *A45D 34/04* (2013.01); *A46B 11/0031* (2013.01); *B43M 11/06* (2013.01); *A45D 2200/055* (2013.01)

USPC ..... 401/172; 401/192; 401/171

(58) Field of Classification Search

USPC ..... 401/66, 79, 171–174, 192, 65

See application file for complete search history.

(56) References Cited

U.S. PATENT DOCUMENTS

| | | | |
|---|---|---|---|
| 4,624,594 | A | 11/1986 | Sasaki et al. |
| 5,871,296 | A | 2/1999 | Furukawa et al. |

(Continued)

FOREIGN PATENT DOCUMENTS

| | | | |
|---|---|---|---|
| JP | 60-116495 | A | 6/1985 |
| JP | 62-080685 | | 5/1987 |
| JP | 62-080685 | U | 5/1987 |
| JP | 63-095514 | | 6/1988 |

(Continued)

OTHER PUBLICATIONS

International Search Report (PCT/ISA/210) issued on Jun. 30, 2009, by Japanese Patent Office as the International Searching Authority for International Application No. PCT/JP2009/057447.

*Primary Examiner* — David Walczak
*Assistant Examiner* — Bradley Oliver
(74) *Attorney, Agent, or Firm* — Buchanan Ingersoll & Rooney, P.C.

(57) ABSTRACT

A clicking type dispensing container that can dispense the content by pressing a crown disposed at the rear end of a barrel body, forwards in the axial direction, and has a structure, including a mechanical assembly that transforms the pressing force acting on crown by user operation into rotational force, a threaded body fixed to barrel body and a threaded rod screw-fitted into threaded body, and dispensing the content by advancing the threaded rod through the threaded body when the threaded rod is turned by the rotational force transformed by the mechanical assembly. The clicking type dispensing container can produce the rotational force without depending on spring force and cam configuration only, is constructed of a fewer number of parts and can dispense a fixed amount of the content by use of a thread.

11 Claims, 44 Drawing Sheets

(56) References Cited

U.S. PATENT DOCUMENTS

| | | | | |
|---|---|---|---|---|
| 6,244,769 | B1 | 6/2001 | Nakajima et al. | |
| 6,287,036 | B1 | 9/2001 | Keda et al. | |
| 6,702,158 | B2 | 3/2004 | Kageyama et al. | |
| 6,742,953 | B2 * | 6/2004 | Burden et al. | 401/194 |
| 7,217,054 | B2 | 5/2007 | Noguchi | |
| 7,654,763 | B2 | 2/2010 | Izawa et al. | |
| 7,815,385 | B2 | 10/2010 | Izawa et al. | |
| 2002/0070247 | A1 | 6/2002 | Kageyama et al. | |
| 2005/0169695 | A1 | 8/2005 | Noguchi | |
| 2009/0180824 | A1 | 7/2009 | Izawa et al. | |
| 2010/0166486 | A1 | 7/2010 | Izawa et al. | |

FOREIGN PATENT DOCUMENTS

| | | | |
|---|---|---|---|
| JP | 63-095514 | U | 6/1988 |
| JP | 2-073000 | A | 3/1990 |
| JP | 6-004837 | U | 1/1994 |
| JP | 06-004837 | Y | 2/1994 |
| JP | 9-000347 | A | 1/1997 |
| JP | 9-118095 | A | 5/1997 |
| JP | 2001-219689 | A | 8/2001 |
| JP | 2001-232273 | A | 8/2001 |
| JP | 2002-068332 | A | 3/2002 |
| JP | 2005-212418 | A | 8/2005 |
| WO | WO 2007/142135 | A1 | 12/2007 |

* cited by examiner

F0
234a1
240a
242
240
240a1
234
234a
236
U
232a
232a1
233
238a1
238a
232
239
228

NK1
242
236
232a
238a2
233
238a1
238a
228

NK2
242
236
232a2
233
232
228
238a2

NK3
242
236
238

UNK1
242
240a2
240a1
240a
240
234a2
234
236
238

UNK2
242
236
238

X - X

X – X

CLICKING TYPE DISPENSING CONTAINER

TECHNICAL FIELD

The present invention relates to a clicking type dispensing container for dispensing a liquid or fluid such as a liquid cosmetic or the like, or a solid content of a stick-type or the like, by clicking a crown at the rear end of the barrel body.

BACKGROUND ART

A conventionally known clicking type dispensing container uses a cam mechanism similar to that of ball-point pens, including a clicking body, a rotary piece and an inner sleeve, each having a cam, so that the rotary piece being urged rearwards by a spring is continuously rotated, whereby the rotation of the rotary piece is transmitted to a threaded rod provided with a threaded part (male thread) (which is called a Khan clicking mechanism). Since this threaded rod (male thread) is screw-fitted with a threaded part (female thread) provided in the bore of a threaded body that is fixed to the barrel body, at least, with respect to the rotational direction, the threaded rod advances relative to the threaded body as the threaded rod rotates. As the threaded rod advances, the piston fitted at the front end of the threaded rod also advances so as to dispense the content (Japanese Patent Application Laid-open S60-116495 (Patent Document 1), Japanese Patent Application Laid-open H09-118095 (Patent Document 2), Japanese Patent Application Laid-open 2002-068332 (Patent Document 3) and Japanese Patent Application Laid-open 2001-232273 (Patent Document 4).

Among the writing instruments that use the Kahn clicking type dispensing mechanism so as to cause a writing element to come out and retract, there is a configuration that has a function of changing the indication that can be seen through an outer sleeve by turning a display sleeve in linkage with the cam rotary piece by a clicking operation (Japanese Patent Application Laid-open 2001-219689 (Patent Document 5) and Japanese Patent Application Laid-open H02-73000 (Patent Document 6).

Other than above, there is a known configuration in which a valve is used so as to eject the content by difference in pressure inside the tank by opening and closing the valve by clicking (Japanese Utility Model Application Laid-Open H06-4837: Patent Document 7).

PRIOR ART DOCUMENTATION

Patent Documents

Patent Document 1:
Japanese Patent Application Laid-open S60-116495
Patent Document 2:
Japanese Patent Application Laid-open H09-118095
Patent Document 3:
Japanese Patent Application Laid-open 2002-068332
Patent Document 4:
Japanese Patent Application Laid-open 2001-232273
Patent Document 5:
Japanese Patent Application Laid-open 2001-219689
Patent Document 6:
Japanese Patent Application Laid-open H02-73000
Patent Document 7:
Japanese Examined Utility Model Application Publication H06-4837

SUMMARY OF THE INVENTION

Problems to be Solved by the Invention

However, among the aforementioned clicking type dispensing containers, the former configuration in which the threaded rod is advanced, the rotational force of the rotary piece is determined by the cam configuration and the strength of the spring. Hence, when the content is of a high viscosity type, if there occurs the phenomenon of the piston sticking to the barrel body due to passage of time or in other cases, it becomes impossible to make a rotational movement. Further, in the former type, the number of components is prone to increase because of its structure, adding restrictions on the external appearance, such as narrowing the diameter etc., while assembly also becomes complicated, resulting increase in cost.

In the latter configuration using a valve, it is difficult to perform ejection in a quantitative manner, and the viscosity of the ejectable content is also limited. Further, there is a fear of the content leaking forwards, so a device to prevent forward leakage is needed.

On the other hand, the inventors hereof have contrived a clicking type dispensing container (not known to the public) in which a rotary body including the first and second cam faces having serrated cam teeth formed with an identical pitch, is rotated by repeatedly applying and releasing pressure so that the rotational force is transferred to the threaded rod to advance the piston, to thereby achieve prevention against rotational movement failure due to sticking of the piston and a reduction of parts in number.

When the first cam face is guided along the first fixed cam face, or when the second cam face is guided along the second fixed cam face, each cam slides over the other cam face so as to generate a clicking sound as the walls of the cam teeth abut each other. However, there have been cases where a satisfactory clicking sound cannot be heard depending on the condition and environment. In this way, the clicking sensation cannot be felt clearly if the user cannot hear a relatively satisfactory clicking sound, and the limit of advancement of clicking is obscure so that it is so awkward to complete the pushing operation of the crown. As a result, there is a possibility that rotation of the rotary body cannot be achieved causing a dispensing failure.

Even if clicking is definitely done to the limit of advancement, there have been the problems that the user may feel an uncomfortable sensation or may click once again without being aware of the completion of dispensing because no clicking sensation can be obtained.

In technologies described in the above Patent Documents 6 and 7 in which indication is changed in linkage with the cam rotary body when the writing element is projected and retracted, a movable indication sleeve is further needed in addition to the Kahn clicking type dispensing mechanism that needs three movable parts, resulting in a complicated structure. However, it is still not clear whether indication is given because the indicator sleeve is driven corresponding to minute piston movement.

In view of what has been described above, the present invention is directed to provide a clicking type dispensing container that can produce rotational force upon initial movement of rotation without depending on the spring force and cam configuration only, that is constructed of a fewer number of parts than the prior art and that can dispense a fixed amount of the content by use of a thread.

The present invention is also directed to provide a clicking type dispensing container that positively lets the user clearly know the delivery of the content without having any uncomfortable sensation and without increase of parts in number and that can dispense a fixed amount of the content.

Further, the present invention is directed to provide a clicking type dispensing container having a dispensing mechanical assembly that has a simple dispensing mechanism, can be simply checked, without taking time, upon examination at the time of assembling and can be markedly improved in certainty.

Means for Solving the Problems

The first aspect of the present invention resides in a clicking type dispensing container that can dispense the content inside a reservoir by a user operating a crown disposed at the rear end of a barrel body, and has a structure, including a mechanical assembly that transforms the pressing force acting on the crown by user operation into rotational force, a threaded body fixed to the barrel body and a threaded rod screw-fitted into the threaded body, and dispensing the content by advancing the threaded rod by means of the threaded body by turning the threaded rod with the rotational force transformed by the mechanical assembly, characterized in that the mechanical assembly for transforming pressing force into rotational force includes:

a rotary body that is provided with the crown that is rotatable and restrained from axial movement, has an annular configuration having a first cam face directed forwards and a second cam face directed rearwards, and is arranged so as to be rotatable and movable in the axial direction relative to the barrel body; and, a first fixed cam face and a second fixed cam face that oppose the first cam face and second cam face, respectively, and are disposed and fixed to the barrel body with respect to the axial direction and the rotational direction, and is constructed such that at least one of the first cam face and the first fixed cam face, has a plurality of the first teeth, each having a forward-inclined slope relative to the predetermined rotational direction of the rotary body, and arranged with an identical pitch along the predetermined rotational direction, at least one of the second cam face and the second fixed cam face, has a plurality of the second teeth, each having a rearward-inclined slope relative to the predetermined rotational direction of the rotary body, and arranged with an identical pitch along the predetermined rotational direction, and in a state where the first cam face of the rotary body is put in mesh with the first fixed cam face by the pressing force, as the first cam face is guided along the forward-inclined slope of the tooth, the rotary body moves forwards and turns in the predetermined direction, whereas, as the aforementioned pressing force is released, the second cam face of the rotary body being kept in mesh with the second fixed cam face is guided along rearward-inclined slope of the second fixed cam face, the rotary body moves rearwards and turns in the predetermined direction, thereby, the threaded rod is rotated by rotation of the rotary body.

The second aspect of the present invention resides in the clicking type dispensing container having the above first feature, wherein the first cam face has a projected step in front of the slope that is inclined forwards relative to the predetermined rotational direction of the rotary body and the first fixed cam face has a recessed step in front of the slope that is inclined forwards relative to the predetermined rotational direction of the rotary body, and when the first cam face is guided along the slope of the first fixed cam face, the steps formed along the slopes of the first cam face and the first fixed cam face abut each other so as to produce a clicking sound and a clicking sensation.

The third aspect of the present invention resides in the clicking type dispensing container having the above second feature, wherein the second cam face of the rotary body and the second fixed cam face are each formed with steps directed rearwards so as to produce a clicking sound and a clicking sensation by the steps when the second cam face and the second fixed cam face mesh each other at the time of release of pressing.

The fourth aspect of the present invention resides in the clicking type dispensing container having the above third feature, wherein, in the state where the first cam face of the rotary body is put in mesh with the first fixed cam face, the second cam face on the rotary body side and the second fixed cam face are set in such a relationship as to be shifted part of one cam tooth out of phase from each other with respect to the rotational direction, and in the state where the second cam face on the rotary body side is put in mesh with the second fixed cam face, the first cam face on the rotary body side and the first fixed cam face are set in such a relationship as to be shifted part of one cam tooth out of phase from each other with respect to the rotational direction.

The fifth aspect of the present invention resides in the clicking type dispensing container having the above fourth feature, wherein the phase shift in the rotational direction is half of one cam tooth.

The sixth aspect of the present invention resides in the clicking type dispensing container having the above fifth feature, wherein a spring element that urges the rotary body rearwards so as to bring the second cam face in the rotary body into contact and in mesh with the second fixed cam face in the state of the pressing being released.

The seventh aspect of the present invention resides in the clicking type dispensing container having the above sixth feature, wherein the rotary body is formed with a variant-sectional hole such as of an oval shape or the like, the threaded body having a threaded part of a female thread and the first fixed cam face is fixed to the barrel body, and in the state where the threaded rod, having a sectional shape that fits with the variant-sectional hole of the rotary body, and formed with a male thread on the outer peripheral side thereof, is screw-fitted to the threaded part of the threaded body and the threaded rod is fitted through the variant-sectional hole of the rotary body, the threaded rod is rotated by rotation of the rotary body.

The eighth aspect of the present invention resides in the clicking type dispensing container having the above seventh feature, wherein when the threaded rod is rotated so as to advance a content thrusting member by rotation of the rotary body with markers such as slits, indentations and projections, or the like, that can be easily seen from the outside, integrally formed on the outer peripheral surface thereof, at intervals of twice the distributed pitch of, and arranged in phase with, the first teeth, and the motion of the markers on the outer surface of the rotary body can be observed through windows formed of via-holes or transparent parts in the threaded body or a barrel cylinder at positions distributed at the same angles as the distributed angles of the cam to be used for rotation, whereby advancement of the threaded rod with rotation of the rotary body can be confirmed by the motion of the markers.

The ninth aspect of the present invention resides in a clicking type dispensing container that can dispense the content by pressing a rear end part of a clicking body arranged at the rear end of a barrel body, forwards in the axial direction and has a structure, including a mechanical assembly that transforms the pressing force acting on the rear end part of the clicking body into rotational force, and dispensing the content by advancing a threaded rod by the transformed rotational force, characterized in that the clicking body includes a cam face having serrated notches and projections formed on the front face of the clicking body, and arranged in the barrel body so as to be slidable in the axial direction in accordance with the pressing at the rear end of the clicking body and restrained from moving in the rotational direction, the mechanical assembly for transforming the pressing force at the rear end of the clicking body into rotational force includes:

the cam face of the clicking body;

a rotary body, having an approximately annular rotational configuration in which a first cam face having notches and projections directed rearwards in the axial direction and a second cam face having notches and projections directed forwards in the axial direction, and being arranged such that the first cam face opposes the cam face of the clicking body);

a threaded body as a whole, having an approximately cylindrical configuration having a cam face having notches and projections directed rearwards in the axial direction and a threaded part formed in a bore to which a threaded rod is screw fitted, and fixed to the barrel body so as to oppose the second cam face of the rotary body; and, a spring disposed between the clicking body and the rotary body so as to constantly urge the second cam face of the rotary body against the cam face of the threaded body to keep the cam faces in mesh with each other, at least one of the cam face of the clicking body and the first cam face of the rotary body and at least one of the second cam face of the rotary body and the cam face of the threaded body, are formed with a first slope and a second slope, respectively, which are each inclined to one side in the axial direction relative to the predetermined rotational direction of the rotary body, the inclined angle of the first slope and the inclined angle of the second slope are made different from each other, and, when the clicking body is pushed to advance, the rotary body rotates in the predetermined rotational direction while the first cam face of the rotary body slides along the cam face of the clicking body and the second cam face slides along the cam face of the threaded body, due to the difference between the inclined angles of the first slope and the second slope.

Effect Of The Invention

The clicking type dispensing containers according to the first to ninth aspects of the present invention are characterized by inclusion of a mechanical assembly that transforms pressing force into rotational force by pressing a crown so as to move a rotary body forwards and backwards in the axial direction and thereby rotate the rotary body.

Specifically, the mechanical assembly for transforming the pressing force acting on the crown into rotational force, includes: an approximately annular rotary body that is formed with a first cam face directed forwards and a second cam face directed rearwards; and a first fixed cam face and a second fixed cam face that oppose the first cam face and second cam face, respectively and are disposed and fixed to the barrel body with respect to the axial direction and the rotational direction, and is constructed such that, in the state where the first cam face of the rotary body is put in mesh with first fixed cam face by the pressing force, as the first cam face is guided along the forward-inclined surface of the tooth, the rotary body moves forwards and turns in the predetermined direction, whereas, as the aforementioned pressing force is released, the second cam face of the rotary body being kept in mesh with the second fixed cam face is guided along the rearward-inclined surface of the second fixed cam face, so that the rotary body moves rearwards and turns in the predetermined direction.

Accordingly, when the crown is pressed and released repeatedly, the rotary body is linked with rotational motion of every cam tooth and rotated when pressing and releasing so that the threaded rod can be advanced by rotation. As the above clicking operation is repeated, the clicking motion and releasing motion in the axial direction are transformed into rotational force so as to rotate the threaded rod, whereby it is possible to thrust, for example a piston body forwards and dispense a fixed amount of the content.

In addition, since the strength of the rotational force for initial rotation depends on the pressing force, it is possible to easily deal with a case where force greater than a certain level is needed for initial rotation because of sticking of the piston body to the reservoir, or the like.

In the second aspect of the present invention, as the first cam face of the rotary body being put in mesh with the first fixed cam face by pressing force, is guided along the forward-inclined slope of the first fixed cam face, the rotary body moves forwards and rotates in the predetermined rotational direction, at the same time, the steps formed on the first cam face and the slope of the first fixed cam face collide with each other, producing a clicking sound and a clicking sensation when the first cam face is guided along the slope of the first fixed cam face, whereby the user who is pressing the crown by the hand and fingers can hear the clicking sound and feel the clicking sensation in their hand and fingers. As a result, the limit of advancement of clicking can be felt clearly and the completion of the pushing operation of the crown is made simple, so that rotation of the rotary body can be achieved without causing any dispensing failure. Further, since a clear clicking sensation can be obtained when clicking has been positively performed to the limit of advancement, it is possible to feel a comfortable sensation of operation, hence confirm the completion of dispensing, never needing additional clicking.

In the third aspect of the present invention, since the second cam face of the rotary body and the second fixed cam face are each formed with steps directed rearwards, it is possible to produce a clicking sound and a clicking sensation by the steps when the second cam face and the second fixed cam face mesh each other at the time of release of pressing.

In the fourth aspect of the present invention, in the state where the first cam face of the rotary body is put in mesh with the first fixed cam face, the second cam face on the rotary body side and the second fixed cam face are set in such a relationship as to be shifted part of one cam tooth out of phase from each other with respect to the rotational direction, and in the state where the second cam face on the rotary body side is put in mesh with the second fixed cam face, the first cam face on the rotary body side and the first fixed cam face are set in such a relationship as to be shifted part of one cam tooth out of phase from each other with respect to the rotational direction. Accordingly, the phase shifts between the teeth assure reliable transformation of the pressing and releasing actions of the crown into rotation of the rotary body, due to the function of the cams.

The phase shift may be set at ¼ to ¾ of one cam teeth. In this case, if the phase shift is set at half as in the fifth aspect of the present invention, it is possible to transform the pressing and releasing actions of the crown into rotation of the rotary body in a more reliable manner.

If the first cam face and the second cam face are in phase with each other, it is possible to shift the first fixed cam face and the second fixed cam face out of phase.

According to the sixth and seventh aspects of the present invention, when a spring element that urges the rotary body rearwards so as to bring the second cam face in the rotary body into contact and in mesh with the second fixed cam face in the state of the pressing being released, it is possible to positively cause the second cam face to abut the second fixed cam face when pressing is released, hence make the operation reliable.

According to the eighth aspect of the present invention, when the threaded rod is rotated so as to advance a content thrusting member by rotation of the rotary body with markers such as slits, indentations and projections, or the like, that can be easily seen from the outside, integrally formed on the outer peripheral surface thereof, at intervals of twice the distributed pitch of, and arranged in phase with, the first teeth, and the motion of the markers on the outer surface of the rotary body can be observed through windows formed of via-holes or transparent parts in the threaded body or a barrel cylinder at positions distributed at the same angles as the distributed angles of the cam to be used for rotation, whereby advancement of the threaded rod with rotation of the rotary body can be confirmed by the motion of the markers. This configuration makes it possible to directly check the rotary body rotating by visual observation through the window of the threaded body when the dispending mechanical assembly is assembled, hence it is possible to exactly and reliably check whether the mechanism works correctly at the time of assembling.

The ninth aspect of the present invention is characterized by inclusion of the structure of dispensing the content by rotating the rotary body as the clicking body is moved forwards and backwards when the rear end of the clicking body is clicked. At least one of the cam face of the clicking body and the first cam face of the rotary body and at least one of the second cam face of the rotary body and the cam face of the threaded body, are formed with a first slope and a second slope, respectively, which are each inclined to one side in the axial direction relative to the predetermined rotational direction of the rotary body, the inclined angle of the first slope and the inclined angle of the second slope are made different from each other, so that when the clicking body is pushed to advance, the cam face of the clicking body moves sliding along the first cam face and the second cam face moves sliding along the cam face of the threaded body, due to the difference between the inclined angles of the first slope and the second slope. As a result, in the clicking type dispensing container of the present invention, the forward and backward motion of the clicking body is transformed into rotational motion of the rotary body. Then the clicking body retracts with its cam face moving away from the first cam face, and the cam face of the threaded body becomes in mesh with the second cam face of the rotary body due to the urging force of the spring.

Thus, as the pressing force on the rear end of the clicking body is applied and released repeatedly, the configuration including a lower number of parts, i.e., the clicking body, rotary body, threaded body and spring, causes the rotary body to rotate in linkage with the action of one cam tooth (which can be formed of slopes having a peak in between or walls), rotationally drives the threaded rod successively to achieve screw feeding, whereby it is possible to realize a mechanism that can dispense a fixed amount of the content with a markedly reduced number of parts than needed in the prior art.

BEST MODE FOR CARRYING OUT THE INVENTION

Figure 1A:
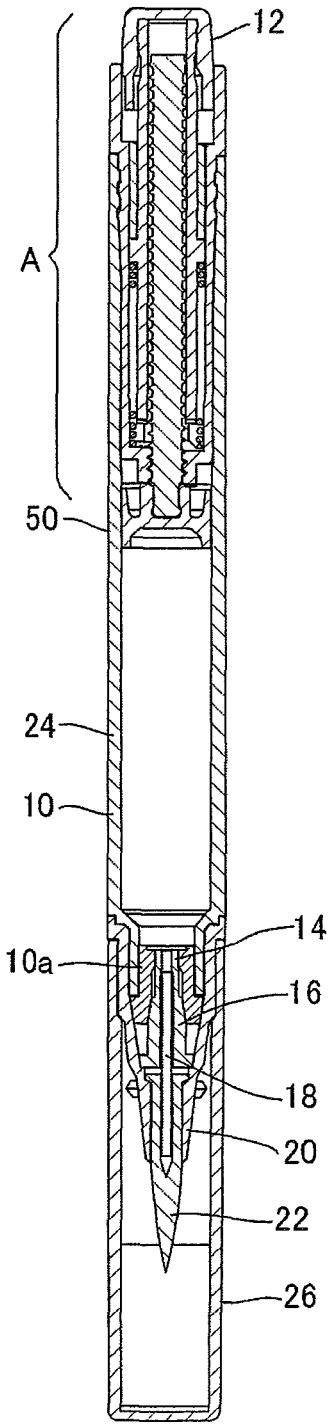
FIGS. 1(*a*) and (*b*) are illustrative views of a clicking type dispensing container according to the first embodiment of the present invention, showing an overall sectional representation of the clicking type dispensing container and an enlarged view of a mechanical assembly before a crown is pressed.

The embodiments of the present invention will be described hereinbelow with reference to the accompanying drawings.

A clicking type dispensing container according to the present invention will be described based on the first embodiment shown in the drawings.

Figure 1B:
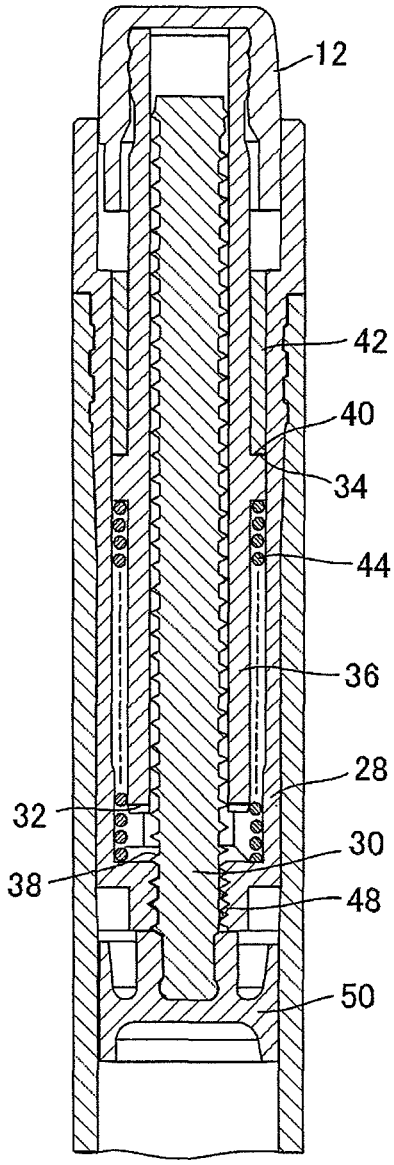
Figure 2A:
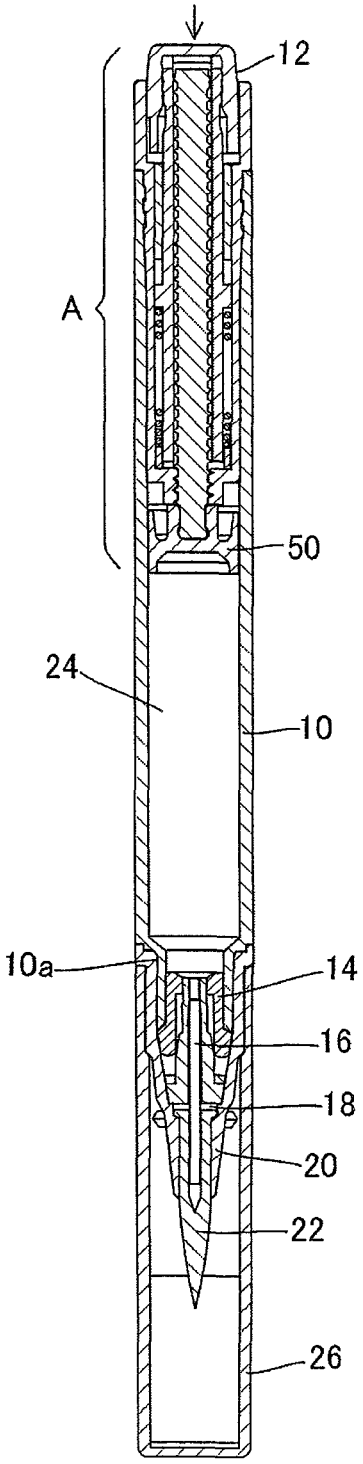
FIGS. 2(*a*) and (*b*) are an overall sectional representation of the clicking type dispensing container shown in FIG. 1 and an enlarged view of the mechanical assembly when the crown is pressed.
Figure 2B:
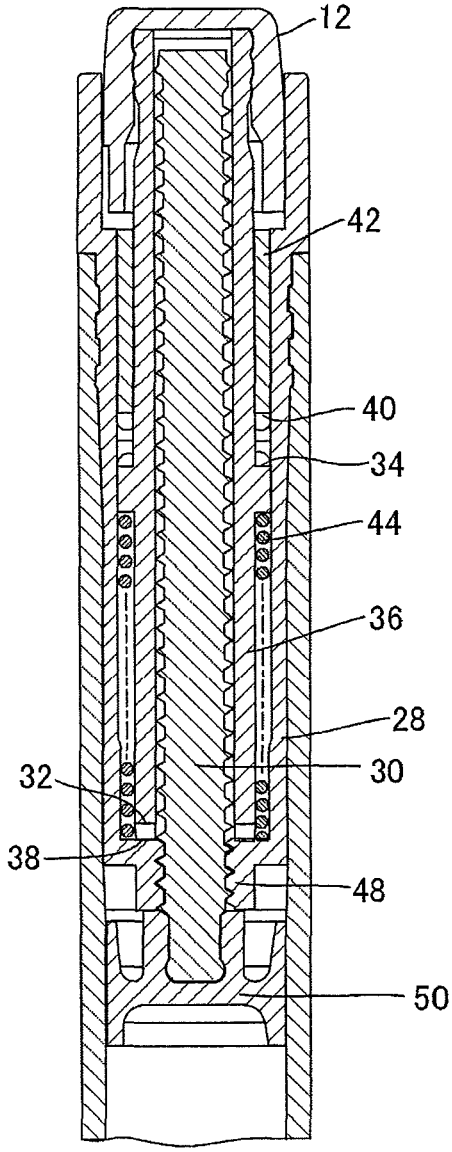
Figure 3A:
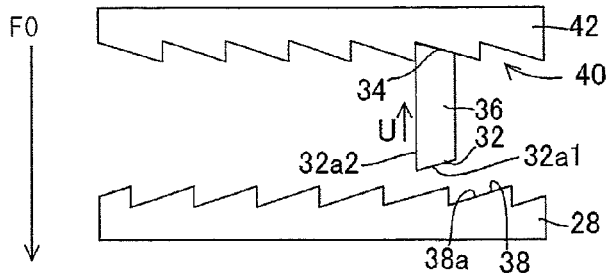
FIGS. 3(*a*) to (*e*) are operational illustrative views of the clicking mechanism of the clicking type dispensing container.
Figure 3B:
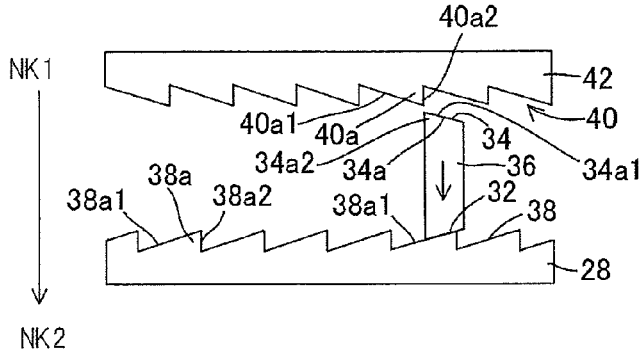
Figure 3C:
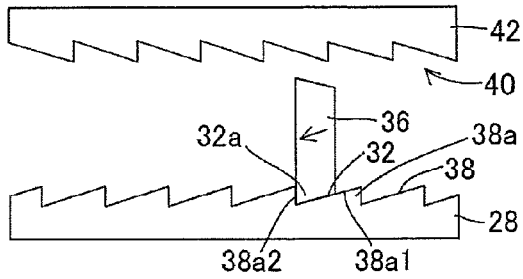
Figure 3D:
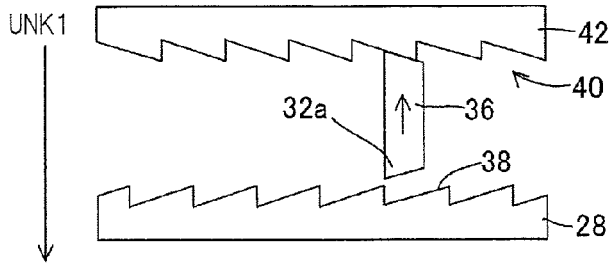
Figure 3E:
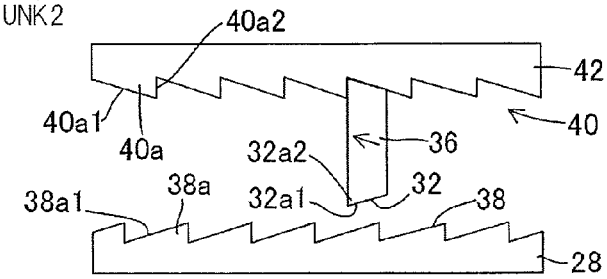
Figure 4A:
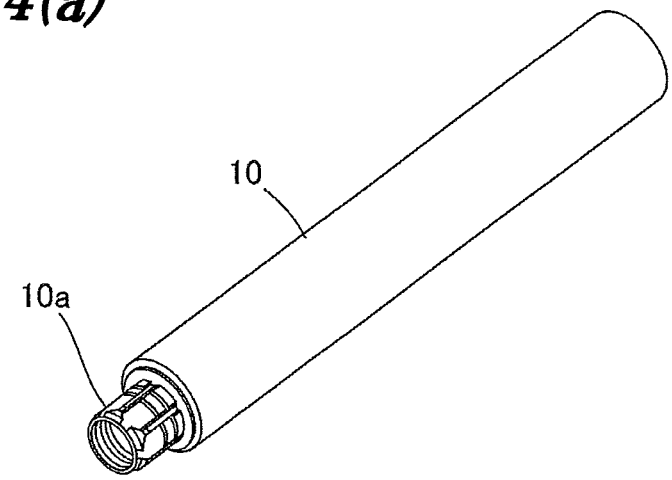
FIGS. 4(*a*) and (*b*) are a perspective view and vertical sectional view of a barrel body.
Figure 4B:
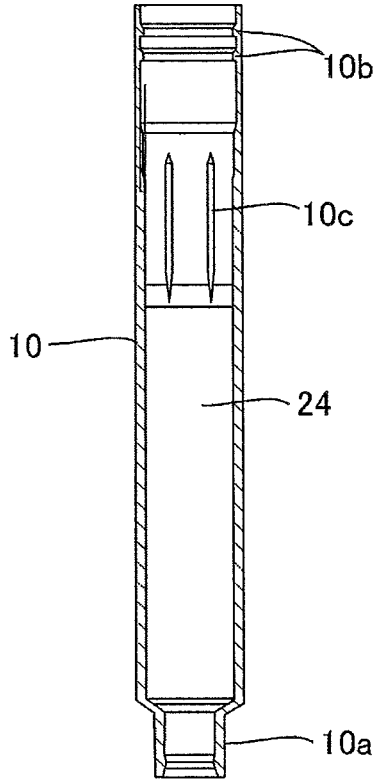
Figure 5A:
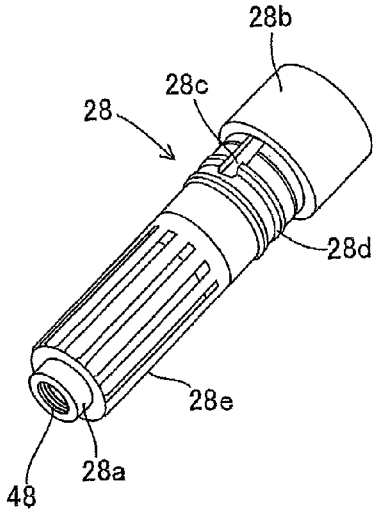
FIGS. 5(*a*), (*b*), (*c*) and (*d*) are a front perspective view, rear perspective view, vertical sectional view and enlarged sectional view of a threaded body.
Figure 5B:
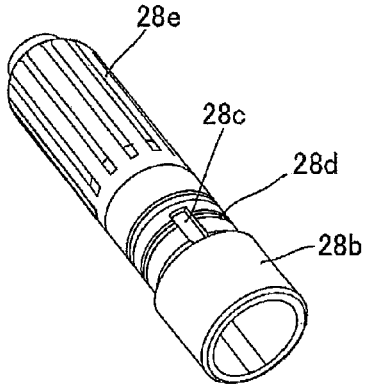
Figure 5C:
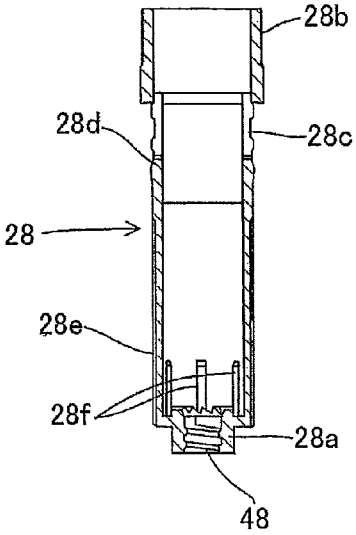
Figure 5D:
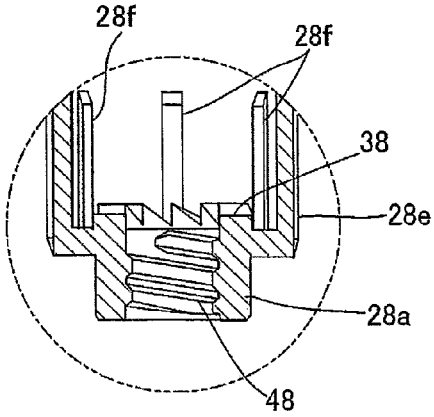
Figure 6A:
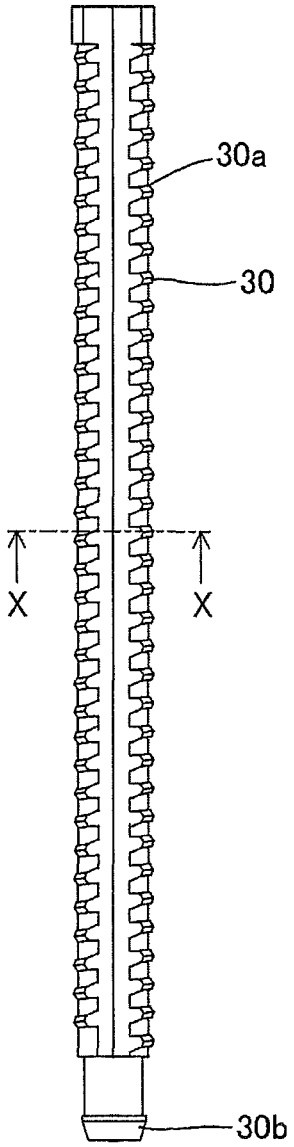
FIGS. 6(*a*) and (*b*) are a side view and a sectional view cut along line X-X of a threaded rod.
Figure 6B:
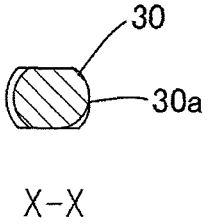
Figure 7A:
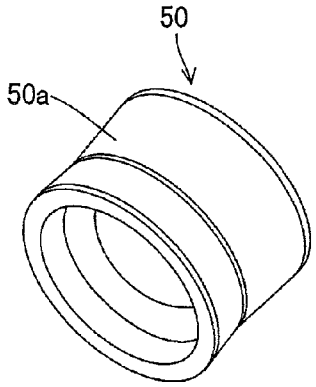
FIGS. 7(*a*), (*b*) and (*c*) are a front perspective view, rear perspective view and vertical sectional view of a piston body.
Figure 7B:
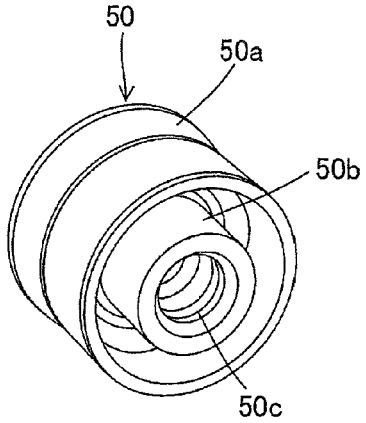
Figure 7C:
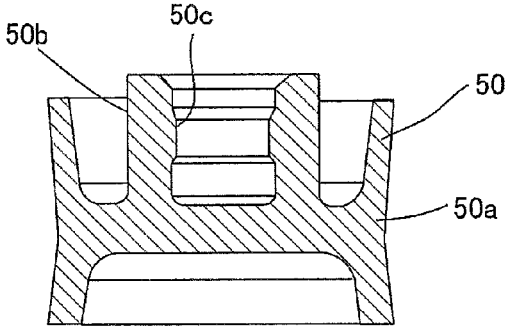
Figure 8A:
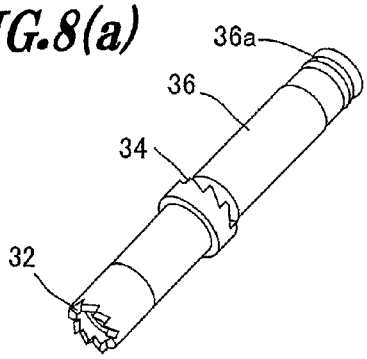
FIGS. 8(*a*), (*b*), (*c*), (*d*) and (*e*) are a front perspective view, rear perspective view, side view, vertical sectional view and front view of a rotary body.
Figure 8B:
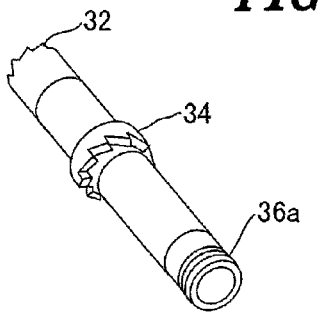
Figure 8C:
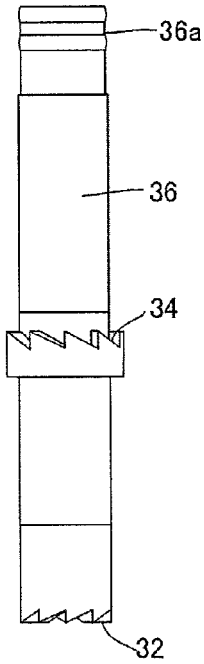
Figure 8D:
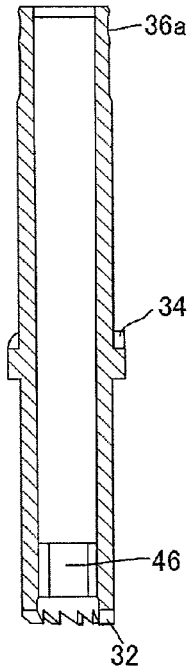
Figure 8E:
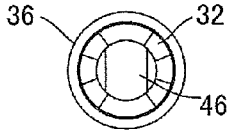
Figure 9A:
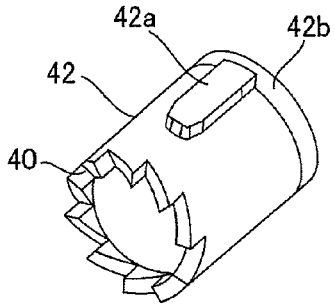
FIGS. 9(*a*), (*b*), (*c*) and (*d*) are a front perspective view, rear perspective view, side view and vertical sectional view of a cam body.
Figure 9B:
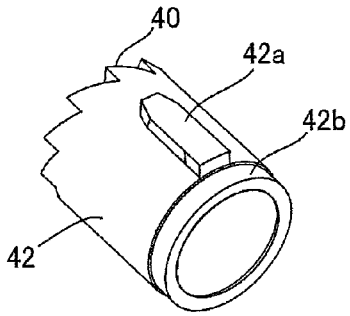
Figure 9C:
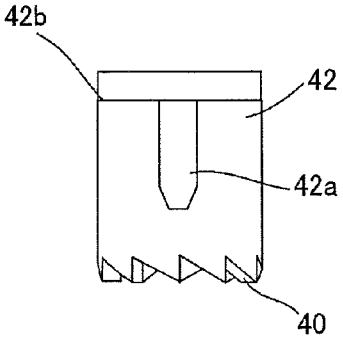
Figure 9D:
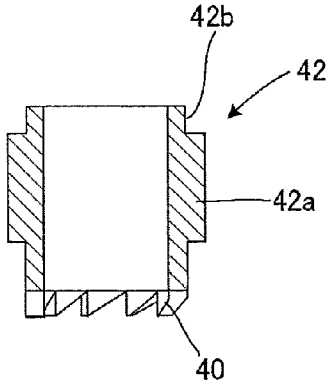
Figure 10A:
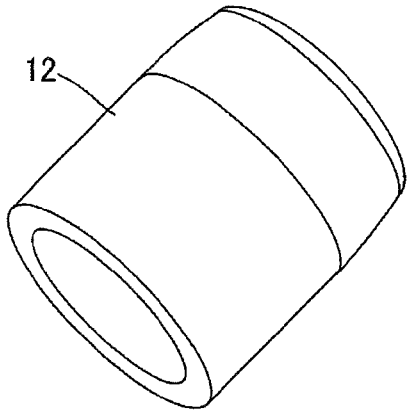
FIGS. 10(*a*), (*b*) and (*c*) are a front perspective view, side view and vertical sectional view of a crown.
Figure 10B:
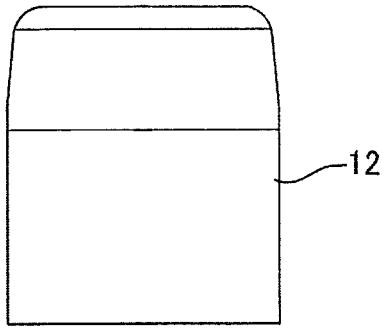
Figure 10C:
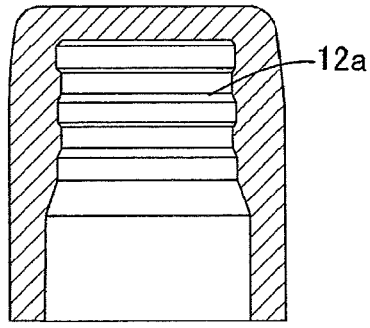

FIGS. 1 to 10 are illustrative views showing a clicking type dispensing container according to the first embodiment. Specifically, FIGS. 1(*a*) and (*b*) are illustrative views of a clicking type dispensing container according to the first embodiment of the present invention, showing an overall sectional representation of the clicking type dispensing container and an enlarged view of a mechanical assembly before a crown is pressed. FIGS. 2(*a*) and (*b*) are an overall sectional representation of the clicking type dispensing container shown in FIG. 1 and an enlarged view of the mechanical assembly when the crown is pressed. FIGS. 3(*a*) to (*e*) are operational illustrative views of the clicking mechanism of the clicking type dispensing container. FIGS. 4(*a*) and (*b*) are a perspective view and vertical sectional view of a barrel body. FIGS. 5(*a*), (*b*), (*c*) and (*d*) are a front perspective view, rear perspective view, vertical sectional view and enlarged sectional view of a threaded body. FIGS. 6(*a*) and (*b*) are a side view and a sectional view cut along line X-X of a threaded rod. FIGS. 7(*a*), (*b*) and (*c*) are a front perspective view, rear perspective view and vertical sectional view of a piston body. FIGS. 8(*a*), (*b*), (*c*), (*d*) and (*e*) are a front perspective view, rear perspective view, side view, vertical sectional view and front view of a rotary body. FIGS. 9(*a*), (*b*), (*c*) and (*d*) are a front perspective view, rear perspective view, side view and vertical sectional view of a cam body. FIGS. 10(*a*), (*b*) and (*c*) are a front perspective view, side view and vertical sectional view of a crown.

As shown in FIG. 1, the clicking type dispensing container according to the first embodiment is a container that can dispense the content by pressing a crown 12 disposed at the rear end of a barrel body 10, forwards in the axial direction, and has a structure, including a mechanical assembly A that transforms the pressing force acting on crown 12 by user operation into rotational force, a threaded body 28 fixed to the barrel body 10 and a threaded rod 30 screw-fitted into threaded body 28, and dispensing the content by advancing the threaded rod 30 through threaded body 28 when threaded rod 30 is turned by the rotational force transformed by the mechanical assembly A.

Attached to the front end at 10*a* of barrel body 10 in the clicking type dispensing container, are a joint 14, pipe joint 16, pipe 18, front barrel 20 and brush head 22. The content dispensed from a content reservoir 24 of barrel body 10 passes through pipe 18 to be ejected to the front end of brush head 22. Also, this container is formed so that a cap 26 can be fitted after use.

Specifically, as shown in FIGS. 1 and 4, barrel body 10 has a stepped small-diametric portion forming front end part 10*a*, viewed in the axial direction. Cylindrical joint 14 and pipe joint 16 being covered by the rear part of front barrel 20, are inserted into front end part 10*a*. Brush head 22 in the form of a writing tip formed of a large number of bundled fibers or of a continuous porous body, is held as an applying element at the front part of pipe joint 16 inside the front part of front barrel 20. The applying element may employ any configuration as appropriate other than the brush head.

The joint 14 has an approximately cylindrical shape with its front end enlarged in diameter, and is fitted into front end part 10*a* of barrel body 10. Pipe joint 16 is inserted into the front opening of joint 14 from the front side. Pipe 18 for feeding liquid from reservoir 24 to brush head 22 is inserted into, and supported by, this pipe joint 16. Cap 26 is fitted to front end part 10*a* so as to cover brush head 22 and front barrel 20.

[Mechanical Assembly A for Transforming Pressing Force into Rotational Force]

Mechanical assembly A for transforming the pressing force by pressing the crown 12 into rotational force is essentially composed of a rotary body 36 having a first cam face 32 and a second cam face 34, a threaded body 28 having a first fixed cam face 38 and a cam body 42 having a second fixed cam face 40.

[Rotary Body 36]

As shown in FIGS. 1 and 8, rotary body 36 is arranged so that crown 12 is rotatable and restrained from moving in the axial direction, has an annular configuration with first cam face 32 directed forwards and second cam face 34 directed rearwards and is disposed to be rotatable, and movable in the axial direction, relative to barrel body 10.

As shown in FIG. 8, rotary body 36 has an approximately hollow cylindrical annular overall configuration. Formed at its front end with respect to the axial direction is the first cam face on the front side, and an oval or any other variant-sectional hole 46 is formed in the bore of the rotary body. Further, a stepped large-diametric annular portion whose rearward face has second cam face 34 directed rearwards is formed in the middle of rotary body 36 with respect to the axial direction, on the outer peripheral side thereof. A flange-like bumped fitting portion 36*a* is formed on the outer peripheral side at the rear end of rotary body 36.

Here, as shown in FIG. 10, crown 12 is a cylindrical vessel-like configuration that is closed at one axial end has an engaging portion 12*a* formed of bumped steps in the inner peripheral portion at the rear end. When the rear end of the rotary body 36 is pushed in from the front opening of crown 12, the fitting portion fits into the engaging portion 12*a*. The dimensions of fitting portion 36*a* and engaging portion 12*a* are so specified that crown 12 can rotate, and is restrained from moving in the axial direction, relative to rotary body 36.

[Threaded Body 28]

The threaded body 28 is an approximately hollow-cylinder that is formed with a stepped front end part having a reduced diameter and a stepped rear end part having an enlarged diameter, as shown in FIGS. 1 and 5. The front end part is a stepped cylindrical part 28*a* reduced in diameter, whose bore is formed with a threaded part 48 of a female thread. First fixed cam face 38 is formed on the rear side of cylindrical part 28*a* having threaded part 48.

A stepped cylindrical portion 28*b* having an enlarged diameter in the rear end part of threaded body 28 is a part into which crown 12 is fitted in so as to be rotatable and movable forwards and backwards. In the part adjacent to the front of cylindrical portion 28*b*, a plurality of slits 28*c* that pass through from the interior to the exterior of threaded body 28 are formed so as to be extended in the axial direction and a bumped fitting portion 28*d* is formed on the outside periphery. Further, a plurality of grooves 28*e* extending in the axial direction are formed on the front outer periphery.

Ribs 28*f* for positioning the radial position of an after mentioned spring element 44 are projected inwards and extended in the axial direction in the front inner periphery of threaded body 28.

[Barrel Body 10]

As shown in FIG. 4, barrel body 10 has a front end part 10*a* that is reduced in diameter. On the inner peripheral surface, a bumped and step-formed fitting portion 10*b* is formed at the rear end part, and ribs 10*c* that are projected inwards and axially extended are formed in the middle part more or less closer to the rear. When threaded body 28 is fitted to barrel body 10, the threaded body 28 is inserted forwards from the open rear end of barrel body 10 and advanced and fitted while the ribs 10*c* are being fitted to the grooves 28*e*.

Further, threaded body 28 is squeezed while fitting portion 10*b* is made to pass over the bumps of fitting portion 28*d*. At this time, threaded body 28 is advanced until the stepped enlarged diametric portion of cylindrical portion 28*b* abuts the rear end face of barrel body 10. Since ribs 10*c* and fitting portion 10*b* are closely fitted to grooves 28*e* and fitting portion 28*d*, respectively, threaded body 28 is attached to barrel body 10 in a fixed relationship with respect to the rotational direction and axial direction.

Here, the front space of threaded body 28 of barrel body 10 forms reservoir 24 for the content.

[Cam Body 42]

As shown in FIG. 9, the cam body 42 has an approximately cylindrical hollowed configuration that has second fixed cam face 40 formed on the front end side, a projected portion 42*a* formed on the outer peripheral side and extended from the middle to the rear and a rear end part 42*b* slightly stepped and reduced in diameter.

As shown in FIG. 1, this cam body 42 being fitted on the outer periphery of rotary body 36 in a movable manner, is inserted into threaded body 28 so that projected portion 42*a* fits into slit 28*c* of threaded body 28 and rear end part 42*b* is engaged inside cylindrical portion 28*b*. With this arrangement, cam body 42 is fixed so as not to move in the rotational direction and in the axial direction relative to threaded body 28. Further, since threaded body 28 is fixed to barrel body 10 as described above, cam body 42 is also fixed so as not to move in the rotational direction and in the axial direction relative to barrel body 10.

[Spring Element 44]

As shown in FIG. 1, spring element 44 is disposed inside threaded body 28, between the side of the projected portion that circularly projected on the periphery of the rotary body 36, opposite to second cam face 34 and the portion that encloses first fixed cam face 38 of threaded body 28. This spring element 44 functions to urge rotary body 36 rearwards so that second cam face 34 of the rotary body 36 abuts the second fixed cam face 40 so as to be engaged therewith when the pressure on crown 12 is released.

[Threaded Rod 30 and Piston Body 50]

As shown in FIG. 6, threaded rod 30 is a bar-like long part, having a cross-section fitting to variant-sectional hole 46 of the rotary body 36 and formed with a male thread 30*a*. A fitting part 30*b* that is projected radially outwards like a flange is formed in the front end part. Fitted on the front end of the threaded rod 30 is a piston body 50 that is integrally moved with the threaded rod 30 in the axial direction so as to be slidable along barrel body 10.

As shown in FIGS. 1 and 7, this piston body 50 includes a main part 50*a* that slides along the inner wall of reservoir 24, a hollowed cylindrical part 50*b* that is extended rearwards from main part 50*a* and a bumped fitting part 50*c* inside hollowed cylindrical part 50*b*. Fitting part 30*b* at the front end of threaded rod 30 is fitted into this fitting part 50*c* of the piston body 50 so that the former is rotatable, and restrained from moving forward and backward, relative to the latter. In this condition, piston body 50 is arranged so as to be movable forward and backward inside reservoir 24 of barrel body 10.

As shown in FIG. 1, the rotary body 36 is formed with oval sectional or any other variant-sectional hole 46. Threaded body 28 having threaded part 48 of a female thread and first fixed cam face 38 is fixed to barrel body 10. Threaded rod 30, having a sectional shape that fits with variant-sectional hole 46 of the rotary body 36, and formed with male thread 30*a* on the outer peripheral side thereof, is screw-fitted to the threaded part of the threaded body 28 and arranged so as to penetrate through variant-sectional hole 46 of the rotary body 36. Under this condition, threaded rod 30 is rotated by rotation of the rotary body 36. This rotation causes piston body 50 to advance inside reservoir 24 to feed the liquid content such as cosmetics etc. to brush head 22 as the applying part inside front barrel 20.

First fixed cam face 38 and second fixed cam face 40 oppose the first cam face 32 and second cam face 34, respectively and are arranged in barrel body 10 so as to be fixed with respect to the axial direction and the rotational direction.

First fixed cam face 38 and second fixed cam face 40, and the first cam face 32 and the second cam face 34 will be described in detail with reference to FIG. 3. In FIG. 3, for convenience of explanation and illustration, only one tooth is depicted for the first cam face 32 and second cam face 34. However, in the first embodiment, a plurality of teeth are formed as shown in FIG. 8. Of course, if teeth are closely and contiguously without gap formed on one of the cam faces that oppose each other, the number of teeth on the other cam face may be one or plural.

Detailedly, first cam face 32 and first fixed cam face 38 have a plurality of first teeth 32*a* and 38*a*, respectively, formed with the same pitch in the predetermined rotational direction of rotary body 36, each of first teeth 32*a* and 38*a* having a slope 32*a*1 or 38*a*1 that is inclined forwards (downwards in the front view in FIG. 3) relative to the predetermined rotational direction (leftward in the front view in FIG. 3).

Second cam face 34 and second fixed cam face 40 have a plurality of second teeth 34*a* and 40*a*, respectively, formed with the same pitch in the predetermined rotational direction of rotary body 36, each of second teeth 34*a* and 40*a* having a slope 34*a*1 or 40*a*1 that is inclined rearwards (upwards in the front view in FIG. 3) relative to the predetermined rotational direction (leftward in the front view in FIG. 3). Here, in the first embodiment, the pitch of first cam face 32 and first fixed cam face 38 and the pitch of second cam face 34 and second fixed cam face 40 are formed to be equal to each other. When the cam faces opposing each other have different numbers of teeth, it would be sufficient if the pitch of teeth of one of first cam face 32 and first fixed cam face 38 is the same as the pitch of teeth of one of second cam face 34 and second fixed cam face 40.

In a state where first cam face 32 of the rotary body 36 is put in mesh with first fixed cam face 38 by the pressing force, as first cam face 32 is guided along forward-inclined surface 38*a*1 of the tooth 38*a* (see FIGS. 3(*b*) to (*c*)), the rotary body 36 moves forwards and turns in the predetermined direction.

On the other hand, as the aforementioned pressing force is released, second cam face 34 of the rotary body 36 being kept in mesh with second fixed cam face 40 is guided along rearward-inclined surface 40*a*1 of the tooth 40*a* (see FIGS. 3(*d*) to (*e*)), so that the rotary body 36 moves rearwards and turns in the predetermined direction. Thus, the mechanical assembly A is constructed so as to actuate rotational movement by the cams operating as above, and so that rotation of rotary body 36 causes the threaded rod 30 to rotate.

Here, in the state where first cam face 32 of the rotary body 36 is in mesh with the first fixed cam face 38 (see FIG. 3(*c*)), the second cam face 34 on the rotary body 36 side and the second fixed cam face 40 are set in such a relationship as to be shifted out of phase from each other by half of one cam tooth with respect to the rotational direction. On the other hand, in the state where second cam face 34 in the rotary body 36 side is in mesh with the second fixed cam face 40 (see FIG. 3(*e*)), the first cam face 32 on the rotary body 36 side and the first fixed cam face 38 are set in such a relationship as to be shifted out of phase from each other by half of one cam tooth with respect to the rotational direction.

Further, spring element 44 that urges rotary body 36 rearwards is provided in order to bring second cam face 34 of the rotary body 36 into contact and in mesh with the second fixed cam face 40 when the pressure is released.

In sum, the clicking type dispensing container has a configuration including: in the hollow of the threaded body 28, annularly formed rotary body 36 having first cam face 32 that meshes the first fixed cam face 38 in the front part and the second cam face 34 in the rear part thereof and variant-sectional hole 46 formed in the bore at the front; spring element 44 disposed between the rotary body 36 and the threaded body 28 for urging rotary body 36 rearwards with respect to threaded body 28; and cam body 42 having second fixed cam face 40 meshing second cam face 34 of the rotary body 36 and fixed in the rear part of the threaded body 28, so as to hold the rotary body 36 from the front and rear between the threaded body 28 and the cam body 42 and urge the rotary body 36 toward the cam body 42 by the spring element 44.

Further, variant-sectional threaded rod 30 having a thread on the outer peripheral side is screw-fitted to threaded part 48 of the threaded body 28. The threaded rod 30 and the rotary body 36 are movable in the axial direction and locked with respect to the rotational direction due to variant-sectional hole 46 of the rotary body 36. Fitted to the front end of the threaded rod 30 is piston body 50 that is slidable along barrel body 10 and integrally moves with the threaded rod 30 in the axial direction.

Moreover, the crown 12 is arranged at the rear of the rotary body 36 in such a manner as to be rotatable and locked with respect to the axial direction.

As shown in FIG. 3, in the state where first cam face 32 of the rotary body 36 is put in mesh with the first fixed cam face 38, the second cam face 34 on the rotary body 36 side and the second fixed cam face 40 are set in such a relationship as to be shifted out of phase from each other by half of one cam tooth with respect to the rotational direction, and in the state where second cam face 34 of the rotary body 36 is in mesh with the second fixed cam face 40, the first cam face 32 on the rotary body 36 side and the first fixed cam face are set in such a relationship as to be shifted out of phase from each other by half of one cam tooth with respect to the rotational direction.

Next, the operation of the above-described first embodiment will be described.

FIGS. 3(*a*) to (*e*) show the scheme of the mutual motion of first cam face 32 and second cam face 34 of rotary body 36, first fixed cam face 38 of threaded body 28 and second fixed cam face 40 of cam body 42.

In the initial state shown in FIG. 1 where crown 12 is not clicked (pressed) (shown by code FO in FIG. 3), rotary body 36 is pushed upward against the cam body 42 side as indicated by arrow U, by spring element 44 so that second cam face 34 of rotary body 36 and second fixed cam face 40 of cam body 42 are meshing each other. In this state, second cam face 34 of rotary body 36 is located with its peak and first cam face 32 residing on the same line parallel to the axial direction and is shifted out of phase from first fixed cam face 38 of threaded body 28 by half of the pitch.

Next, as shown in FIG. 2, crown 12 is pushed in the axial direction to start clicking.

As clicking begins, the state changes from FIG. 3(*a*) to FIG. 3(*b*) (clicked state 1: shown by code NK1). Specifically, crown 12 and rotary body 36 start to integrally move forwards as spring element 44 is compressed, so that second cam face 34 of rotary body 36 goes away from second fixed cam face 40 of cam body 42.

As clinking is further continued, first cam face 32 of rotary body 36 abuts first fixed cam face 38 of threaded body 28, at a position out of phase by half of the pitch, as shown in FIG. 3(*b*).

As shown in FIG. 3(*c*), a further pressure is applied from this state of abutment (clicked state 2: shown by code NK2), slope 32*a*1 of tooth 32*a* of first cam face 32 of rotary body 36 moves sliding over slope 38*a*1 of tooth 38*a* of first fixed cam face 38 of threaded body 28 so that rotary body 36 moves forwards whilst rotating in the predetermined direction until wall 32*a*2 of the tooth 32*a* abuts wall 38*a*2 of tooth 38*a* of first fixed cam face 38 (shown in FIG. 3(*c*)). During this, crown 12 itself will not rotate since rotary body 36 is attached to crown 12 in a rotatable manner.

With the rotation of rotary body 36 at the time of clicking, threaded rod 30 that penetrates through variant-sectional hole 46 located at the front end of rotary body 36, can hence axially move but is restricted from rotating relative to rotary body 36, integrally rotates with rotary body 36. Since threaded rod 30 is screw-fitted with threaded part 48 of threaded body 28, the threaded rod moves forwards with piston body 50 so that the content of reservoir 24 is dispensed.

From this state, clicking is released.

Release of clicking is performed as spring element 44 disposed inside threaded body 28 moves up rotary body 36. At this time, second cam face 34 of rotary body 36 starts moving rearwards with its position out of phase relative to the cam part of cam body 42 by half of the pitch.

As release of clinking is further continued, second cam face 34 of rotary body 36 abuts second fixed cam face 40 of cam body 42, as shown in FIG. 3(*d*) (click-released state 1: shown by code UNK1) and then, as shown in FIG. 3(*e*), slope 34*a*1 of tooth 34*a* of second cam face 34 of rotary body 36 is moved by pushup force of spring element 44, sliding over slope 40*a*1 of tooth 40*a* of second fixed cam face 40 of cam body 42 (click-released state 2: shown by code UNK2) so that the rotary body rotates and retracts to the position where wall 34*a*2 of tooth 34*a* of second cam face 34 abuts wall 40*a*2 of tooth 40*a* of second fixed cam face 40. Also during this rotation, threaded rod 30 being rotated as above, moves forwards with piston body 50 to dispense the content.

When the above clicking operation is repeated, the clicking motion and releasing motion in the axial direction are transformed into rotational force so as to rotate threaded rod 30 and thrust piston body 50 forwards, whereby it is possible to dispense a fixed amount of the content.

In addition, since the strength of the rotational force for initial rotation depends on the pressing force, it is possible to easily deal with a case where force greater than a certain level is needed for initial rotation because of sticking of piston body 50 or the like.

It should be noted that the clicking type dispensing container of the present invention is not limited to the above embodiment. It is, of course, possible to make various changes therein without departing from the scope of the gist of the invention.

In the first embodiment, each part is preferably formed of a resin molding. It is preferable that the barrel body is formed of PP, the rotary body of POM, the cam body of ABS, the threaded body of ABS and the crown of PC.

Also, in the first embodiment, first cam face 32 of rotary body 36 and first fixed cam face 38 of threaded body 28 as well as second cam face 34 of the rotary body and second fixed cam face 40 of cam body 42, are all formed with a plurality of teeth arranged with the same pitch. However, the present invention is not limited to this configuration. One of the first cam face and the first fixed cam face may be formed of a plurality of first teeth which each have a slope inclined forwards with respect to the predetermined rotational direction and which are arranged with an identical pitch along the predetermined rotational direction while one of the second cam face and the second fixed cam face may be formed of a plurality of second teeth which each have a slope inclined rearwards with respect to the predetermined rotational direction and which are arranged with an identical pitch along the predetermined rotational direction. That is, the present invention may include a configuration in which one of the opposing cam faces is formed with a plurality of teeth while the other is formed of, other than a cam face, or a body having a circular section at the tip, or a roller body, which can be easily guided by the cam face.

Next, a clicking type dispensing mechanism according to the present invention will be described based on the second embodiment shown in the drawings.

FIGS. 11 to 21 are illustrative views of a clicking type dispensing mechanism according to the second embodiment.

Figure 11A:
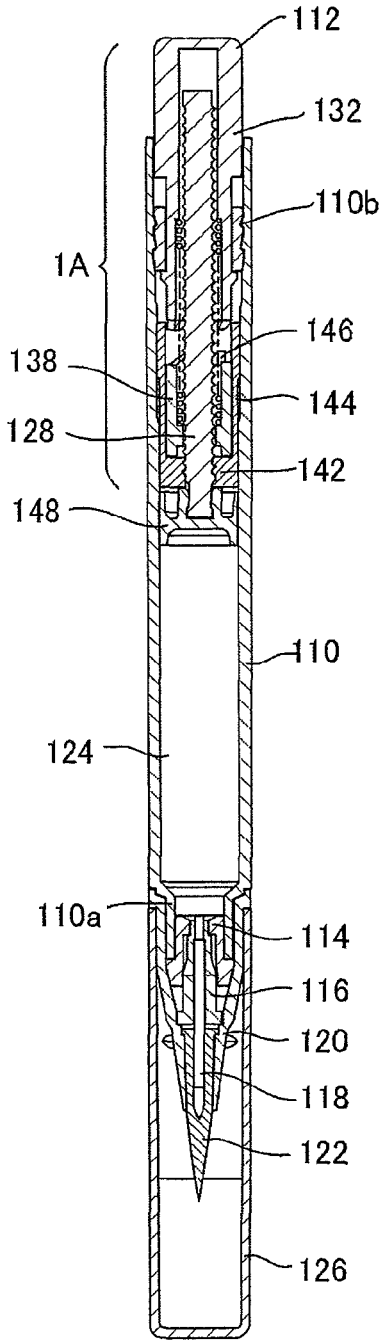
FIGS. 11(*a*) and (*b*) are illustrative views of a clicking type dispensing container according to the second embodiment of the present invention, showing an overall sectional representation of the clicking type dispensing container and an enlarged view of a mechanical assembly before the rear end of a clicking body is pressed.
Figure 11B:
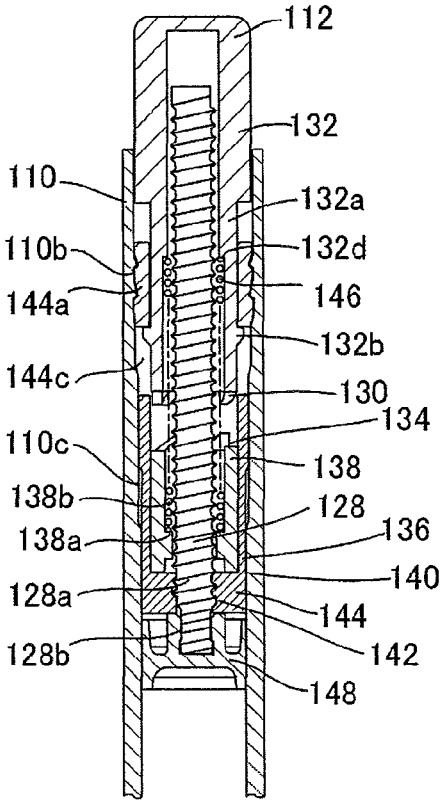
Figure 12A:
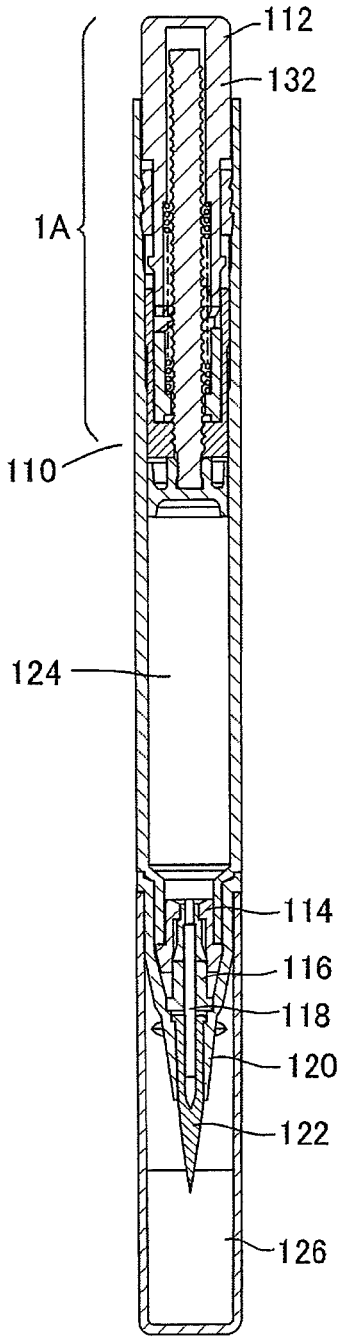
FIGS. 12(*a*) and (*b*) are an overall sectional representation of the clicking type dispensing container shown in FIG. 11 and an enlarged view of the mechanical assembly when the rear end of the clicking body is being pressed.
Figure 12B:
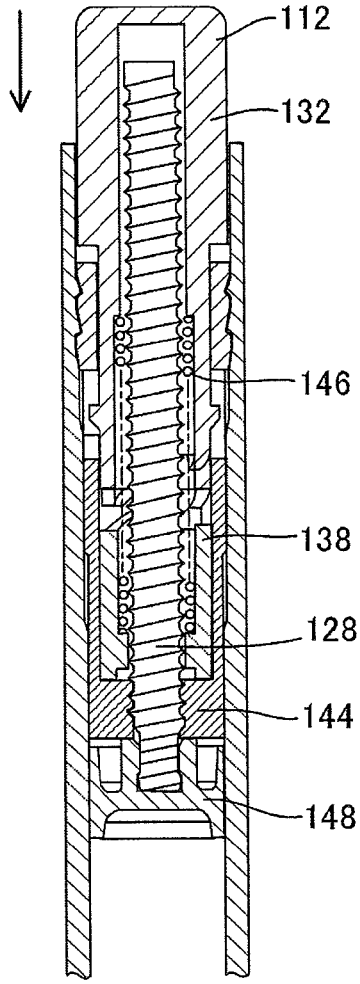
Figure 13A:
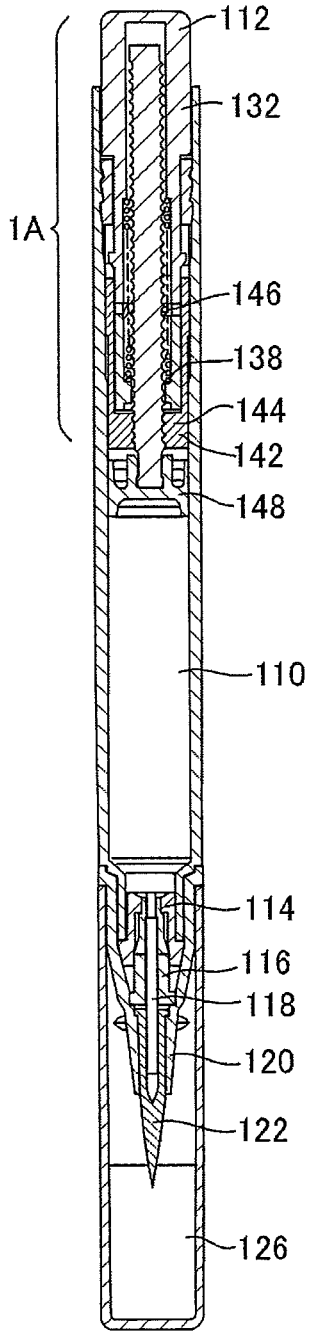
FIGS. 13(*a*) and (*b*) are an overall sectional representation of the clicking type dispensing container shown in FIG. 11 and an enlarged view of the mechanical assembly when the rear end of the clicking body is pressed to the limit.
Figure 13B:
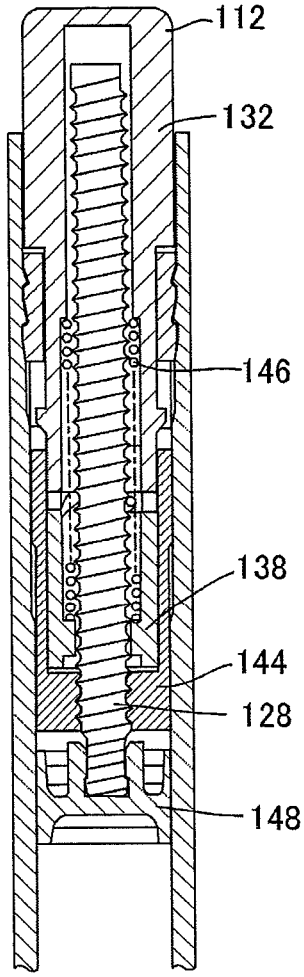
Figure 14A:
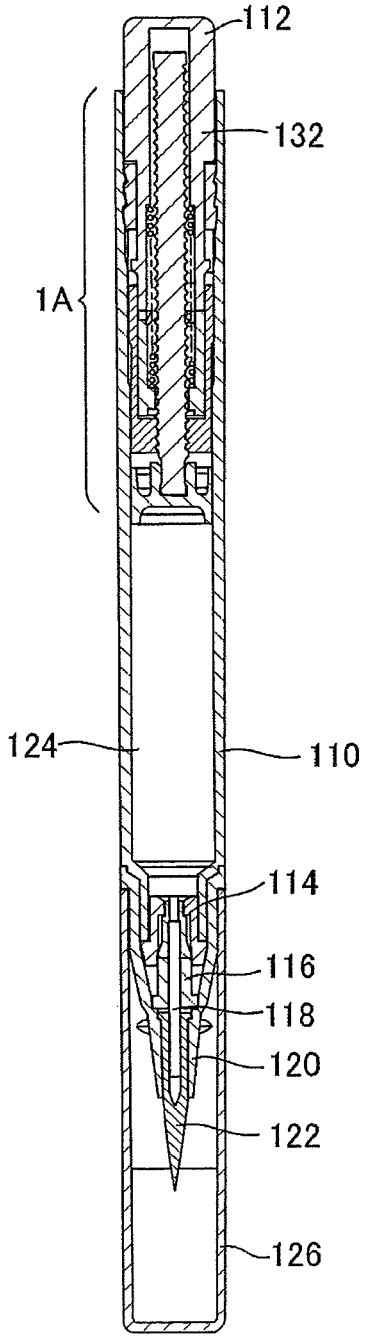
FIGS. 14(*a*) and (*b*) are an overall sectional representation of the clicking type dispensing container shown in FIG. 11 and an enlarged view of the mechanical assembly when the rear end of the clicking body is released from the state of being pressed.
Figure 14B:
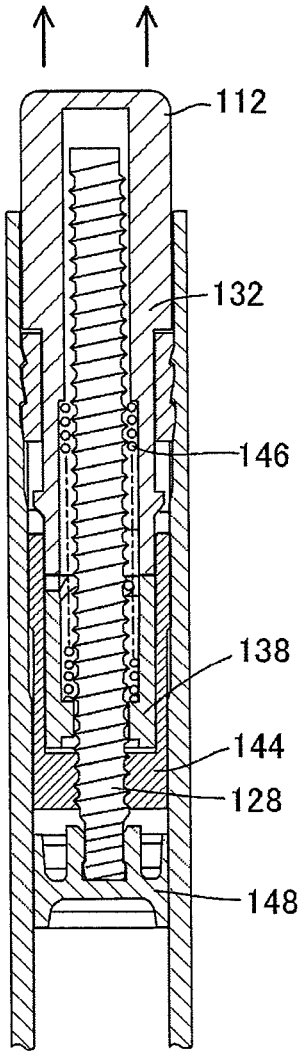
Figure 15A:
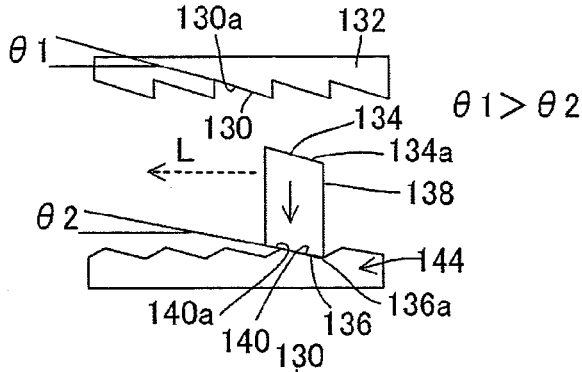
FIGS. 15(*a*) to (*f*) are illustrative views of the clicking mechanism of the dispensing container, (a) showing the original state before clicking, (b) the state when the clicking body is advanced and the rotary body is abutted, (c) the state when the rotary body is rotated by pressing the clicking body, (d) the state when the peak of the rotary body passes over as the clicking body is pressed, (e) the state when the rotary body is suspended, and (f) the state when clicking is released.
Figure 15B:
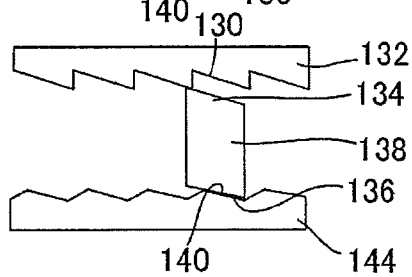
Figure 15C:
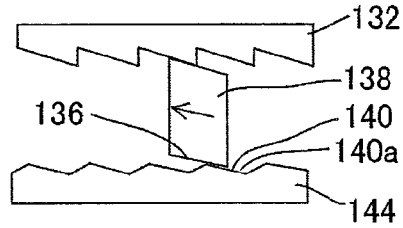
Figure 15D:
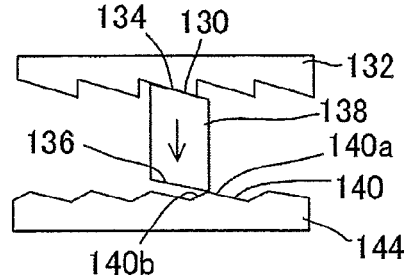
Figure 15E:
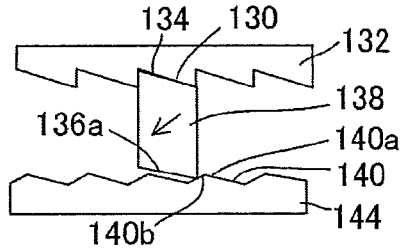
Figure 15F:
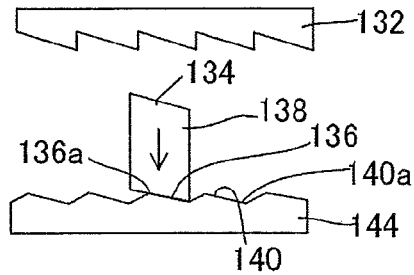

That is, FIGS. 11 to 14 show overall sectional representation of a clicking type dispensing container according to the second embodiment and enlarged views of its mechanical assembly. FIG. 11 shows a state before the rear end of a clicking body is pressed. FIGS. 12 to 14 are similar sectional views showing each step of operation.

Figure 16A:
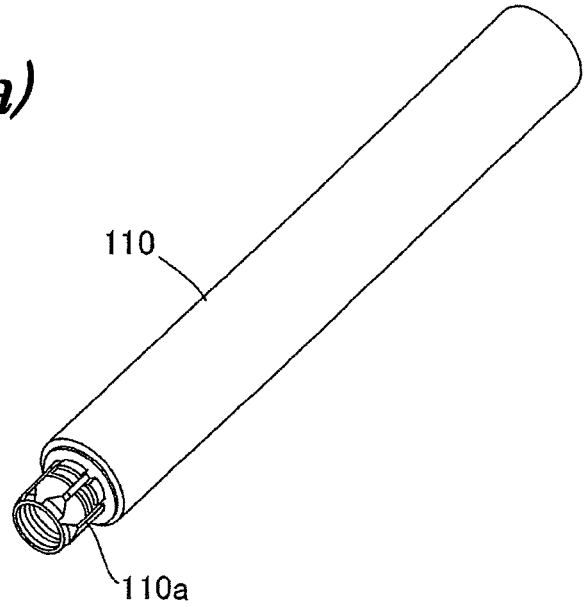
FIGS. 16(*a*) and (*b*) are a perspective view and vertical sectional view of a barrel body.
Figure 16B:
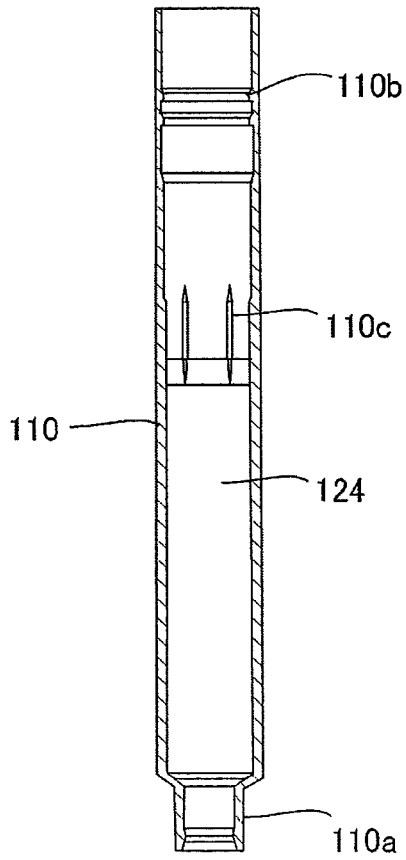
Figure 17A:
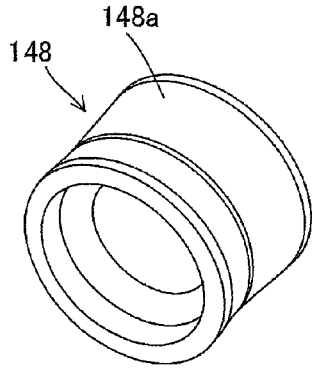
FIGS. 17(*a*), (*b*), (*c*) and (*d*) are a front perspective view, rear perspective view, side view and vertical sectional view of a piston.
Figure 17B:
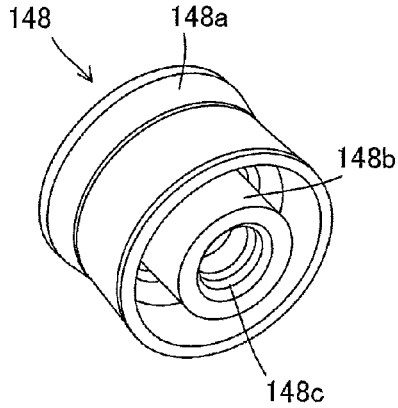
Figure 17C:
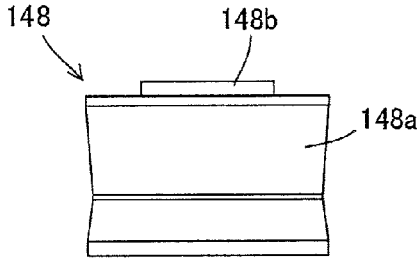
Figure 17D:
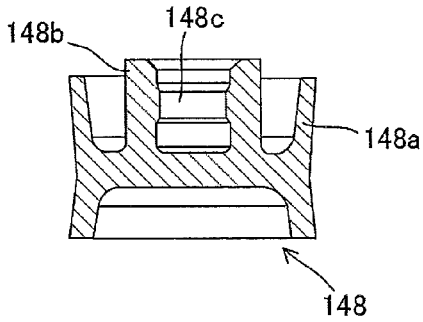
Figure 18A:
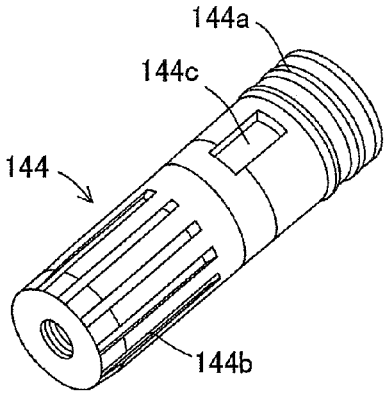
FIGS. 18(*a*), (*b*), (*c*) and (*d*) are a front perspective view, rear perspective view, side view and vertical sectional view of a threaded body.
Figure 18B:
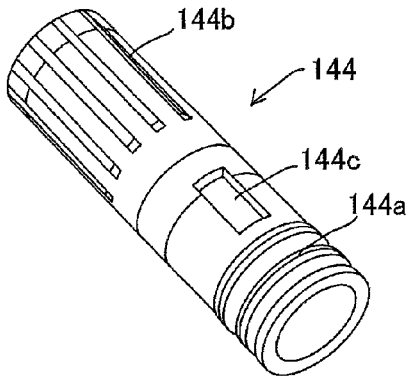
Figure 18C:
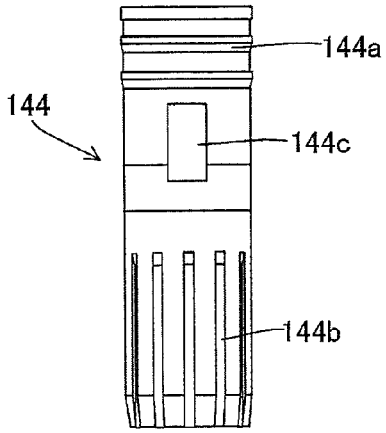
Figure 18D:
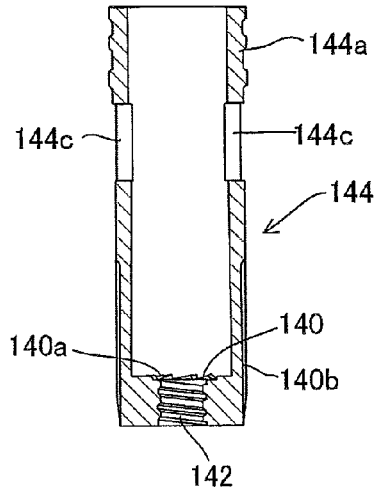
Figure 19A:
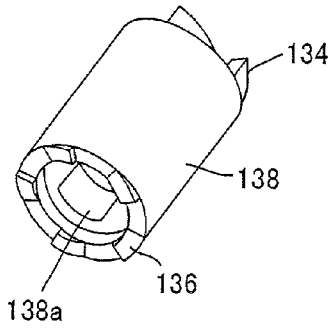
FIGS. 19(*a*), (*b*), (*c*), (*d*) and (*e*) are a front perspective view, rear perspective view, side view, vertical sectional view and front view of a rotary body.
Figure 19B:
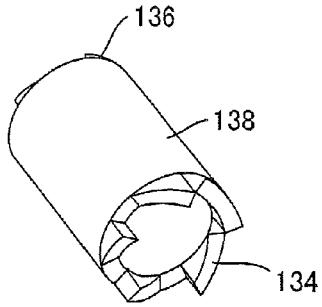
Figure 19C:
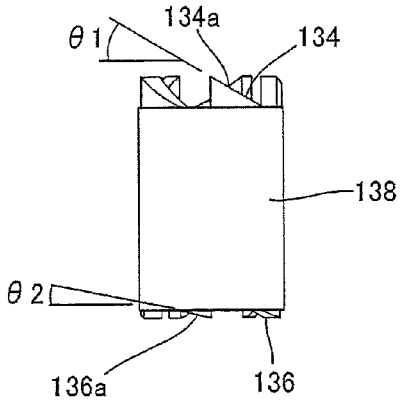
Figure 19D:
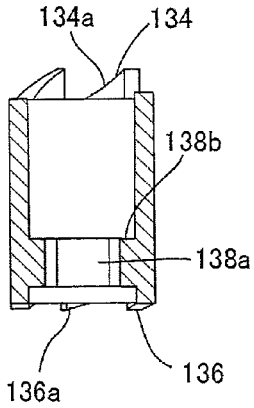
Figure 19E:
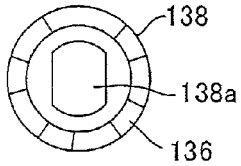
Figure 20A:
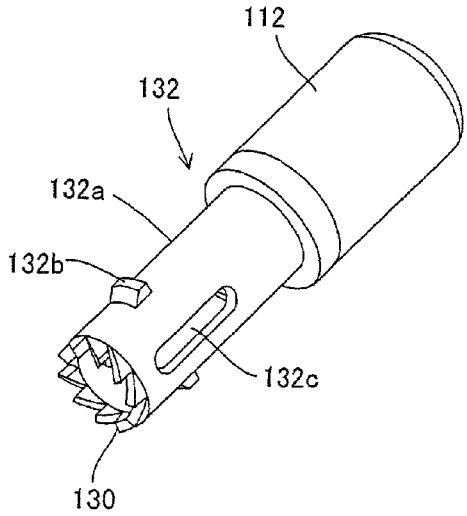
FIGS. 20(*a*), (*b*), (*c*) and (*d*) are a front perspective view, rear perspective view, side view and vertical sectional view of a clicking body.
Figure 20B:
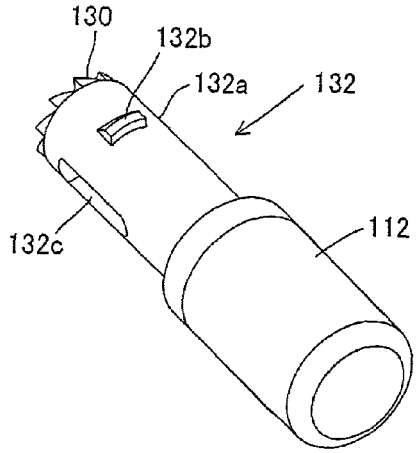
Figure 20C:
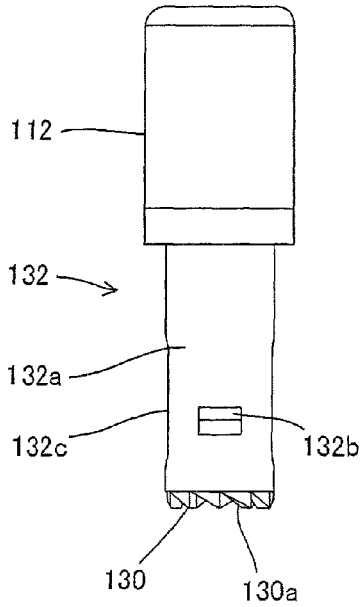
Figure 20D:
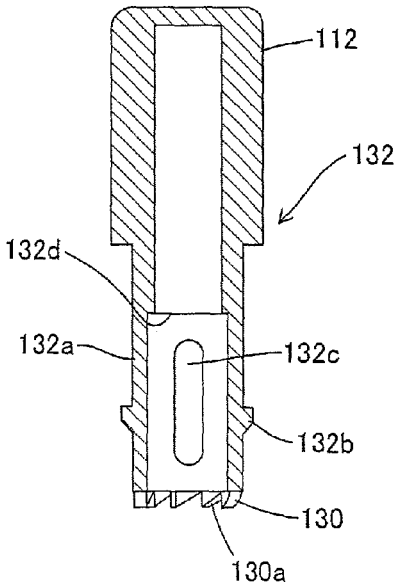
Figure 21A:
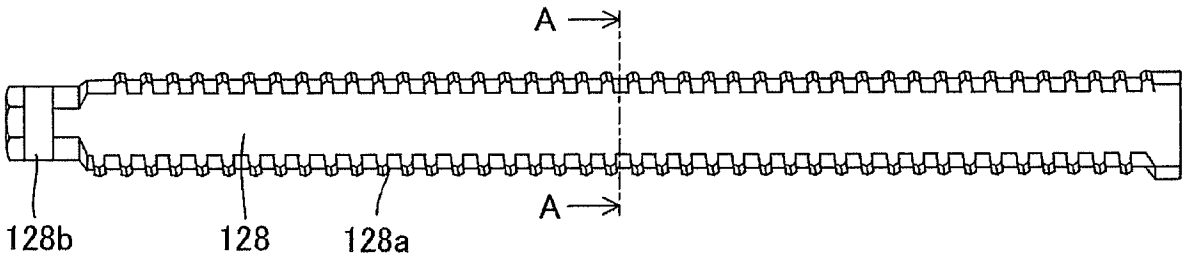
FIG. 21(*a*) and (*b*) are a side view and a sectional view cut along line A-A of a threaded rod.
Figure 21B:
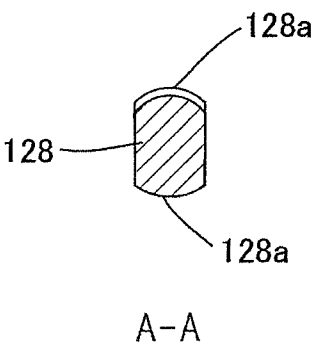

FIGS. 15(*a*) to (*f*) are illustrative views of the clicking mechanism of the above dispensing container, FIGS. 16(*a*) and (*b*) are a perspective view and vertical sectional view of a barrel body, FIGS. 17(*a*), (*b*), (*c*) and (*d*) are a front perspective view, rear perspective view, side view and vertical sectional view of a piston, FIGS. 18(*a*), (*b*), (*c*) and (*d*) are a front perspective view, rear perspective view, side view and vertical sectional view of a threaded body, FIGS. 19(*a*), (*b*), (*c*), (*d*) and (*e*) are a front perspective view, rear perspective view, side view, vertical sectional view and front view of a rotary body, FIGS. 20(*a*), (*b*), (*c*) and (*d*) are a front perspective view, rear perspective view, side view and vertical sectional view of a clicking body, and FIG. 21(*a*) and (*b*) are a side view and a sectional view cut along line A-A of a threaded rod.

The clicking type dispensing container according to the second embodiment is a container that can dispense the content by pressing a rear end part 112 of a clicking body 132 arranged at the rear end of a barrel body 110, forwards in the axial direction, and has structure, including a mechanical assembly 1A that transforms the pressing force acting on rear end part 112 of clicking body 132 into rotational force, and dispensing the content inside barrel body 110 by advancing a threaded rod 128 by the transformed rotational force.

Attached to the front end 110*a* of barrel body 110 are a joint 114, pipe joint 116, pipe 118, front barrel 120 and brush head 122. The content dispensed from a content reservoir 124 of barrel body 110 passes through pipe 118 to be ejected to the front end of brush head 122. Also, this container is formed so that a cap 126 can be fitted after use.

Specifically, as shown in FIG. 11, barrel body 110 has a stepped small-diametric portion forming a front end 110*a*, viewed in the axial direction. Cylindrical joint 114 and pipe joint 116 covered by the rear part of front barrel 120, are inserted into front end 110*a*. Brush head 122 in the form of a writing tip formed of a large number of bundled fibers or of a continuous porous body, is held as an applying element at the front part of pipe joint 116 inside the front part of front barrel 120.

Joint 114 has an approximately cylindrical shape with its front end enlarged in diameter, and is fitted into front end 110*a* of barrel body 110. Pipe joint 116 is inserted into the front opening of joint 114 from the front side. Pipe 118 for feeding liquid from reservoir 124 toward brush head 122 is inserted into, and supported by, this pipe joint 116. Cap 126 is fitted to front end 110*a* so as to cover brush head 122 and front barrel 120.

The mechanical assembly 1A for transforming the pressing force acting on rear end part 112 of the clicking body 132 into rotational force is essentially composed of clicking body 132 having a cam face 130, a rotary body 138 having a first cam face 134 and second cam face 136 and a threaded body 144 having a cam face 140 and a spring 146, all being inserted into barrel body 110.

Clicking body 132 includes cam face 130 having serrated notches and projections formed on the front face of the clicking body 132, has an integrated configuration from the portion having cam face 130 of the clicking body 132 to the rear end part 112. The clicking body 132 as a whole is slidable in the axial direction as the rear end part 112 is pressed in the axial direction, and is arranged in barrel body 110 with its rearward movement and rotational movement restrained.

Specifically, in clicking body 132, a cylindrical insert part 132*a* having a smaller diameter is formed extending forwards via a step from rear end part 112 forming a large diametric part of clicking body 132, as shown in FIG. 20, and the front end of insert part 132*a* is formed with cam face 130. Formed on the side of insert part 132*a* are a pair of projected portions 132*b*, 132*b* while a pair of slits 132*c*, 132*c* that communicate the interior with the exterior are formed between these projected portions 132*b*. Projected portions 132*b*, 132*b* fit into aftermentioned slits 144*c*, 144*c* of threaded part 144 (see FIGS. 11 and 18) so as to provide the function of permitting relative movement in the axial direction within a fixed range and restraining rotational movement.

[Rotary Body 138]

As shown in FIG. 19, rotary body 138 has an approximately annular rotational configuration in which first cam face 134 having notches and projections formed on the rear end face so as to be directed rearwards in the axial direction and second cam face 136 having notches and projections formed on the front end face so as to be directed forwards in the axial direction, and is arranged in barrel body 110 in a rotatable manner such that the first cam face 134 opposes cam face 130 of the clicking body 132 (see FIG. 11).

As shown in FIGS. 11 and 19, rotary body 138 has first cam face 134 and second cam face 136 formed at the rear and front ends, respectively, with respect to the axial direction. A variant-shaped hole 138*a* of an approximately elliptical, oval shape or the like that enables threaded rod 128 to be fixed in the rotational direction and move in the axial direction is formed in the front part of the rotary body, where the interior is stepped and made smaller in diameter.

Here, a step 138*b* is formed in the front end part inside the rotary body 138 on which the front end of spring 146 is abutted when spring 146 is attached.

[Threaded Body 144]

As shown in FIGS. 11 and 18, threaded body 144 as a whole, has an approximately cylindrical configuration having a threaded part 142 formed in a bore in the front end so as to screw fit with threaded rod 128 and a cam face 140 having notches and projections formed on the rear end face of the threaded part 142 so as to be directed rearwards in the axial direction, and fixed to barrel body 110 with respect to the rotational direction such that the cam face 140 opposes second cam face 136 of the rotary body 138.

Specifically, threaded body 144 is, as a whole, an overall cylinder, having a stepped inward thick wall in the front end part thereof so that threaded part (female thread) 142 to be screw-fitted with threaded rod 128 is formed in the bore, and having a hollow behind threaded part 142. Fixture of threaded body 144 to barrel body 110 with respect to the axial direction is created by fitting an annularly bumped fitting portion 110*b* formed on the inner periphery in the rear part of barrel body 110 into annular fitting projection 114*a* at the rear of threaded body 144 while fixture with respect to the relative rotational direction is created by fitting ribs 110*c* that are projected so as to extend in the axial direction inside barrel body 110 into grooves 144*b* extending in the axial direction on the outer periphery in the front part of threaded body 144, in an axially movable manner. In the middle of threaded body 144, a pair of window-like slits 144*c*, 144*c* that open from the hollow interior to the outside are formed. As shown in FIGS. 11 and 18, projected portion 132*b*, 132*b* of clicking body 132 that are shorter in the axial direction than slits 144*c*, 144*c* are fitted in these slits 144*c*, 144 so that clicking body 132 is movable in the axial direction within a fixed range and fixed in the rotational direction, relative to threaded body 144.

Inserted further into threaded body 144 attached inside barrel body 110 are rotary body 138, spring 146 and clicking body 132, as shown in FIGS. 11, 19 and 20.

Spring 146 is disposed between the clicking body 132 and the rotary body 138 and applies force to constantly press second cam face 136 of the rotary body 138 against the cam face 140 of the threaded body 144 so as to keep these cam faces meshing each other. As shown in FIG. 20, a step 132*d* forming a stepped portion reduced in diameter is formed at a halfway position on the inner surface of the hollow of insert part 132*a* of clicking body 132. As shown in FIG. 19, step 138*b* is formed around variant-shaped hole 138*a* inside rotary body 138. As shown in FIG. 11, spring 146 is interposed between the rearward face of step 138*b* of rotary body 138 and the forward face of step 132*d* of clicking body 132 so that this spring 146 urges rotary body 138 forwards and clicking body 132 rearwards.

Rotary body 138 is inserted into threaded body 144 from the rear opening, and spring 146 is inserted. Then clicking body 132 is inserted from their behind with projected portions 132*b*, 132*b* fitted into slits 144*c*, forming such a structure that clicking body 132 can move forwards and backwards relative to threaded body 144 within a fixed range and is fixed in the rotational direction.

[Threaded Rod 128]

The front end of threaded rod 128 is structured with a piston 148 for pushing out the content in barrel body 110, being attached in such a manner as to be slidable inside barrel body 110 and rotatable relative to threaded rod 128.

Threaded rod 128 is a solid structure free from hollow therein, formed by partly cutting out the peripheral side so as to have a variant cross-section of an approximately oval shape, as shown in FIG. 21. The shape of the cross-section of threaded rod 128 is formed by cutting out part of the circumferential side so as to correspond to the cross-section of variant-shaped hole 138*a* at the front end of the rotary body 138, creating a structure that fixes movement of threaded rod 128 and rotary body 138 in the mutual rotational direction and enables relative movement in the axial direction when threaded rod 128 is inserted into the rotary body. The peripheral surface of threaded rod 128, the area other than the cut-out part, is formed with a male thread 128*a* along the arcs.

Threaded rod 128 is inserted through variant-shaped hole 138*a* of rotary body 138 so as to create a state in which threaded rod 128 is integrally rotated with, and relatively moveable in the axial direction to, rotary body 138. Further, male thread 128*a* on the outside part of threaded rod 128 is screw-fitted with the threaded part 142 with a female thread in the bore of threaded body 144. A projected or flange-like fitting portion 128*b* is formed at the front end of threaded rod 128. Attached to this fitting portion 128*b* at the front end of threaded rod 128 is piston 148 for pushing out the content in barrel body 110 as described below, that can slide along the inner wall of reservoir 124 inside barrel body 110 and is relatively rotatable to threaded rod 128.

[Piston 148]

In order to dispense the content such as a fluid cosmetic etc. in reservoir 124 inside barrel body 110 by use of the advancing force of threaded rod 128, piston 148 is disposed inside reservoir 124 so as to be slidable forwards and rearwards. As shown in FIG. 17, piston 148 is comprised of a main part 148*a* having an H-shaped section and a cylindrical support 148*b* that is projectively formed from the main body 148*a* toward the rear so as to receive fitting part 128*b* at the front end of threaded rod 128, therein. Inside cylindrical support 148*b*, the middle part is projected inwards, narrowing the diameter (fitted part 148*c*) so that fitting part 128*b* at the front end of threaded rod 128 passes over fitted part 148*c*, creating tight fitting. With this arrangement, piston 148 is held by threaded rod 128 in a relatively rotatable manner.

[Each Cam Face]

Now, the configurations of cam face 130 of the clicking body 132, first cam face 134 and second cam face 136 of rotary body 138, cam face 140 of threaded body 144 will be described.

As shown in FIGS. 15, 18 to 20, cam face 130 of the clicking body 132 and first cam face 134 of rotary body 138 are formed with slopes 130*a* and 134*a*, respectively, which are each inclined rearwards (toward the barrel's rear) relative to the predetermined rotational direction (the direction of arrow L in FIG. 15(*a*) in the second embodiment) while second cam face 136 of the rotary body 138 and cam face 140 of threaded body 144 are formed with slopes 136*a* and 140*a*, respectively, which each are inclined rearwards relative to the predetermined rotational direction. The inclined angle θ1 of slopes 130*a* and 134*a* is formed to be greater or steeper than the inclined angle θ2 of slopes 136*a* and 140*a* (θ1>θ2).

In the above arrangement, when clicking body 132 is pushed to advance, cam face 130 of clicking body 132 abuts first cam face 134 of rotary body 138 and second cam face 136 of rotary body 138 abuts cam face 140 of threaded body 144. When clicking body 132 is pressed from this state, rotary body 138 will rotate in the predetermined rotational direction with cam face 130 of clicking body 132 sliding over first cam face 134 and second cam face 136 sliding over cam face 140 of threaded body 144, due to the difference (θ1>θ2) between the inclined angle θ1 of the slopes 130*a* and 134*a* and the inclined angle θ2 of the slopes 136*a* and 140*a*.

Further, as shown in FIG. 15, the associated notches and projections of cam face 130 of the clicking body 132 and first cam face 134 of rotary body 138, as well as the associated notches and projections of second cam face 136 of rotary body 138 and cam face 140 of threaded body 144, are formed with the same pitch or with pitches related by a multiplication of an even number. Further, cam face 130 of clicking body 132, first cam face 134 and second cam face 136 of the rotary body 138, and cam face 140 of threaded body 144 are configured in such a relationship that, when second cam face 136 of the rotary body 138 and cam face 140 of threaded body 144 are meshing each other, the cam notches and projections of first cam face 134 of the rotary body 138 and cam face 130 of the clicking body 132 are out of phase from each other with respect to the rotational direction, whereas, when cam face 130 of the clicking body 132 and first cam face 134 of the rotary body 138 are meshing each other, the cam notches and projections of second cam face 136 of the rotary body 138 and cam face 140 of the threaded body 144 are out of phase from each other with respect to the rotational direction. The differences in phase fall within a range in which when one pair of the associated cams are meshing, the peak of first cam face 134 and the peak of second cam face 136 will not reside on an identical straight line that is parallel to the axial direction.

Further, as shown in FIG. 15, when first cam face 134 of the rotary body 138 has meshed cam face 130 of the clicking body 132, second cam face 136 of the rotary body 138 rotates by sliding over cam face 140 of the threaded body 144 (see (b) to (c)), and second cam face 136 is retained when the peak thereof passes over the peak of cam face 140 of the threaded body 144 (see (d) to (e)).

Detailedly, cam face 130 of the clicking body 132 forms one pitch from the wall face that rises steeply forwards (towards the barrel's front end) via the front end peak to the rearward-inclined slope 130*a*, along the predetermined rotational direction.

First cam face 134 of rotary body 138 forms one pitch from slope 134*a* inclined rearwards (toward the barrel's rear end) to the wall face that falls steeply rearwards from the rear end peak, along the predetermined rotational direction.

Second cam face 136 of rotary body 138 forms one pitch from the wall face that rises steeply forwards (towards the barrel' front end) via the front end peak to the slope 136*a* inclined rearwards, along the predetermined rotational direction.

Cam face 140 of threaded body 144 forms one pitch from slope 140*a* inclined rearwards (toward the barrel's rear end) and slope 140*b* forwards from the rear end peak, along the predetermined rotational direction.

The clicking body 132 is pressed and advanced whilst spring 146 disposed between the rotary body 138 and the clicking body 132 is being compressed, whereby first cam face 134 of the rotary body 138 is slid along the slope of cam face 130 of the clicking body 132 while second cam face 136 of the rotary body 138 is slid along cam face 140 of the threaded body 144. The rotary body 138 rotates whilst moving rearwards opposing spring 146 disposed between the rotary body 138 and the clicking body 132. With this rotation, the front end peak of second cam face 136 of the rotary body 138 passes over the rear end peak of cam face 140 of the threaded body 144 and is positioned partway on slope 140 inclined forwards while the wall portion of first cam face 134 of the rotary body 138 abuts the wall portion of cam face 130 of the clicking body 132 so as to prevent a further rotation, whereby second cam face 136 of the rotary body 138 is suspended on cam face 140 of the threaded body 144 until release of clinking.

In the clicking type dispensing mechanism according to the second embodiment thus constructed, joint 114, pipe joint 116, pipe 118, front barrel 120 and brush head 122 are attached to the front end side of barrel body 110 that holds the content. The content dispensed from content reservoir 124 of barrel body 110 passes through pipe 118 and ejected to the front end of brush head 122. Also, this container is formed so that cap 126 can be fitted after use.

As described above, in the clicking type dispensing container of the second embodiment shown in FIG. 11, mechanical assembly 1A for transformation into rotational force is provided at the rear end of barrel body 110.

The mechanical assembly 1A for transformation is composed of piston 148 shown in FIG. 17, threaded body 144 shown in FIG. 18, the cam body in FIG. 19 and clicking body 132 shown in FIG. 20. Approximately cylindrical threaded body 144 having threaded part 142 in the bore and cam face 140 in the rear is fixed to approximately cylindrical barrel body 110 including content reservoir 124 so as to be restrained from rotating relative to barrel body 110 by engagement between ribs 110*c* of barrel body 110 and grooves 144*b* of threaded body 144 and also restrained from moving in the axial direction by engagement between fitting portion 110*b* of barrel body 110 and fitting projection 144*a* of threaded body 144.

Threaded rod 128 that has a variant-shaped section with male thread 128*a* on the outer peripheral side thereof is screw-fitted into threaded part 142 of threaded body 144 in such a state that the front end of threaded rod 128 is projected out from the front end of threaded body 144. In this state, piston 148 that slides in the bore of barrel body 110 to thrust out the content is rotatably attached to front end fitting portion 128*b* of threaded rod 128. Rotary body 138 is rotatably arranged inside threaded body 144 in such a position that second cam face 136 of rotary body 138 is directed opposing cam face 140 of threaded body 144. Variant-shaped hole 138*a* is formed inside rotary body 138. This variant-shaped hole 138*a* restrains rotation of threaded rod 128 and permits movement in the axial direction.

This variant-shaped hole 138*a* enables integral rotation of threaded rod 128 with rotary body 138 when rotary body 138 rotates. Since the inclined angle θ1 of slope 134*a* of first cam face 134 of rotary body 138 is steeper than the inclined angle θ2 of slope 136*a* of second cam face 136, the force required for rotating first cam face 134 and that for second cam face 136 are different.

Further, since spring 146 is inserted from the rear into interior step 138*b* of rotary body 138 while clicking body 134 is assembled from the rear of threaded body 144 with projections 132*b* of clicking body 132 fitted in slits 144*c* of the threaded body 144, clicking body 132 and rotary body 138 are urged by spring 146 disposed therebetween. Since clicking body 132 is restrained from moving rearwards by slits 144*c* of threaded body 144, rotary body 138 is constantly pressed against threaded body 144 by the force of spring 146. Further, clicking body 132 is also restrained from turning in the rotational direction by slits 144*c* of the threaded body, and cam face 140 of threaded body 144 and cam face 130 of clicking body 132 are laid out to be out of phase from each other.

Next, the operation will be described. (FIG. 15 shows the scheme of the operation). In the initial state (where rear end part 112 of clicking body 132 is not pressed), projected portions 132*b* of clicking body 132 are pressed by the rear end face of slits 144*c* of threaded body 144 by the force of spring 146, at the same time rotary body 138 is also pressed by threaded body 144. At this time, second cam face 136 of rotary body 138 is set in mesh with cam face 140 of threaded body 144.

From this state, the rear end of clicking body 132 starts being clicked by pressing thereof, clicking body 132 moves forwards as spring 146 is compressed.

As clicking is further continued, cam face 130 of clicking body 132 abuts first cam face 134 of rotary body 138, being positioned out of phase therewith (see FIGS. 12 and 15(*b*)).

When a further clicking is continued from the state in which cam face 130 of clicking body 132 is abutting first cam face 134 of rotary body 138, rotary body 138 begins to rotate by sliding over slope 130*a* of cam face 130 of clicking body 132 and slope 140*a* of cam face 140 of threaded body 144 (see FIGS. 13 and 15(*c*)). At this time, the angles of the slopes of cam face 130 on the clicking body 132 side and cam face 140 on the threaded body 144 side are made different so that the rotational force on the clicking body 132 side becomes greater than the rotational force on threaded body 144 side.

With this rotation, threaded rod 128 rotates integrally with rotary body 138 so as to advance piston 148 to thereby dispense the content inside reservoir 124.

As clicking is further continued, the peak of second cam face 136 of rotary body 138 climbs over the peak of cam face 140 of threaded body 144 and is moved forwards as sliding and rotating along slope 140*b* of cam face 140 of threaded body 144, by the force of spring 146. At this time, rotary body 138 becomes engaged with cam face 130 of clicking body 132 while being out of phase from cam face 140 of threaded body 144. Even under this condition, rotary body 138 is rotating, so that the content keeps being dispensed (see FIG. 13 and FIGS. 15(*d*) to (*e*)).

Clicking reaches the forward limit at the state in which clicking body 132 is engaged with the cam of rotary body 138. Clicking is released from this condition, clicking body 132 retracts and returns to the initial position (see FIG. 14 and FIGS. 15(*e*) to (*f*)). Since rotary body 138 is constantly pressed against threaded body 144 by spring 146, slope 136*a* of second cam face 136 of rotary body 138 rotates sliding along cam face 140 of threaded body 144 and becomes in mesh with cam face 140 of threaded body 144. As a result, the same positional relationship as the initial state (FIG. 15(*a*)) in which the peak of first cam face 134 of rotary body 138 and the peak of cam face 130 of clicking body 132 are positioned out of phase from each other, is restored.

When the above clicking operation is repeated, the clicking motion in the axial direction is transformed into rotational force so as to rotate threaded rod 128 and push piston body 148 forwards, whereby it is possible to dispense a fixed amount of the content with a minimum number of parts.

It should be noted that the clicking type dispensing container of the present invention is not limited to the above embodiment. It is, of course, possible to make various changes therein without departing from the scope of the gist of the invention.

In the second embodiment, each part is preferably formed of a resin molding. It is preferable that barrel body 110 is formed of PP, rotary body 138 of POM, threaded body 144 of ABS, and clicking body 132 of PC.

Further, in the second embodiment, the associated notches and projections of cam face 130 of the clicking body 132 and first cam face 134 of rotary body 138, as well as the associated notches and projections of second cam face 136 of rotary body 138 and cam face 140 of threaded body 144, are formed with multiple teeth arranged with the same pitch. However, the present invention should not be limited to this configuration. That is, one of cam face 130 of the clicking body 132 and first cam face 134 of rotary body 138 and one of second cam face 136 of the rotary body 138 and cam face 140 of threaded body 144 are formed with the first slope and second slope that are inclined toward one side in the axial direction with respect to the predetermined rotational direction of rotary body 138. That is, the present invention may include a configuration in which one of the opposing cam faces is formed with a plurality of teeth while the other is formed of, other than a cam face, or a body with a circular section at the tip, or a roller body, which can be easily guided by the cam face.

Next, a clicking type dispensing container according to this invention will be described based on the third embodiment shown in the drawings.

FIGS. 22 to 32 are illustrative views of a clicking type dispensing container according to the third embodiment.

Figure 22A:
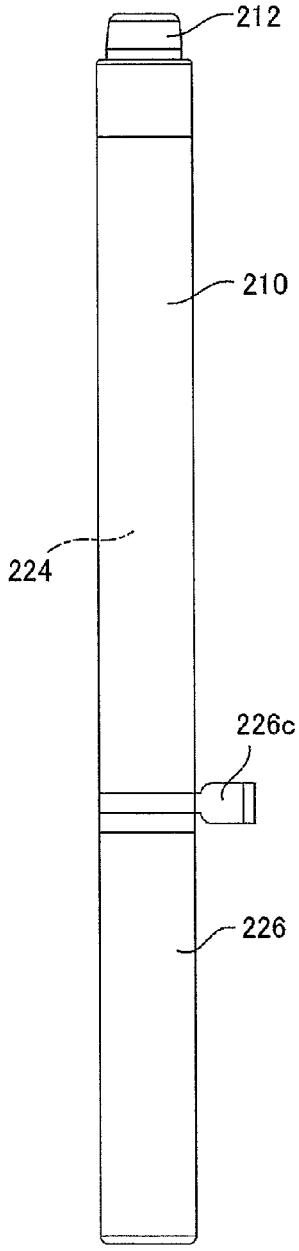
FIGS. 22(*a*) and (*b*) are illustrative views of a clicking type dispensing container according to the third embodiment of the present invention, showing an overall appearance view and a vertical sectional view of the clicking type dispensing container in a state where a crown is not pressed.
Figure 22B:
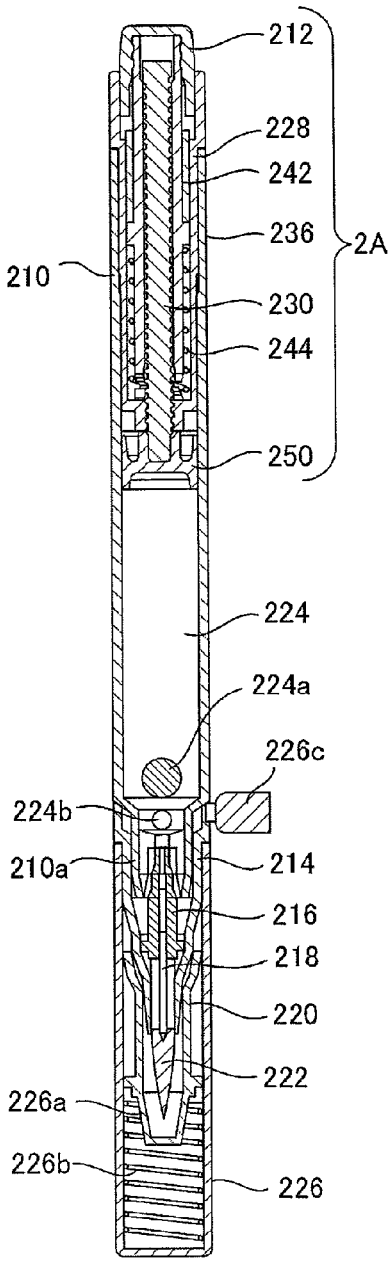
Figure 23:
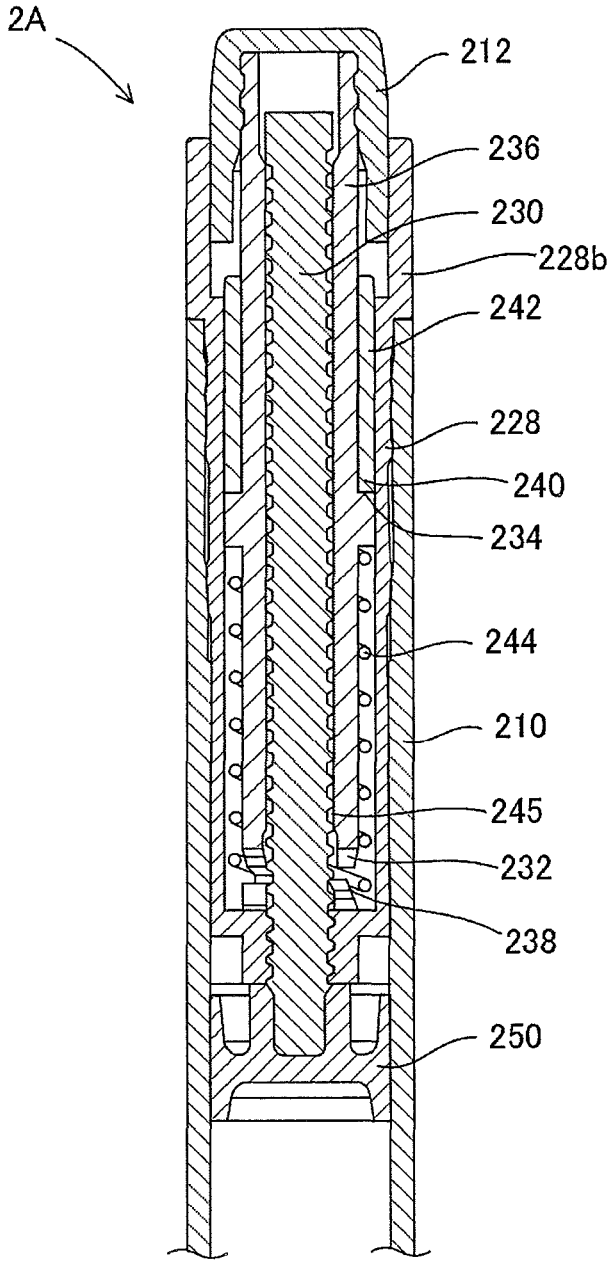
FIG. 23 is an enlarged sectional view showing a clicking mechanical assembly in the clicking type dispensing container shown in FIG. 22 in a state where the crown is not pressed.
Figure 24:
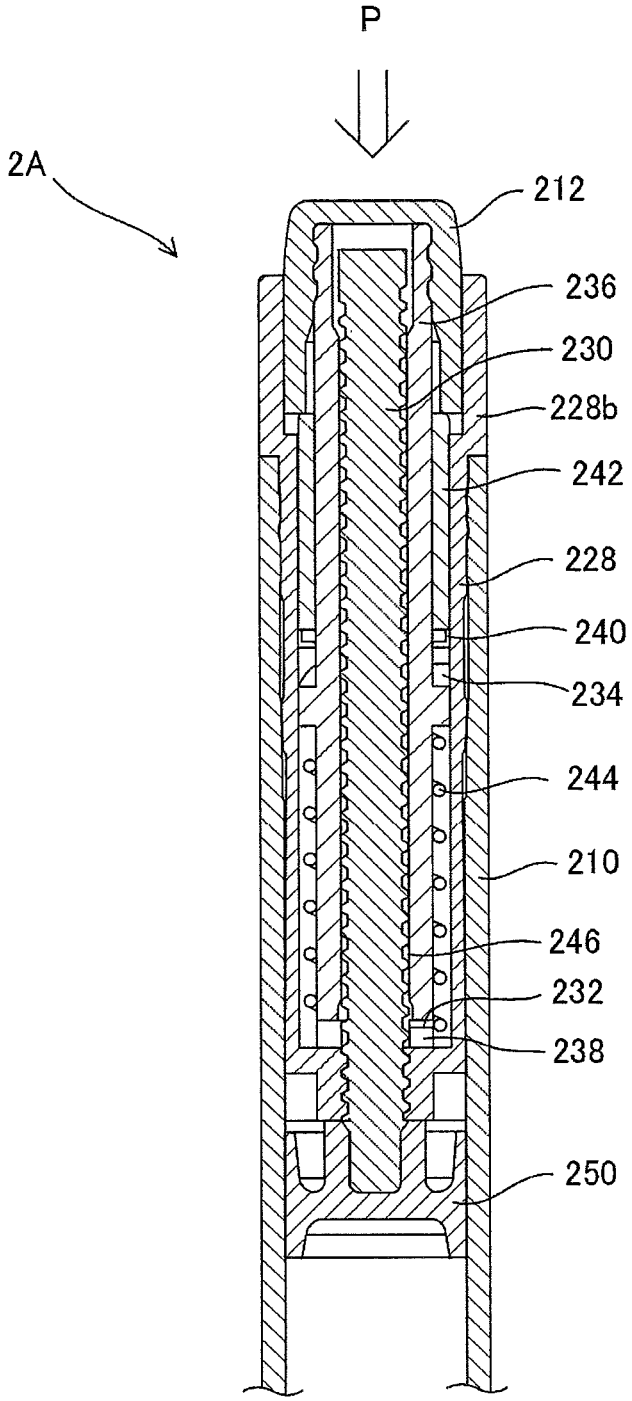
FIG. 24 is an enlarged sectional view showing a clicking mechanical assembly in the clicking type dispensing container shown in FIG. 22 in a state where the crown is pressed.
Figures 25A, 25B, 25C, 25D, 25E, 25F:
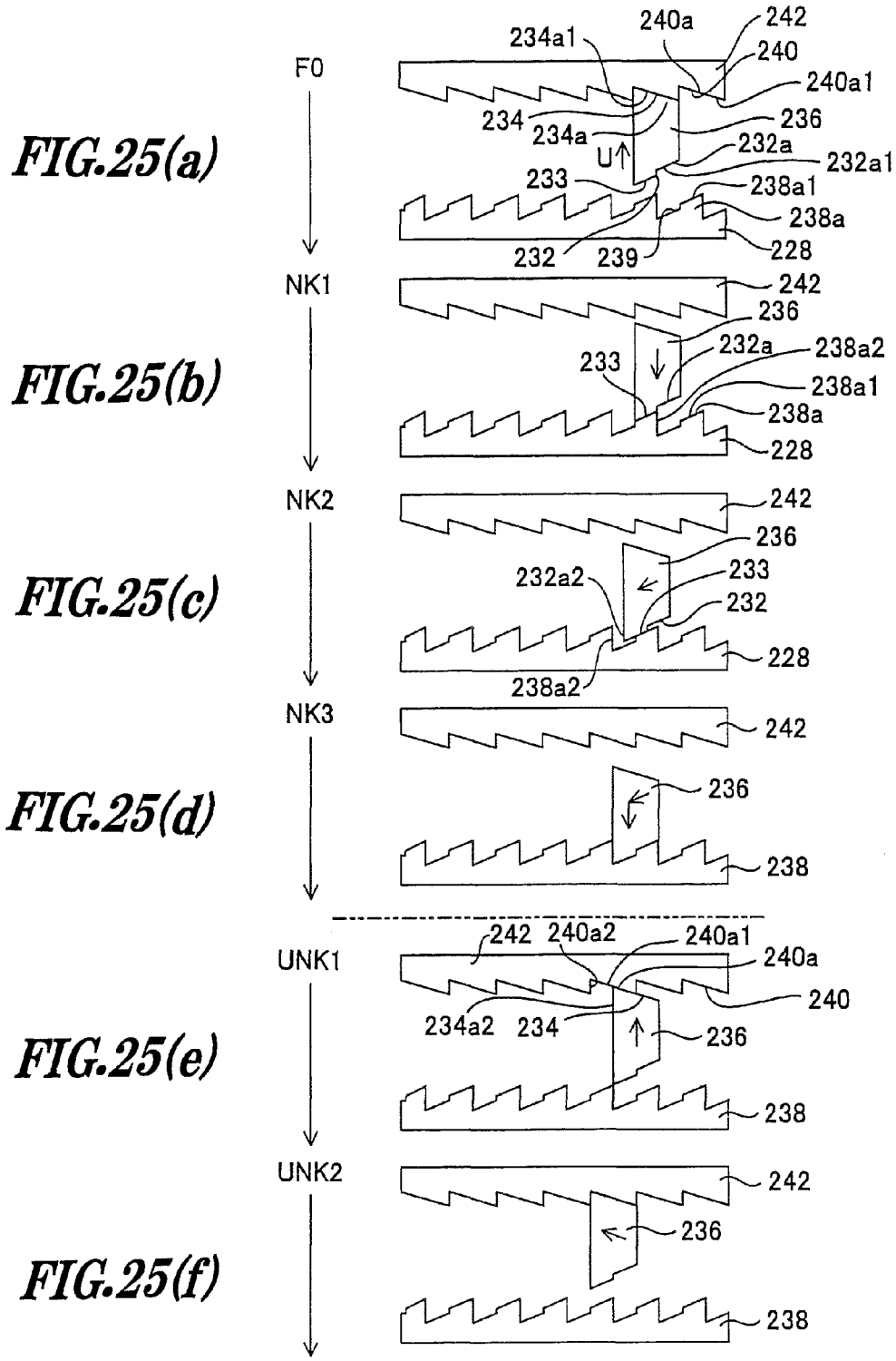
FIGS. 25(*a*) to (*f*) are operational illustrative views of the clicking mechanical assembly of the clicking type dispensing container.
Figure 26A:
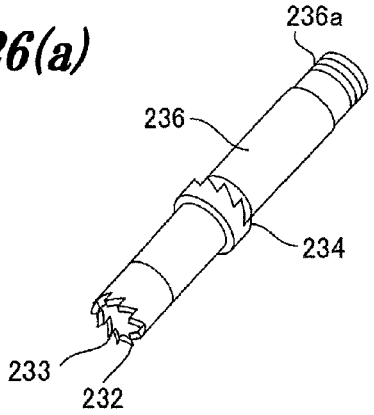
FIGS. 26(*a*), (*b*), (*c*), (*d*) and (*e*) are a front perspective view, rear perspective view, side view, vertical sectional view and front view of a rotary body.
Figure 26B:
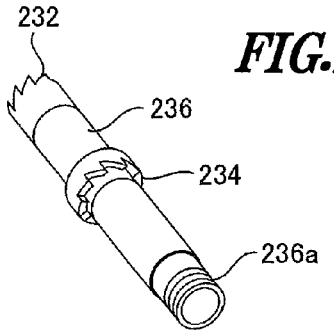
Figure 26C:
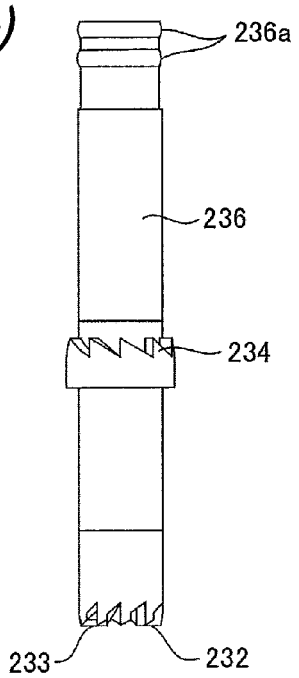
Figure 26D:
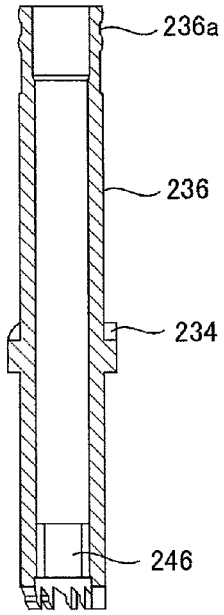
Figure 26E:
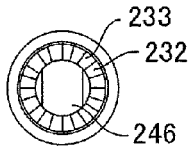

Specifically, FIGS. 22(*a*) and (*b*) are illustrative views of a clicking type dispensing container according to the third embodiment of the present invention, showing an overall appearance view and a vertical sectional view of the clicking type dispensing container in a state where a crown is not pressed. FIG. 23 is an enlarged sectional view showing the clicking mechanical assembly in the clicking type dispensing container shown in FIG. 22 in a state where the crown is not pressed. FIG. 24 is an enlarged sectional view showing the clicking mechanical assembly in the clicking type dispensing container shown in FIG. 22 in a state where the crown is pressed. FIGS. 25(*a*) to (*f*) are operational illustrative views of the clicking mechanical assembly of the clicking type dispensing container.

Figure 27A:
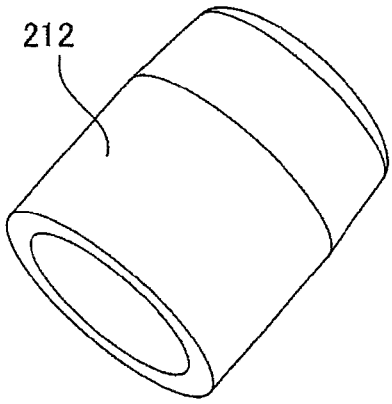
FIGS. 27(*a*), (*b*) and (*c*) are a front perspective view, side view and vertical sectional view of a crown.
Figure 27B:
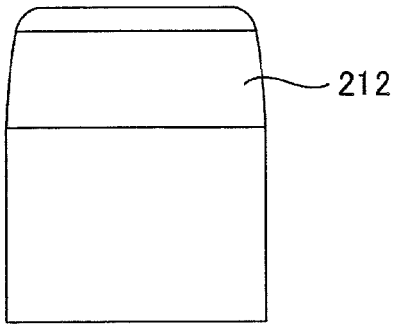
Figure 27C:
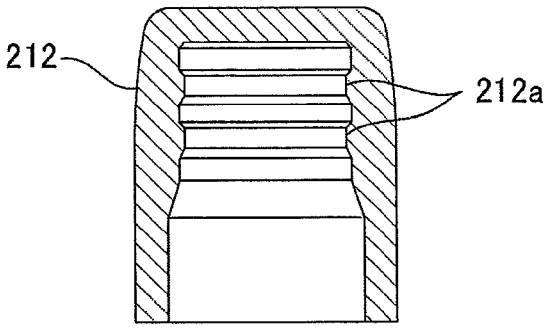
Figure 28A:
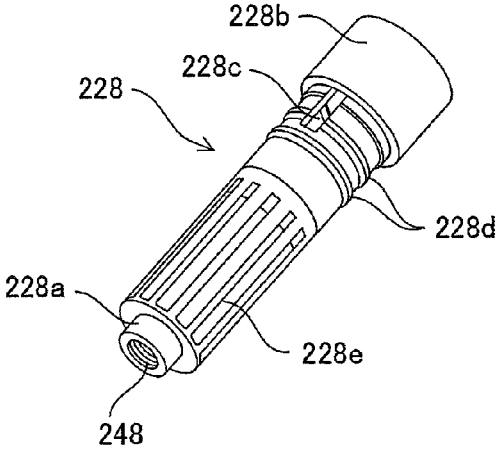
FIGS. 28(*a*), (*b*), (*c*) and (*d*) area front perspective view, rear perspective view and vertical sectional view of a threaded body and an enlarged sectional view around a threaded part.
Figure 28B:
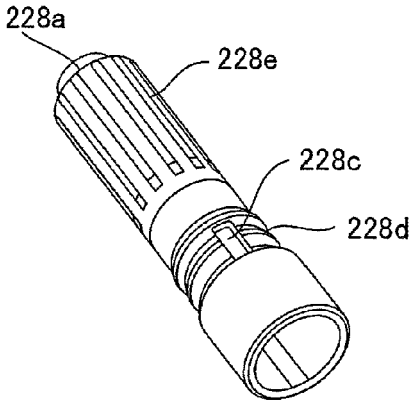
Figure 28C:
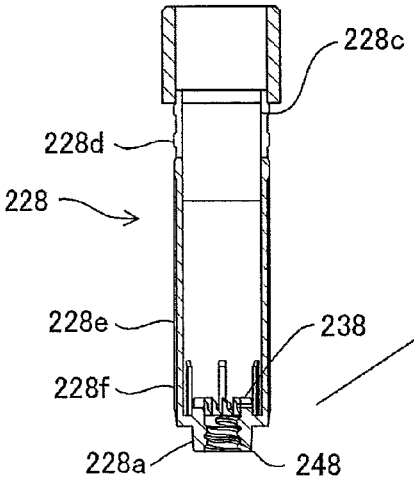
Figure 28D:
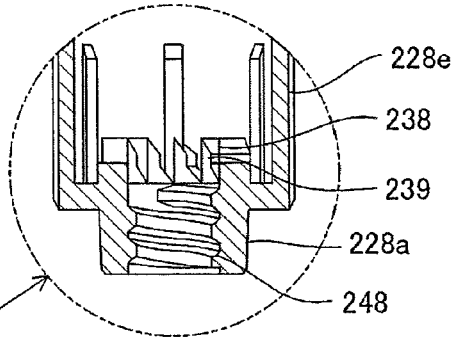
Figure 29A:
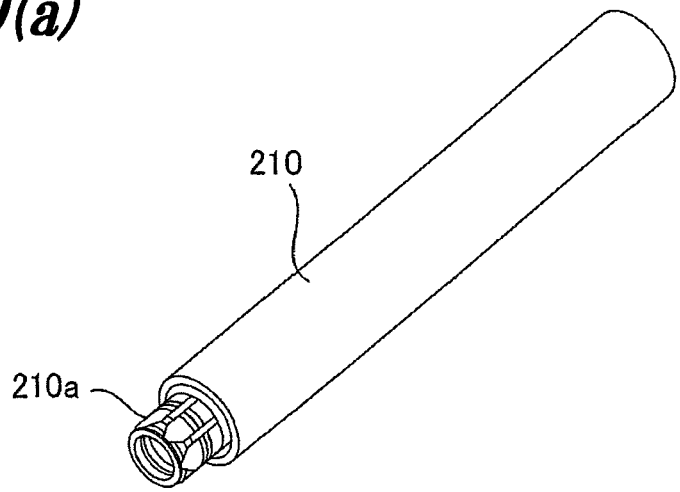
FIGS. 29(*a*) and (*b*) are a perspective view and vertical sectional view of a barrel body.
Figure 29B:
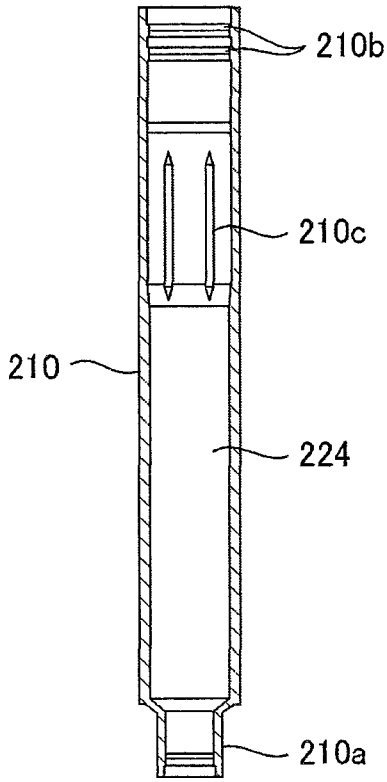
Figure 30A:
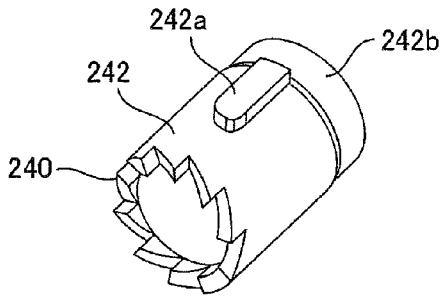
FIGS. 30(*a*), (*b*), (*c*) and (*d*) are a front perspective view, rear perspective view, side view and vertical sectional view of a cam body.
Figure 30B:
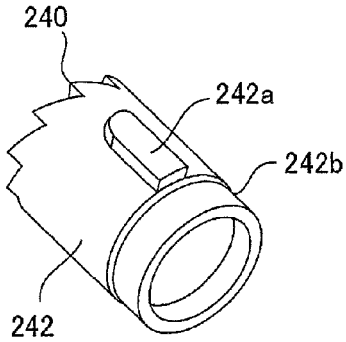
Figure 30C:
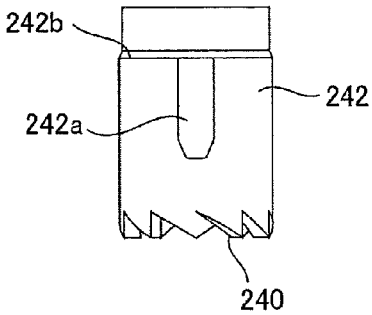
Figure 30D:
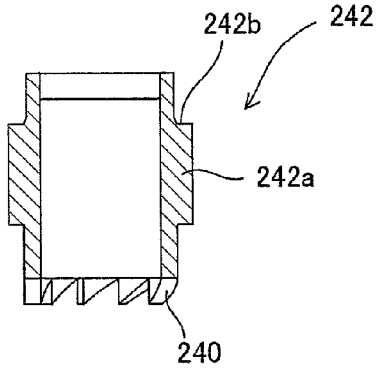
Figure 31A:
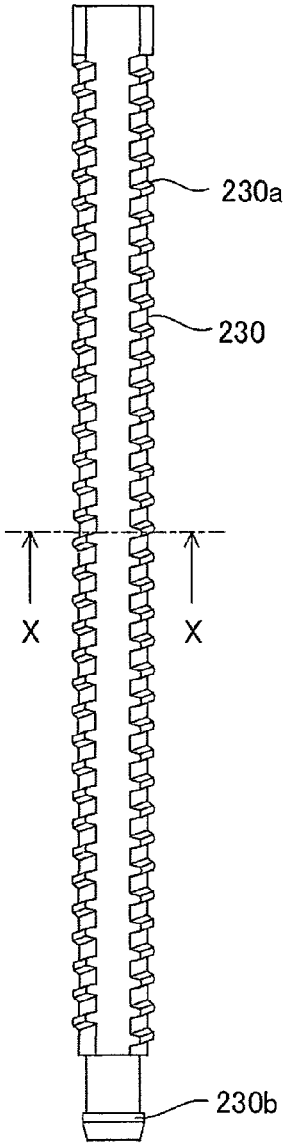
FIGS. 31(*a*) and (*b*) are a side view and sectional view cut along line X-X of a threaded rod.
Figure 31B:
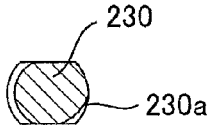
Figure 32A:
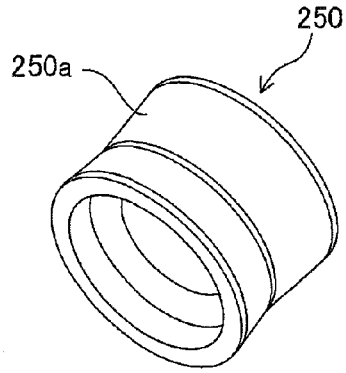
FIGS. 32(*a*), (*b*) and (*c*) are a front perspective view, rear perspective view and vertical sectional view of a piston body.
Figure 32B:
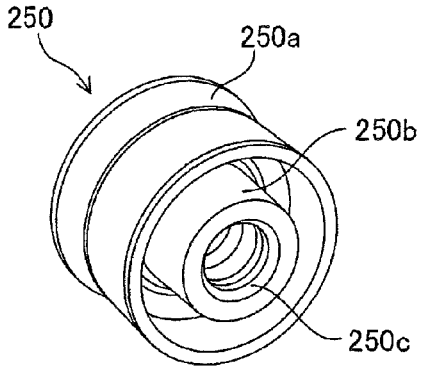
Figure 32C:
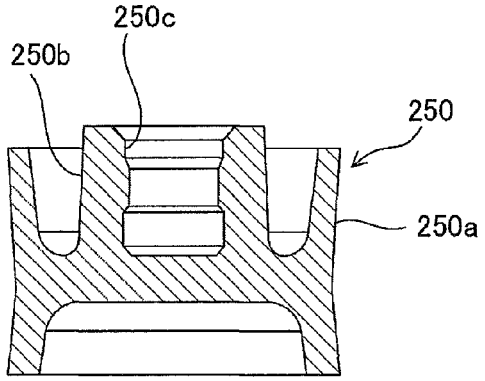

FIGS. 26(*a*), (*b*), (*c*), (*d*) and (*e*) are a front perspective view, rear perspective view, side view, vertical sectional view and front view of a rotary body. FIGS. 27(*a*), (*b*) and (*c*) are a front perspective view, side view and vertical sectional view of a crown. FIGS. 28(*a*), (*b*), (*c*) and (*d*) are a front perspective view, rear perspective view and vertical sectional view of a threaded body and an enlarged sectional view around a threaded part. FIGS. 29(*a*) and (*b*) are a perspective view and vertical sectional view of a barrel body. FIGS. 30(*a*), (*b*), (*c*) and (*d*) are a front perspective view, rear perspective view, side view and vertical sectional view of a cam body. FIGS. 31(*a*) and (*b*) are a side view and sectional view cut along line X-X of a threaded rod. FIGS. 32(*a*), (*b*) and (*c*) are a front perspective view, rear perspective view and vertical sectional view of a piston body.

As shown in FIG. 22, the clicking type dispensing container according to the third embodiment is a container that can dispense the content by pressing a crown 212 disposed at the rear end of a barrel body 210, forwards in the axial direction, and has a structure, including a mechanical assembly 2A that transforms the pressing force acting on crown 212 by user' clicking operation into rotational force, a threaded body 228 fixed to barrel body 210 and a threaded rod 230 screw-fitted into threaded body 228, and dispensing the content by advancing the threaded rod 230 through threaded body 228 (hence advancing a piston body 250 fitted at the front end of threaded body 230) when threaded rod 230 is turned by the rotational force transformed by the mechanical assembly 2A.

Attached to the front end at 210*a* of barrel body 210 in the clicking type dispensing container, are a joint 214, pipe joint 216, pipe 218, front barrel 220 and brush head 222. The content (liquid such as a fluid cosmetic or the like in the third embodiment) dispensed from a content reservoir 224 of barrel body 210 passes through pipe 218 to be ejected to the front end of brush head 222. Also, this container is formed so that a cap 226 can be fitted after use. Here, in FIG. 22, 224*a* designates a content agitating ball in reservoir 224, 226*a* an inner cap, 226*b* a spring for urging the rear of the inner cap, 226*c* a stopper for confining the passage of the content to pipe 218 and its downstream when not in use. At the rear end of pipe 218, a seal ball 224*b* is arranged closely inside the bore of joint 214 so that the content will not flow into pipe 218 when unused. When used, stopper 226*c* is pulled out from barrel body 210, and front barrel 220 is pushed in toward the rear end so that seal ball 224*b* is removed from the bore of joint 214, whereby the content flows into pipe 218 and can be applied.

Specifically, as shown in FIGS. 22 and 29, barrel body 210 has a stepped small-diametric portion forming front end part 210*a*, viewed in the axial direction. Cylindrical joint 214 and pipe joint 216 being covered by the rear part of front barrel 220, are inserted into front end part 210*a*. Brush head 222 in the form of a writing tip formed of a large number of bundled fibers or of a continuous porous body, is held as an applying element at the front part of pipe joint 216 inside the front part of front barrel 220. The applying element may employ any configuration as appropriate other than the brush head of this type.

The joint 214 has an approximately cylindrical shape with its front end enlarged in diameter, and is fitted into front end part 210*a* of barrel body 210. Pipe joint 216 is inserted into the front opening of joint 214 from the front side. Pipe 218 for feeding liquid from reservoir 224 to brush head 222 is inserted into, and supported by, this pipe joint 216. Cap 226 is fitted to front end part 210*a* so as to cover brush head 222 and front barrel 220.

Next, the specific configuration of each part will be described.

[Clicking Mechanical Assembly 2A for Transforming Pressing Force into Rotational Force]

Clicking mechanical assembly 2A for transforming the pressing force by pressing the crown 212 into rotational force is essentially composed of a rotary body 236 having a first cam face 232 and a second cam face 234, a threaded body 228 having a first fixed cam face 238 and a cam body 242 having a second fixed cam face 240, as shown in FIGS. 22 and 23.

[Rotary Body 236]

As shown in FIGS. 22 and 26, rotary body 236 is arranged so that crown 212 is rotatable and restrained from moving in the axial direction, has an annular configuration with first cam face 232 directed forwards and second cam face 234 directed rearwards and is disposed to be rotatable, and movable in the axial direction, relative to barrel body 210.

As shown in FIG. 26, rotary body 236 has an approximately hollow cylindrical annular overall configuration. Formed at its front end with respect to the axial direction is first cam face 232 having a step 233 having a projected stepped portion directed forwards, formed on the front side, and an oval or any other variant-sectional hole 246 is formed in the bore. Further, a stepped enlarged diametric annular portion whose rearward face has second cam face 234 directed rearwards is formed in the middle of rotary body 236 with respect to the axial direction, on the outer peripheral side thereof. A flange-like bumped fitting portion 236*a* is formed on the outer peripheral side at the rear end part of rotary body 236.

It should be noted that, not only on first cam face 232, but a step having the same difference in level as that of the aforementioned step may also be formed on second cam face 234.

Here, as shown in FIG. 27, crown 212 is a cylindrical vessel-like configuration that is closed at one axial end and has an engaging portion 212*a* formed of bumped steps in the inner peripheral portion at the rear end. When the rear end of the rotary body 236 is pushed in from the front opening of crown 212, the fitting portion 236*a* fits into the engaging portion 212*a*. The dimensions of the fitting portion 236*a* and engaging portion 212*a* are so specified that crown 212 can rotate, and is restrained from moving in the axial direction, relative to rotary body 236.

[Threaded Body 228]

The threaded body 228 is an approximately hollow-cylinder that is formed with a stepped front end part having a reduced diameter and a stepped rear end part having an enlarged diameter, as shown in FIGS. 22 and 28. The front end part is a stepped cylindrical part 228*a* reduced in diameter, whose bore is formed with a threaded part 248 of a female thread. First fixed cam face 238 having a step 239 of a recessed step directed forwards from the partway of the slope is formed on the rear side of cylindrical part 228*a* having threaded part 248.

A cylindrical portion 228*b* stepped and enlarged in diameter in the rear end part of threaded body 228 is a part into which crown 212 is fitted in so as to be rotatable and movable forwards and backwards. In the part adjacent to the front of cylindrical portion 228*b*, a plurality of slits 228*c* that pass through from the interior to the exterior of threaded body 228 are formed so as to be extended in the axial direction and a bumped fitting portion 228*d* is formed on the outside periphery. Further, a plurality of grooves 228*e* extending in the axial direction are formed on the front outer periphery. Ribs 228*f* for positioning the radial position of an aftermentioned spring element 244 are projected inwards and extended in the axial direction in the front inner periphery of threaded body 228.

[Barrel Body 210]

As shown in FIG. 29, barrel body 210 has a front end part 210*a* that is reduced in diameter. On the inner peripheral surface, a bumped and step-formed fitting portion 210*b* is formed at the rear end part, and ribs 210*c* that are projected inwards and axially extended are formed in the middle part more or less closer to the rear. When threaded body 228 is fitted to barrel body 210, the threaded body 228 is inserted forwards from the open rear end of barrel body 210 and advanced and fitted while the ribs 210*c* are being fitted to the grooves 228*e*.

Further, threaded body 228 is squeezed while fitting portion 210*b* of the barrel body 210 is made to pass over the bumps of fitting portion 228*d* of threaded body 228. At this time, threaded body 228 is advanced until the stepped enlarged diametric portion of cylindrical portion 228*b* abuts the rear end face of barrel body 210. Since ribs 210*c* and the aforementioned fitting portion 210*b* are closely fitted to grooves 228*e* and the fitting portion, respectively, threaded body 228 is attached to barrel body 210 in a fixed relationship with respect to the rotational direction and axial direction.

Here, the front space of threaded body 228 of barrel body 210 forms reservoir 224 for the content.

[Cam Body 242]

As shown in FIG. 30, the cam body 242 has an approximately cylindrical hollowed configuration that has second fixed cam face 240 formed on the front end side, a projected portion 242*a* formed on the outer peripheral side and extended from the middle to the rear in axial direction and a rear end part 242*b* slightly stepped and reduced in diameter.

As shown in FIGS. 22 and 23, this cam body 242 being fitted on the outer periphery of rotary body 236 in a movable manner, is inserted into threaded body 228 so that projected portion 242*a* fits into slit 228*c* of threaded body 228 and rear end part 242*b* is engaged inside cylindrical portion 228*b*. With this arrangement, cam body 242 is fixed so as not to move in the rotational direction and in the axial direction relative to threaded body 228. Further, since threaded body 228 is fixed to barrel body 210 as described above, cam body 242 is also fixed so as not to move in the rotational direction and in the axial direction relative to barrel body 210. Here, a step similar to step 239 of first fixed cam face 238 may also be formed on second fixed cam face 240 of this cam body 242.

[Spring Element 244]

As shown in FIGS. 22 and 23, spring element 244 is disposed inside threaded body 228, between the side of the circularly projected annular portion on the periphery in the front of the rotary body 236, opposite to second cam face 234 and the portion that encloses first fixed cam face 238 of threaded body 228. This spring element 244 functions to urge rotary body 236 rearwards so that second cam face 234 of the rotary body 236 abuts the second fixed cam face 240 so as to be engaged therewith when the pressure on crown 212 is released.

[Threaded Rod 230 and Piston Body 250]

As shown in FIG. 31, threaded rod 230 is a bar-like long part, having a cross-section fitting to variant-sectional hole 246 of the rotary body 236 and formed on the outer periphery with a male thread 230*a*. A fitting part 230*b* that is projected radially outwards like a flange is formed in the front end part. Fitted on the front end of the threaded rod 230 is a piston body 250 that is slidable along barrel body 210 and integrally moves with the threaded rod 230 in the axial direction.

As shown in FIGS. 22 and 32, this piston body 250 includes a main part 250*a* that slides along the inner wall of reservoir 224, a hollowed cylindrical part 250*b* that is extended rearwards from main part 250*a* and a bumped fitting part 250*c* inside hollowed cylindrical part 250*b*. Fitting part 230*b* at the front end of threaded rod 230 is fitted into this fitting part 250*c* of the piston body 250 so that the former is rotatable, and restrained from moving forward and backward, relative to the latter. In this condition, piston body 250 is arranged so as to be movable forward and backward inside reservoir 224 of barrel body 210.

As shown in FIG. 22, the rotary body 236 is formed with oval sectional or any other variant-sectional hole 246. Threaded body 228 having threaded part 248 of a female thread and first fixed cam face 238 is fixed to barrel body 210. Threaded rod 230, having a sectional shape that fits with variant-sectional hole 246 of the rotary body 236, and formed with male thread 230*a* on the outer peripheral side thereof, is screw-fitted to the threaded part of the threaded body 228 and arranged so as to penetrate through variant-sectional hole 246 of the rotary body 236. Under this condition, threaded rod 230 is rotated by rotation of the rotary body 236. This rotation causes piston body 250 to advance inside reservoir 224 to feed the liquid content such as cosmetics etc. to brush head 222 as the applying part inside front barrel 220.

First fixed cam face 238 and second fixed cam face 240 oppose the first cam face 232 and second cam face 234, respectively and are arranged in barrel body 210 so as to be fixed with respect to the axial direction and the rotational direction.

First fixed cam face 238 and second fixed cam face 240, and the first cam face 232 and the second cam face 234 will be described in detail with reference to FIG. 25. In FIG. 25, for convenience of explanation and illustration, only one tooth is depicted for the first cam face 232 and second cam face 234. However, in the third embodiment, a plurality of teeth are formed as shown in FIG. 26. Of course, if teeth are closely and contiguously formed without gap on one of the cam faces that oppose each other, the number of teeth on the other cam face may be one or plural.

Detailedly, first cam face 232 of the rotary body 236 has a slope, inclined forwards (downwards in the front view in FIG. 25) relative to the predetermined rotational direction of the rotary body (leftward in the front view in FIG. 25), and having step 233 of a forward projected step while first fixed cam face 238 of the threaded body 228 has a slope, inclined forwards relative to the predetermined rotational direction of the rotary body 236, and having step 239 of a forward recessed step. First cam face 232 of the rotary body 236 and first fixed cam face 238 of the threaded body 228 have a plurality of first teeth 232*a* and 238*a*, respectively, formed with the same pitch in the predetermined rotational direction, each of first teeth 232*a* and 238*a* having slope 232*a*1 or 238*a*1 that is inclined in the predetermined rotational direction. Stepped portions 233 and 239 are formed in the middle part of each of the first tooth of the first cam face 232 and first fixed cam face 238, respectively.

Second cam face 234 of the rotary body 236 and second fixed cam face 240 of the cam body 242 have a plurality of second teeth 234*a* and 240*a*, respectively, formed with the same pitch in the predetermined rotational direction of rotary body 236, each of second teeth 234*a* and 240*a* having a slope 234*a*1 or 240*a*1 that is inclined rearwards (upwards in the front view in FIG. 25) relative to the predetermined rotational direction (leftward in the front view in FIG. 25).

Here, in the third embodiment, the pitch of first cam face 232 and first fixed cam face 238 and the pitch of second cam face 234 and second fixed cam face 240 are formed to be equal to each other. When the cam faces opposing each other have different numbers of teeth, a workable configuration is obtained if the pitch of teeth of one of first cam face 232 and first fixed cam face 238 is the same as the pitch of teeth of one of second cam face 234 and second fixed cam face 240.

When the user clicks crown 212, first cam face 232 of the rotary body 236 is put in mesh with first fixed cam face 238 by the pressing force, and in this state, as first cam face 232 is guided along forward-inclined surface 238*a*1 of the tooth 238*a* (see FIGS. 25(*b*) to (*c*)), the rotary body 236 moves forwards and turns in the predetermined direction. Specifically, the tip of step 233 of first cam face 232 rides on, and slides along, slope 238*a*1 of first fixed cam face 238.

Then, step 233 formed in first cam face 232 slides into step 239 formed in first fixed cam face 238, as shown in FIG. 25(*d*). Specifically, step 233 of tooth 232*a* of the first cam face 232 moves into the recess of step 239 of first fixed cam face 238*a* so that the step 233 slides into the recess of the step 239 and the end face (wall face 232*a*2) directed in the rotational direction, of step 233 of tooth 232*a* of first cam face 232 collides with wall face 238*a*2 on the side directed in the counter-rotational direction of first fixed cam face 238 to give off an impact sound, or clicking sound, whereby the user gripping the dispensing container can feel a clicking sensation in their hand and fingers.

On the other hand, as the aforementioned pressing force is released, second cam face 234 of the rotary body 236 being kept in mesh with second fixed cam face 240 is guided along rearward-inclined surface 240*a*1 of the tooth 240*a* (see FIGS. 25(*e*) to (*f*)), so that the rotary body 236 moves rearwards and turns in the predetermined direction.

Thus, the clicking mechanical assembly 2A is constructed so as to actuate rotational movement by the cams operating as above, and so that rotation of rotary body 236 causes the threaded rod 230 to rotate.

Here, in the state where first cam face 232 of the rotary body 236 is in mesh with the first fixed cam face 238 (see FIG. 25(*d*)), the second fixed cam face 240 is set in such a relationship as to be shifted out of phase by half of one cam tooth of first fixed cam face 238 with respect to the rotational direction. On the other hand, in the state where second cam face 234 on the rotary body 236 side is in mesh with the second fixed cam face 240 (see FIG. 25(*f*)), the first cam face 232 on the rotary body 236 side and the first fixed cam face 238 are set in such a relationship as to be shifted out of phase from each other by half of one cam tooth with respect to the rotational direction.

Further, spring element 244 that urges rotary body 236 rearwards is provided in order to bring second cam face 234 of the rotary body 236 into contact and in mesh with the second fixed cam face 240 when the pressure is released.

In sum, the clicking type dispensing container has a configuration including: in the hollow of the threaded body 228, annularly formed rotary body 236 having first cam face 232 that meshes the first fixed cam face 238 in the front part thereof, second cam face 234 in the rear and variant-sectional hole 246 formed in the bore at the front; spring element 244 disposed between the rotary body 236 and the threaded body 228 for urging rotary body 236 rearwards relative to threaded body 228; and cam body 242 having second fixed cam face 240 meshing second cam face 234 of the rotary body 236 and fixed to the rear part of the threaded body 228, so as to hold the rotary body 236 from the front and rear between the threaded body 228 and the cam body 242 and urge the rotary body 236 toward the cam body 242 by the spring element 244.

Further, variant-sectional threaded rod 230 having a thread on the outer peripheral side is screw-fitted to threaded part 248 of the threaded body 228. The threaded rod 230 and the rotary body 236 are movable in the axial direction and locked with respect to the rotational direction due to variant-sectional hole 246 of the rotary body 236. Fitted to the front end of the threaded rod 230 is piston body 250 that is slidable along barrel body 210 and integrally moves with the threaded rod 230 in the axial direction.

Moreover, the crown 212 is arranged at the rear of the rotary body 236 in such a manner as to be rotatable and locked with respect to the axial direction.

As shown in FIG. 25, in the state where first cam face 232 of the rotary body 236 is put in mesh with the first fixed cam face 238, the second cam face 234 on the rotary body 236 side and the second fixed cam face 240 are set in such a relationship as to be shifted out of phase from each other by half of one cam tooth with respect to the rotational direction, and in the state where second cam face 234 of the rotary body 236 is in mesh with the second fixed cam face 240, the first cam face 232 on the rotary body 236 side and the first fixed cam face are set in such a relationship as to be shifted out of phase from each other by half of one cam tooth with respect to the rotational direction.

Next, the operation of the above-described third embodiment will be described.

FIGS. 25(*a*) to (*f*) show the scheme of the mutual motion of first cam face 232 and second cam face 234 of rotary body 236, first fixed cam face 238 of threaded body 228 and second fixed cam face 240 of cam body 242.

In the initial state (FO) shown in FIGS. 22 and 23 where crown 212 is not clicked (pressed), rotary body 236 is pushed against the cam body 242 side as shown in FIG. 25(*a*), by spring element 244 (upwards: indicated by arrow U) so that second cam face 234 of rotary body 236 and second fixed cam face 240 of cam body 242 are meshing each other. In this state, second cam face 234 of rotary body 236 is located with its peak and first cam face 232 residing on the same line parallel to the axial direction and shifted out of phase from first fixed cam face 238 of threaded body 228 by half of the pitch.

Next, as shown in FIG. 24, crown 212 is pushed downwards in the axial direction (in the P direction) to start clicking.

As clicking begins, the state changes from FIG. 25(*a*) to FIG. 25(*b*) (clicked state 1: shown by code NK1). Specifically, crown 212 and rotary body 236 start to integrally move forwards as spring element 244 is compressed, so that second cam face 234 of rotary body 236 goes away from second fixed cam face 240 of cam body 242.

As clinking is further continued, first cam face 232 of rotary body 236 abuts first fixed cam face 238 of threaded body 228, at a position out of phase by half of the pitch, as shown in FIG. 25(*b*).

As shown in FIG. 25(*c*), a further pressure is applied from this state of abutment (clicked state 2: shown by code NK2), slope 232*a*1 of tooth 232*a* of first cam face 232 of rotary body 236 moves sliding over slope 238*a*1 of tooth 238*a* of first fixed cam face 238 of threaded body 228 so that rotary body 236 moves forwards whilst rotating in the predetermined direction until wall 232*a*2 of the tooth 232*a* abuts wall 238*a*2 of tooth 238*a* of first fixed cam face 238 (clicked state 3 shown in FIG. 25(*d*): indicated by code NK3). During this, crown 212 itself will not rotate since rotary body 236 is attached to crown 212 in a rotatable manner.

With the rotation of rotary body 236 at the time of clicking, threaded rod 230 that penetrates through variant-sectional hole 246 located at the front end of rotary body 236, can axially move but is restricted from rotating relative to rotary body 236, integrally rotates with rotary body 236. Since being screw-fitted with threaded part 248 of threaded body 228, threaded rod 230 moves forwards with piston body 250 so as to dispense the content of reservoir 224.

From this state, clicking is released.

Release of clicking is performed as spring element 244 disposed inside threaded body 228 moves up rotary body 236, as shown in FIG. 25(*e*) (click-released state 1: shown by code UNK1). At this time, since tooth 240*a* of second fixed cam 240 of cam body 242 is located out of phase from second cam face 234 of rotary body 236 by half of the pitch, the second cam face 234 starts turning in the predetermined rotational direction and moving rearwards.

As release of clinking is further continued, from the state in which second cam face 234 of rotary body 236 abuts second fixed cam face 240 of cam body 242 as shown in FIG. 25(*e*), slope 234*a*1 of tooth 234*a* of second cam face 234 of rotary body 236 is moved by pushup force of spring element 244, sliding over slope 240*a*1 of tooth 240*a* of second fixed cam face 240 of cam body 242 as shown in FIG. 25(*f*) (click-released state 2: shown by code UNK2) so that the rotary body rotates and retracts to the position where wall 234*a*2 of tooth 234*a* of second cam face 234 abuts wall 240*a*2 of tooth 240*a* of second fixed cam face 240. Also during this rotation, threaded rod 230 is rotated as above and moves forwards with piston body 250 to dispense the content.

When the above clicking operation is repeated, a clicking sound is generated when the first cam face and the first fixed cam mesh each other, and the clicking motion and releasing motion in the axial direction are transformed into rotational force so as to rotate threaded rod 230 and thrust piston body 250 forwards, whereby it is possible to dispense a fixed amount of the content.

In addition, since the strength of the rotational force for initial rotation depends on the pressing force, it is possible to easily deal with a case where force greater than a certain level is needed for initial rotation because of sticking of piston body 250 or the like.

It should be noted that the clicking type dispensing container of the present invention is not limited to the above embodiment. It is, of course, possible to make various changes therein without departing from the scope of the gist of the invention.

In the third embodiment, each part is preferably formed of a resin molding. It is preferable that the barrel body is formed of PP, the rotary body of POM, the cam body of ABS, the threaded body of ABS and the crown of PC.

Also, in the third embodiment, first cam face 232 of rotary body 236 and first fixed cam face 238 of threaded body 228 as well as second cam face 234 of the rotary body and second fixed cam face 240 of cam body 242, are all formed with a plurality of teeth arranged with the same pitch. However, the present invention is not limited to this configuration. One of the first cam face and the first fixed cam face may be formed of a plurality of first teeth which each have a slope inclined forwards relative to the predetermined rotational direction of the rotary body and are arranged with an identical pitch along the predetermined rotational direction while one of the second cam face and the second fixed cam face may be formed of a plurality of second teeth which each have a slope inclined rearwards relative to the predetermined rotational direction of the rotary body and are arranged with an identical pitch along the predetermined rotational direction. That is, the present invention may include a configuration in which one of the opposing cam faces is formed with a plural teeth while the other is formed with a single tooth or plural teeth.

Next, a clicking type dispensing mechanism according to this invention will be described based on the fourth embodiment shown in the drawings.

FIGS. 33 to 44 are illustrative views of a clicking type dispensing container according to the fourth embodiment.

Figure 33A:
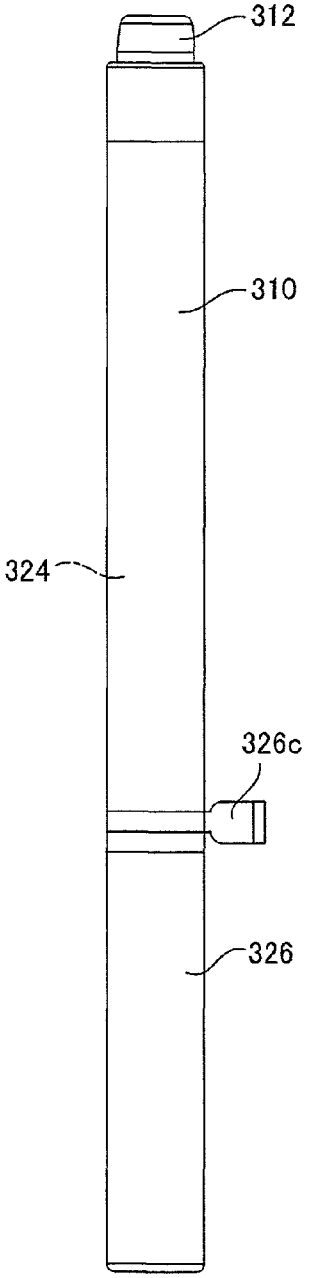
FIGS. 33(*a*) and (*b*) are illustrative views of a clicking type dispensing container according to the fourth embodiment of the present invention, showing an overall appearance view and a vertical sectional view of a clicking type dispensing container in a state where a crown is not pressed.
Figure 33B:
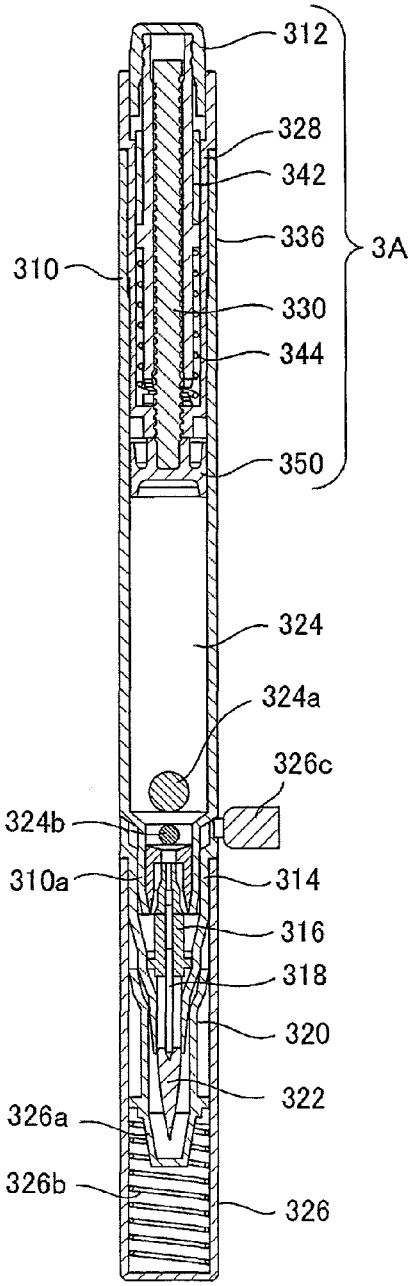
Figure 34:
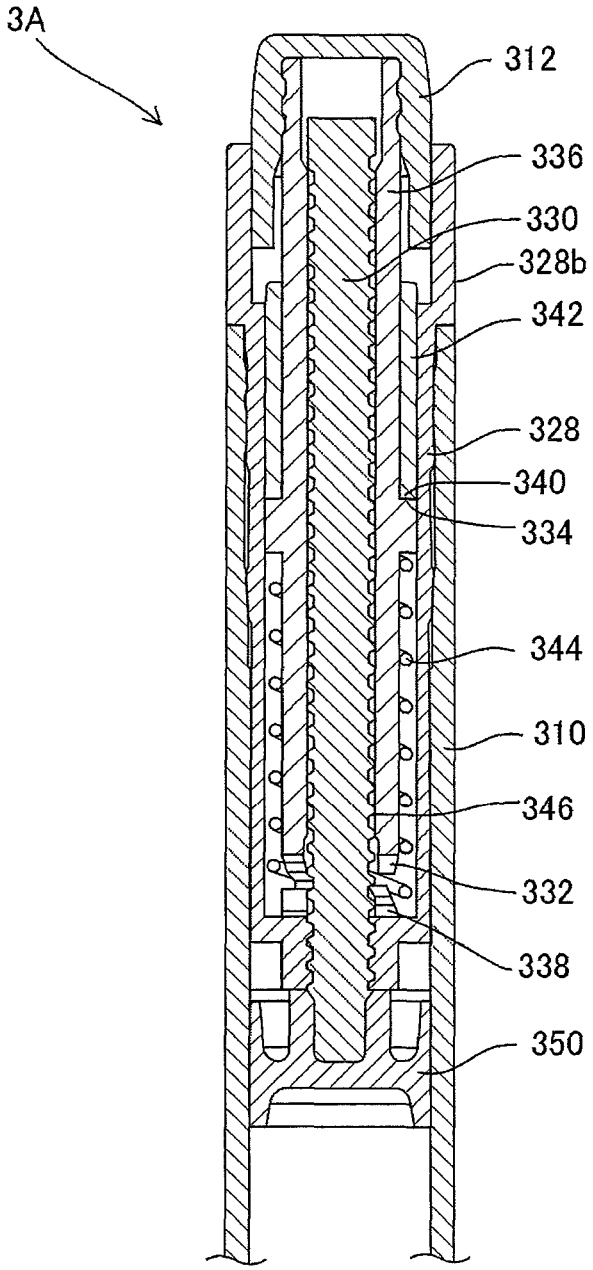
FIG. 34 is an enlarged sectional view showing a clicking mechanical assembly in the clicking type dispensing container shown in FIG. 33 in a state where the crown is not pressed.
Figure 35:
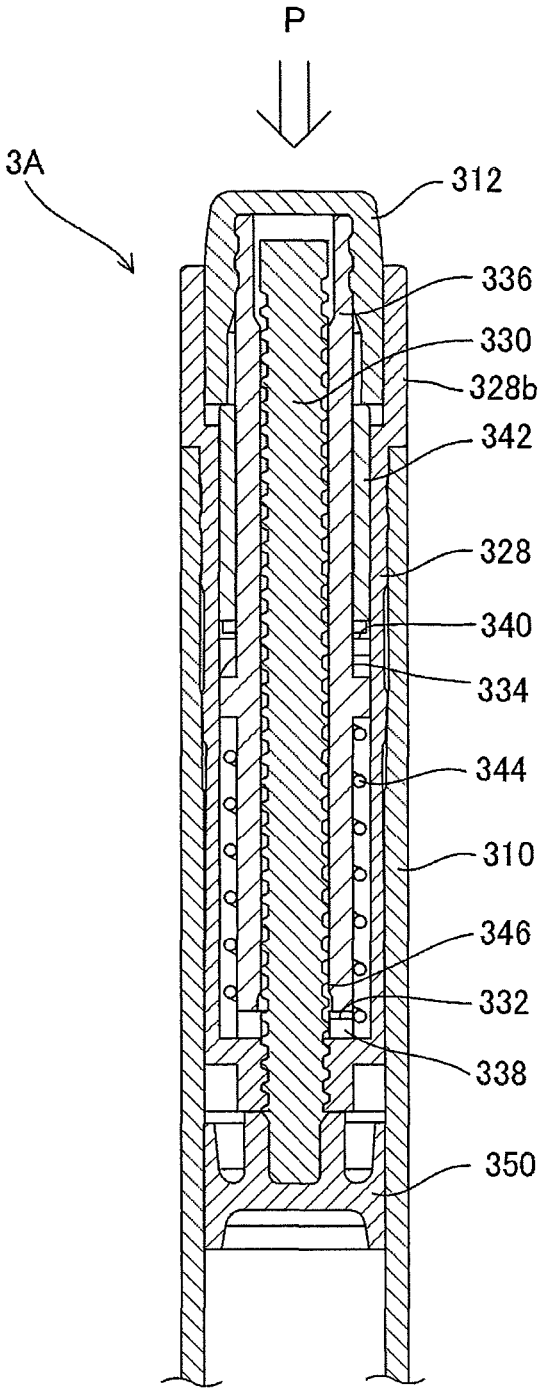
FIG. 35 is an enlarged sectional view showing a clicking mechanical assembly in the clicking type dispensing container shown in FIG. 33 in a state where the crown is pressed.
Figure 36A:
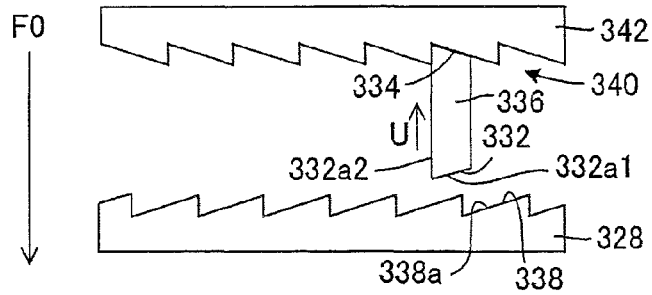
FIGS. 36(*a*) to (*e*) are operational illustrative views of the clicking mechanical assembly of the clicking type dispensing container.
Figure 36B:
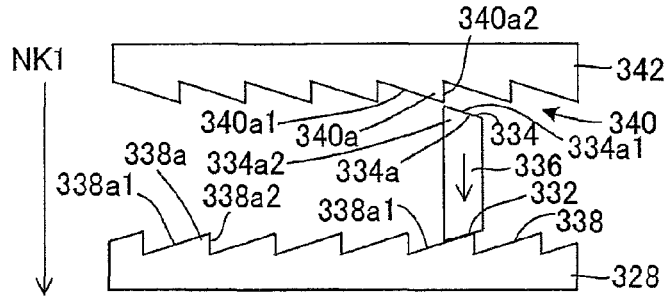
Figure 36C:
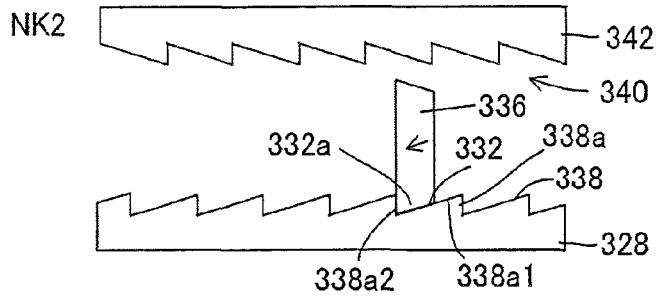
Figure 36D:
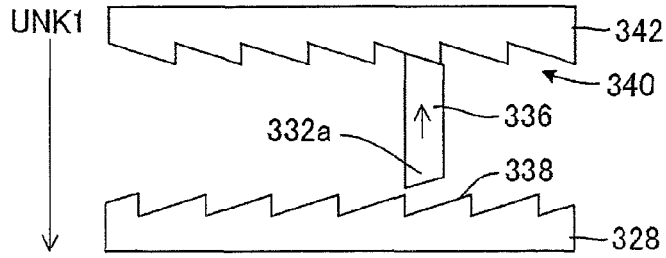
Figure 36E:
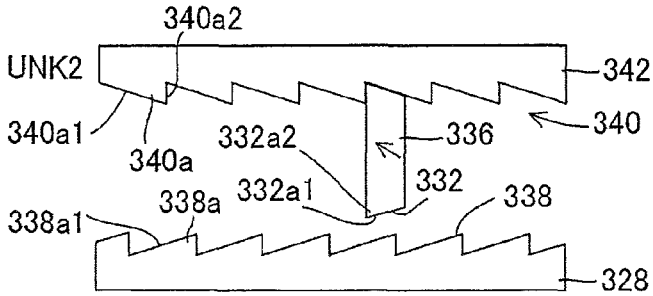

Specifically, FIGS. 33(*a*) and (*b*) are illustrative views of a clicking type dispensing container according to the fourth embodiment of the present invention, showing an overall appearance view and a vertical sectional view of the clicking type dispensing container in a state where a crown is not pressed. FIG. 34 is an enlarged sectional view showing the clicking mechanical assembly in the clicking type dispensing container shown in FIG. 33 in a state where the crown is not pressed. FIG. 35 is an enlarged sectional view showing the clicking mechanical assembly in the clicking type dispensing container shown in FIG. 33 in a state where the crown is pressed. FIGS. 36(*a*) to (*e*) are operational illustrative views of the clicking mechanical assembly of the clicking type dispensing container.

Figure 37A:
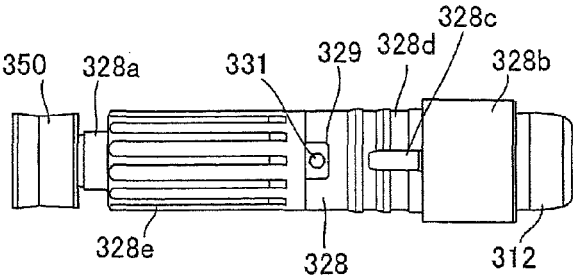
FIGS. 37(*a*) to (*c*) are illustrative views showing how a mark (marker) to be seen through a threaded body window is viewed.
Figure 37B:
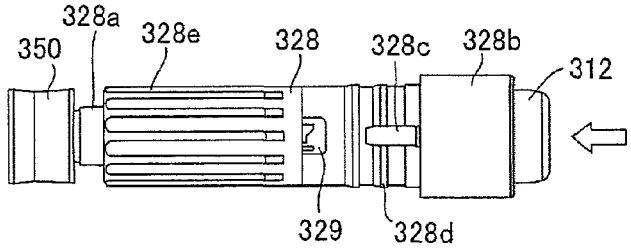
Figure 37C:
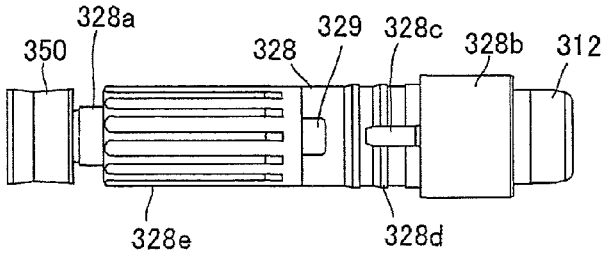
Figure 38A:
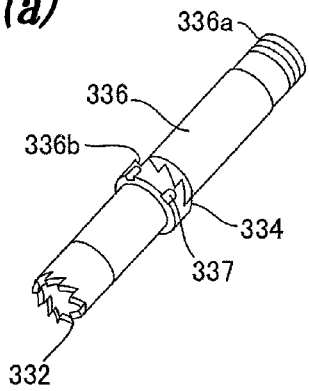
FIGS. 38(*a*), (*b*), (*c*), (*d*) and (*e*) are a front perspective view, rear perspective view, side view, vertical sectional view and front view of a rotary body.
Figure 38B:
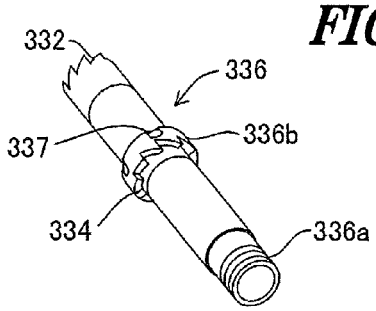
Figure 38C:
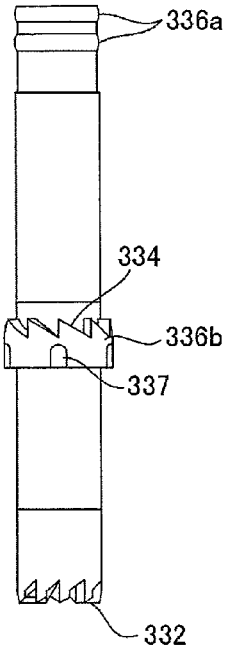
Figure 38D:
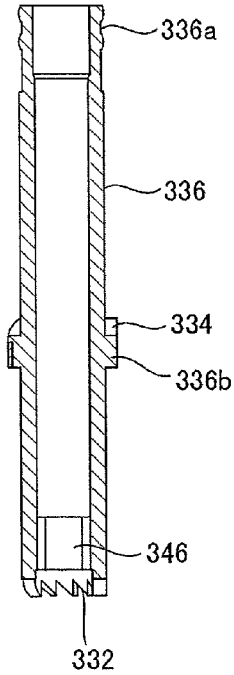
Figure 38E:
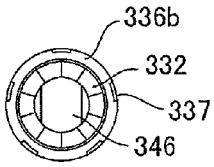
Figure 39A:
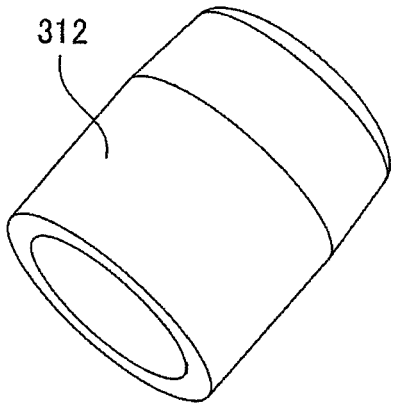
FIGS. 39(*a*), (*b*) and (*c*) are a front perspective view, side view and vertical sectional view of a crown.
Figure 39B:
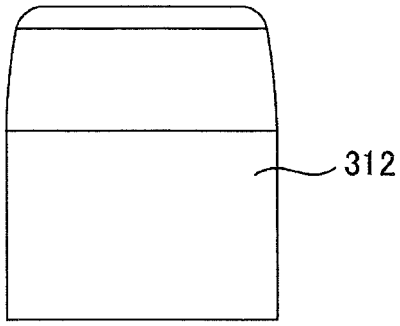
Figure 39C:
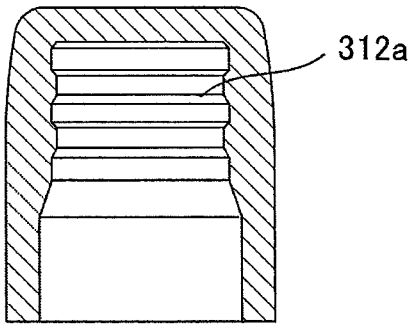
Figure 40A:
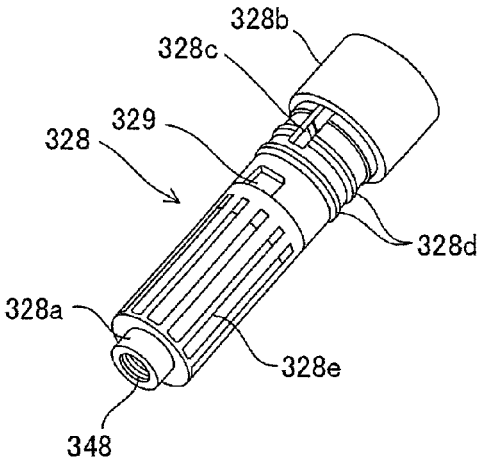
FIGS. 40(*a*), (*b*), (*c*) and (*d*) are a front perspective view, rear perspective view and vertical sectional view of a threaded body and an enlarged sectional view around a threaded part.
Figure 40B:
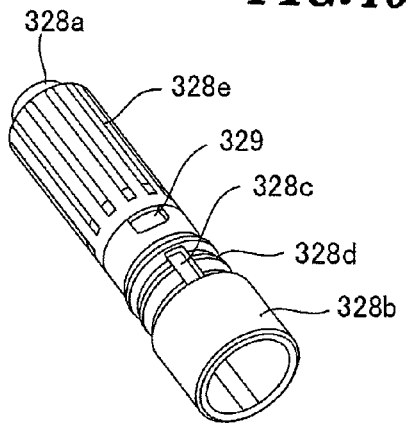
Figure 40C:
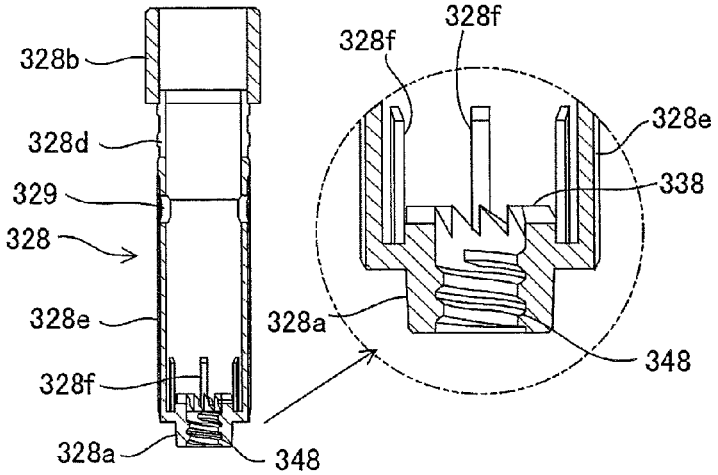
Figure 40D:
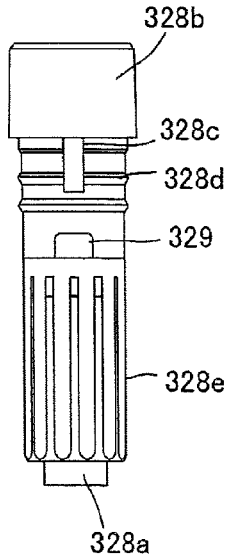
Figure 41A:
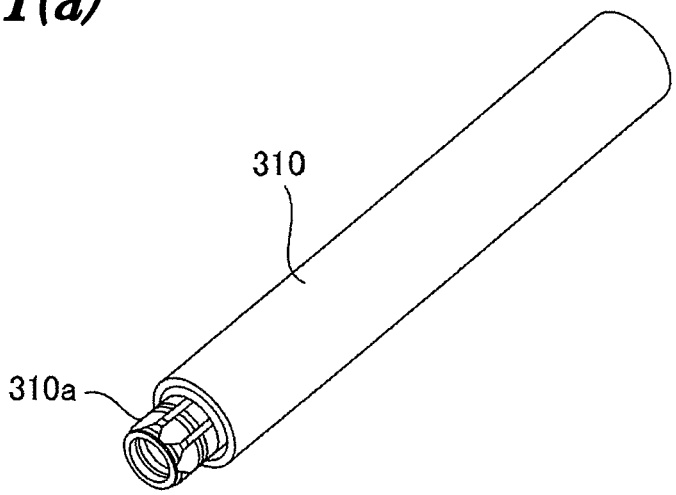
FIGS. 41(*a*) and (*b*) are a perspective view and vertical sectional view of a barrel body.
Figure 41B:
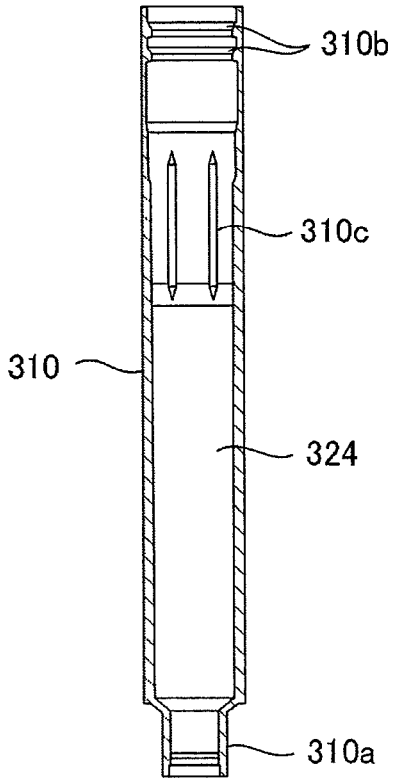
Figure 42A:
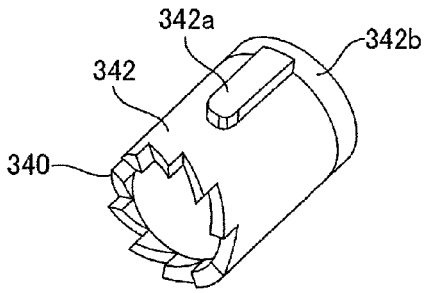
FIGS. 42(*a*), (*b*), (*c*) and (*d*) are a front perspective view, rear perspective view, side view and vertical sectional view of a cam body.
Figure 42B:
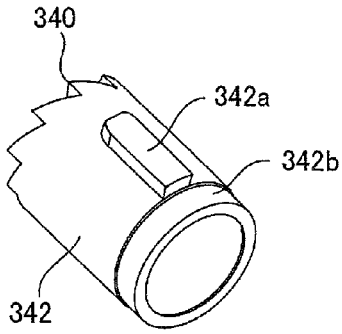
Figure 42C:
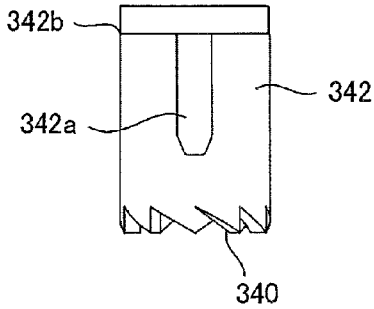
Figure 42D:
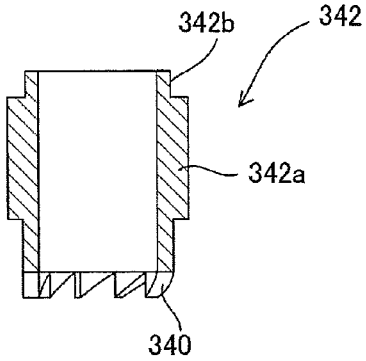
Figure 43A:
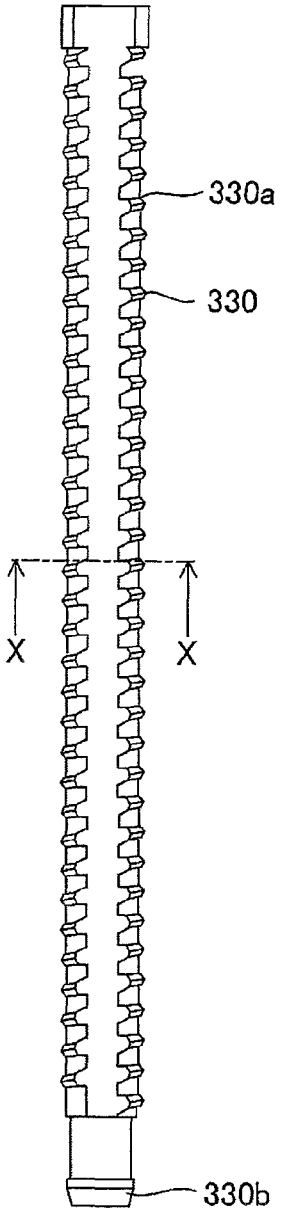
FIGS. 43(*a*) and (*b*) are a side view and sectional view cut along line X-X of a threaded rod.
Figure 43B:
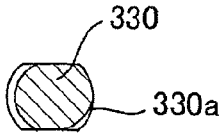
Figure 44A:
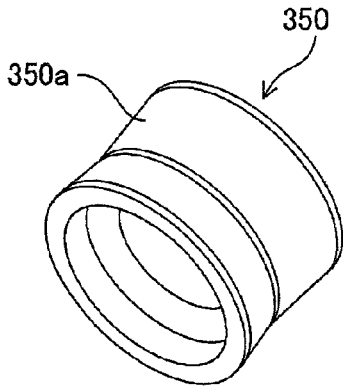
FIGS. 44(*a*), (*b*) and (*c*) are a front perspective view, rear perspective view and vertical sectional view of a piston body.
Figure 44B:
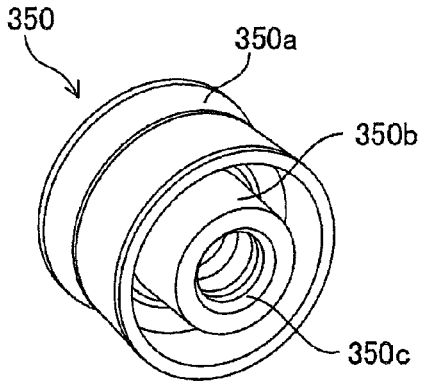
Figure 44C:
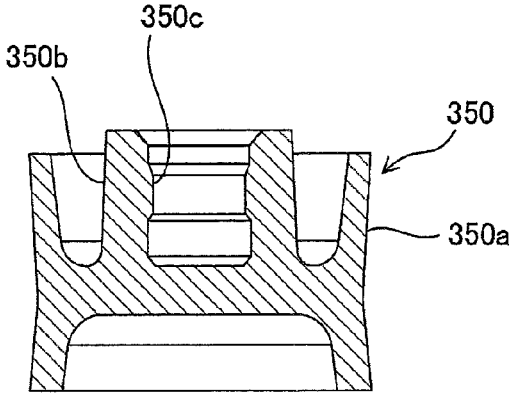

FIGS. 37(*a*) to (*c*) are illustrative views showing how a mark (marker) to be seen through a threaded body window is viewed. FIGS. 38(*a*), (*b*), (*c*), (*d*) and (*e*) are a front perspective view, rear perspective view, side view, vertical sectional view and front view of a rotary body. FIGS. 39(*a*), (*b*) and (*c*) are a front perspective view, side view and vertical sectional view of a crown. FIGS. 40(*a*), (*b*), (*c*) and (*d*) are a front perspective view, rear perspective view and vertical sectional view of a threaded body and an enlarged sectional view around a threaded part. FIGS. 41(*a*) and (*b*) are a perspective view and vertical sectional view of a barrel body. FIGS. 42(*a*), (*b*), (*c*) and (*d*) are a front perspective view, rear perspective view, side view and vertical sectional view of a cam body. FIGS. 43(*a*) and (*b*) are a side view and sectional view cut along line X-X of a threaded rod. FIGS. 44(*a*), (*b*) and (*c*) are a front perspective view, rear perspective view and vertical sectional view of a piston body.

As shown in FIG. 33, the clicking type dispensing container according to the fourth embodiment is a container that can dispense the content by pressing a crown 312 disposed at the rear end of a barrel body 310, forwards in the axial direction, and has a structure, including a clicking mechanical assembly 3A that transforms the pressing force on crown 312 by user' clicking operation into rotational force, a threaded body 328 fixed to barrel body 310 and a threaded rod 330 screw-fitted into threaded body 328, and so dispensing the content by advancing the threaded rod 330 through threaded body 328 (hence advancing a piston body fitted at the front end of threaded body 330) when threaded rod 330 is turned by the rotational force transformed by the clicking mechanical assembly 3A.

Attached to the front end at 310*a* of barrel body 310 in the clicking type dispensing container, are a joint 314, pipe joint 316, pipe 318, front barrel 320 and brush head 322. The content (liquid such as a fluid cosmetic or the like in the fourth embodiment) dispensed from a content reservoir 324 of barrel body 310 passes through pipe 318 to be ejected to the front end of brush head 322. Also, this container is formed so that a cap 326 including an inner cap 326*a* and an inner cap spring 326*b* can be fitted after use. Here, in FIG. 33, 324*a* designates a content agitating ball in reservoir 324, 326*c* a stopper for confining the passage of the content to pipe 318 and its downstream when not in use. At rear end of pipe 318, a seal ball 324*b* is arranged closely inside the bore of joint 314 so that the content will not flow into pipe 318 when unused. When used, stopper 326*c* is pulled out from barrel body 310, and front barrel 320 is pushed in toward the rear end so that seal ball 324*b* is removed from the bore of joint 314, whereby the content flows into pipe 318 and can be applied.

Specifically, as shown in FIGS. 33 and 41, barrel body 310 has a stepped small-diametric portion forming front end part 310*a*, viewed in the axial direction. Cylindrical joint 314 and pipe joint 316 being covered by the rear part of front barrel 320, are inserted into front end part 310*a*. Brush head 322 in the form of a writing tip formed of a large number of bundled fibers or of a continuous porous body, is held as an applying element at the front part of pipe joint 316 inside the front part of front barrel 320. The applying element may employ any configuration as appropriate other than the brush head of this type.

The joint 314 has an approximately cylindrical shape with its front end enlarged in diameter, and is fitted into front end part 310*a* of barrel body 310. Pipe joint 316 is inserted into the front opening of joint 314 from the front side. Pipe 318 for feeding liquid from reservoir 324 to brush head 322 is inserted into, and supported by, this pipe joint 316. Cap 326 is fitted to front end part 310*a* so as to cover brush head 322 and front barrel 320.

Next, the specific configuration of each part will be described.

[Clicking Mechanical Assembly 3A for Transforming Pressing Force into Rotational Force]

Clicking mechanical assembly 3A for transforming the pressing force by pressing the crown 312 into rotational force is essentially composed of a rotary body 336 having a first cam face 332 and a second cam face 334, a threaded body 328 having a first fixed cam face 338 and a cam body 342 having a second fixed cam face 340, as shown in FIGS. 33 and 34.

[Rotary Body 336]

As shown in FIGS. 33 and 38, rotary body 336 is arranged so that crown 312 is rotatable and restrained from moving in the axial direction, has an annular configuration with first cam face 332 directed forwards and second cam face 334 directed rearwards and is disposed to be rotatable, and movable in the axial direction, relative to barrel body 310.

As shown in FIG. 38, rotary body 336 has an approximately hollow cylindrical annular overall configuration. Formed at its front end with respect to the axial direction is first cam face 332 having a slope inclined forwards, formed on the front side, and an oval or any other variant-sectional hole 346 is formed in the bore. Further, a stepped enlarged diametric annular portion 336*b* whose rearward face has second cam face 334 directed rearwards is formed in the middle of rotary body 336 with respect to the axial direction, on the outer peripheral side thereof. A flange-like bumped fitting portion 336*a* is formed on the outer peripheral side at the rear end part of rotary body 336.

Further, marks (corresponding to markers) 337 such as slits, indentations or projections are formed, on the side surface of an annular portion 336*b* that is stepped and enlarged in diameter in the middle of rotary body 336 with respect to the axial direction, at intervals of twice the pitch of cam face 334 (the pitch between teeth 334*a*) and at the same phase. However, the marks 337 and their pitch and phase are not limited to the above.

Here, as shown in FIG. 39, crown 312 is a cylindrical vessel-like configuration that is closed at one axial end and has an engaging portion 312*a* formed of bumped steps in the inner peripheral portion at the rear end. When the rear end of the rotary body 336 is pushed in from the front opening of crown 312, the fitting portion 336*a* fits into the engaging portion 312*a*. The dimensions of the fitting portion 336*a* and engaging portion 312*a* are so specified that crown 312 can rotate, and is restrained from moving in the axial direction, relative to rotary body 336.

[Threaded Body 328]

The threaded body 328 is an approximately hollow-cylinder that is formed with a stepped front end part having a reduced diameter and a stepped rear end part having an enlarged diameter, as shown in FIGS. 33 and 40. The front end part is a stepped cylindrical part 328*a* reduced in diameter, whose bore is formed with a threaded part 348 of a female thread. First fixed cam face 338 is formed on the rear side of cylindrical part 328*a* having threaded part 348.

A cylindrical portion 328*b* stepped and enlarged in diameter in the rear end part of threaded body 328 is a part into which crown 312 is fitted in so as to be rotatable and movable forwards and backwards. In the part adjacent to the front of cylindrical portion 328*b*, a plurality of slits 328*c* that pass through from the interior to the exterior of threaded body 328 are formed so as to be extended in the axial direction and a bumped fitting portion 328*d* is formed on the outside periphery. Further, a plurality of grooves 328*e* extending in the axial direction are formed on the outer periphery located in front of bumped fitting portion 328*d*. Around (between) the fitting portion 328*d* and grooves 328*e*, at least one window 329 through which mark 337 of annular portion 336*b* of rotary body 336 that is assembled inside can be visually observed is formed. The window 329 of the fourth embodiment is opened as a via-hole, and it is preferable that the positions of the opening of window 329 with respect to the circumferential direction of threaded body 328 coincide with the distributed angles of the cams of rotary body 336 (first cam 332 and second cam 334).

Ribs 328*f* for positioning the radial position of an aftermentioned spring element 344 are projected inwards and extended in the axial direction in the front inner periphery of threaded body 328.

[Barrel Body 310]

As shown in FIG. 41, barrel body 310 has a front end part 310*a* that is reduced in diameter. On the inner peripheral surface, a bumped and step-formed fitting portion 310*b* is formed at the rear end part, and ribs 310*c* that are projected inwards and axially extended are formed in the middle part more or less closer to the rear. When threaded body 328 is fitted to barrel body 310, the threaded body 328 is inserted forwards from the open rear end of barrel body 310 and advanced and fitted while the ribs 310*c* are being fitted to the grooves 328*e*.

Further, threaded body 328 is squeezed while fitting portion 310*b* is made to pass over the bumps of fitting portion 328*d* of threaded body 328. At this time, threaded body 328 is advanced until the stepped and enlarged diametric portion of cylindrical portion 328*b* abuts the rear end face of barrel body 310. Since ribs 310*c* and fitting portion 310*b* are closely fitted to grooves 328*e* and fitting portion 328*d*, respectively, threaded body 328 is attached to barrel body 310 in a fixed relationship with respect to the rotational direction and axial direction.

Here, the front space of threaded body 328 of barrel body 310 forms reservoir 324 for the content.

[Cam Body 342]

As shown in FIG. 42, the cam body 342 has an approximately cylindrical hollowed configuration that has second fixed cam face 340 formed on the front end side, a projected portion 342*a* formed on the outer peripheral side and extended from the middle to the rear and a rear end part 342*b* slightly stepped and reduced in diameter.

As shown in FIGS. 33 and 34, this cam body 342 being fitted on the outer periphery of rotary body 336 in a movable manner, is inserted into threaded body 328 so that projected portion 342*a* fits into slit 328*c* of threaded body 328 and rear end part 342*b* is engaged inside cylindrical portion 328*b*. With this arrangement, cam body 342 is fixed so as not to move in the rotational direction and in the axial direction relative to threaded body 328. Further, since threaded body 328 is fixed to barrel body 310 as described above, cam body 342 is also fixed so as not to move in the rotational direction and in the axial direction relative to barrel body 310.

[Spring Element 344]

As shown in FIGS. 33 and 34, spring element 344 is disposed inside threaded body 328, between the side of the circular portion 336*b* on the periphery in the front of the rotary body 336, opposite to second cam face 334 and the portion that encloses first fixed cam face 338 of threaded body 328. This spring element 344 functions to urge rotary body 336 rearwards so that second cam face 334 of the rotary body 336 abuts the second fixed cam face 340 so as to be engaged therewith when the pressure on crown 312 is released.

[Threaded Rod 330 and Piston Body 350]

As shown in FIG. 43, threaded rod 330 is a bar-like long part, having a cross-section fitting to variant-sectional hole 346 of the rotary body 336 and formed on the outer periphery with a male thread 330*a*. A fitting part 330*b* that is projected radially outwards like a flange is formed in the front end part. Fitted on the front end of the threaded rod 330 is a piston body 350 that is slidable along barrel body 310 and integrally moves with the threaded rod 330 in the axial direction.

As shown in FIGS. 33 and 44, this piston body 350 includes a main part 350*a* that slides along the inner wall of reservoir 324, a hollowed cylindrical part 350*b* that is extended rearwards from main part 350*a* and a bumped fitting part 350*c* inside hollowed cylindrical part 350*b*. Fitting part 330*b* at the front end of threaded rod 330 is fitted into this fitting part 350*c* of the piston body 350 so that the former is rotatable, and restrained from moving forward and backward, relative to the latter. In this condition, piston body 350 is arranged so as to be movable forward and backward inside reservoir 324 of barrel body 310.

As shown in FIG. 33, the rotary body 336 is formed with oval sectional or any other variant-sectional hole 346. Threaded body 328 having threaded part 348 of a female thread and first fixed cam face 338 is fixed to barrel body 310. Threaded rod 330, having a sectional shape that fits with variant-sectional hole 346 of the rotary body 336, and formed with male thread 330*a* on the outer peripheral side thereof, is screw-fitted to the threaded part of the threaded body 328 and arranged so as to penetrate through variant-sectional hole 346 of the rotary body 336. Under this condition, threaded rod 330 is rotated by rotation of the rotary body 336. This rotation causes piston body 350 to advance inside reservoir 324 to feed the liquid content such as cosmetics etc. to brush head 322 as the applying part inside front barrel 320.

First fixed cam face 338 and second fixed cam face 340 oppose the first cam face 332 and second cam face 334, respectively and are arranged in barrel body 310 so as to be fixed with respect to the axial direction and the rotational direction.

First fixed cam face 338 and second fixed cam face 340, and the first cam face 332 and the second cam face 334 will be described in detail with reference to FIG. 36. In FIG. 36, for convenience of explanation and illustration, only one tooth is depicted for the first cam face 332 and second cam face 334. However, in the fourth embodiment, a plurality of teeth are formed as shown in FIG. 38. Of course, if teeth are closely and contiguously formed without gap on one of the cam faces that oppose each other, the number of teeth on the other cam face may be one or plural.

Detailedly, first cam face 332 of the rotary body 336 has a plurality of first teeth 332*a* formed with the same pitch in the predetermined rotational direction of rotary body 336, each tooth having a slope on the front side that is inclined forwards (downwards in the front view in FIG. 36) relative to the predetermined rotational direction (leftward in the front view in FIG. 36). First fixed cam face 338 of the threaded body 328 has a plurality of first teeth 338*a* formed with the same pitch in the predetermined rotational direction of rotary body 336, each tooth having a slope 338*a*1 on the front side that is inclined forwards relative to the predetermined rotational direction.

Second cam face 334 of the rotary body 336 and second fixed cam face 340 of the cam body 342 have a plurality of second teeth 334*a* and 340*a*, respectively, formed with the same pitch in the predetermined rotational direction of rotary body 336, each of second teeth 334*a* and 340*a* having a slope 334*a*1 or 340*a*1 that is inclined rearwards (upwards in the front view in FIG. 36) relative to the predetermined rotational direction (leftward in the front view in FIG. 36).

Here, in the fourth embodiment, the pitch of first cam face 332 and first fixed cam face 338 and the pitch of second cam face 334 and second fixed cam face 340 are formed to be equal to each other. When the cam faces opposing each other have different numbers of teeth, a workable configuration is obtained if the pitch of teeth of one of first cam face 332 and first fixed cam face 338 is the same as the pitch of teeth of one of second cam face 334 and second fixed cam face 340.

When the user clicks crown 312, first cam face 332 of the rotary body 336 is put in mesh with first fixed cam face 338 by the pressing force, and in this state, as first cam face 332 is guided along forward-inclined surface 338*a*1 of the tooth 338*a* of first fixed cam face 338 (see FIGS. 36(*b*) to (*c*)), the rotary body 336 moves forwards and turns in the predetermined direction.

On the other hand, as the aforementioned pressing force is released, second cam face 334 of the rotary body 336 being kept in mesh with second fixed cam face 340 is guided along rearward-inclined surface 340*a*1 of the tooth 340*a* (see FIGS. 36(*d*) to (*e*)), so that the rotary body 336 moves rearwards and turns in the predetermined direction.

Thus, the clicking mechanical assembly 3A is constructed so as to actuate rotational movement by the cams operating as above, and so that rotation of rotary body 336 causes the threaded rod 330 to rotate.

Here, in the state where first cam face 332 of the rotary body 336 is in mesh with the first fixed cam face 338 (see FIG. 36(*c*)), the second fixed cam face 340 is set in such a relationship as to be shifted out of phase by half of one cam tooth of first fixed cam face 338 with respect to the rotational direction. On the other hand, in the state where second cam face 334 on the rotary body 336 side is in mesh with the second fixed cam face 340 (see FIG. 36(*e*)), the first cam face 332 on the rotary body 336 side and the first fixed cam face 338 are set in such a relationship as to be shifted out of phase from each other by half of one cam tooth with respect to the rotational direction.

Further, spring element 344 that urges rotary body 336 rearwards is provided in order to bring second cam face 334 of the rotary body 336 into contact and in mesh with the second fixed cam face 340 when the pressure is released.

In sum, the clicking type dispensing container has a configuration including: in the hollow of the threaded body 328, annularly formed rotary body 336 having first cam face 332 that meshes the first fixed cam face 338 in the front part thereof, second cam face 334 in the rear and variant-sectional hole 346 formed in the bore at the front; spring element 344 disposed between the rotary body 336 and the threaded body 328 for urging rotary body 336 rearwards relative to threaded body 328; and cam body 342 having second fixed cam face 340 meshing second cam face 334 of the rotary body 336 and fixed to the rear part of the threaded body 328, so as to hold the rotary body 336 from the front and rear between the threaded body 328 and the cam body 342 and urge the rotary body 336 toward the cam body 342 by the spring element 344.

Further, variant-sectional threaded rod 330 having a thread on the outer peripheral side is screw-fitted to threaded part 348 of the threaded body 328. The threaded rod 330 and the rotary body 336 are movable in the axial direction and locked with respect to the rotational direction due to variant-sectional hole 346 of the rotary body 336. Fitted to the front end of the threaded rod 330 is piston body 350 that is slidable along barrel body 310 and integrally moves with the threaded rod 330 in the axial direction.

Moreover, the crown 312 is arranged at the rear of the rotary body 336 in such a manner as to be rotatable and locked with respect to the axial direction.

As shown in FIG. 36, in the state where first cam face 332 of the rotary body 336 is put in mesh with the first fixed cam face 338, the second cam face 334 on the rotary body 336 side and the second fixed cam face 340 are set in such a relationship as to be shifted out of phase from each other by half of one cam tooth with respect to the rotational direction, and in the state where second cam face 334 of the rotary body 336 is in mesh with the second fixed cam face 340, the first cam face 332 on the rotary body 336 side and the first fixed cam face are set in such a relationship as to be shifted out of phase from each other by half of one cam tooth with respect to the rotational direction.

Next, the operation of the above-described fourth embodiment will be described.

FIGS. 36(*a*) to (*f*) show the scheme of the mutual motion of first cam face 332 and second cam face 334 of rotary body 336, first fixed cam face 338 of threaded body 328 and second fixed cam face 340 of cam body 342.

In the initial state (FO) shown in FIGS. 33, 34 and 37(*a*) where crown 312 is not clicked (pressed), rotary body 336 is pushed against the cam body 342 side as shown in FIG. 36(*a*), by spring element 344 (upwards: indicated by arrow U) so that second cam face 334 of rotary body 336 and second fixed cam face 340 of cam body 342 are meshing each other. In this state, second cam face 334 of rotary body 336 is located with its peak and first cam face 332 residing on the same line parallel to the axial direction and is shifted out of phase from first fixed cam face 338 of threaded body 328 by half of the pitch. From window 329, mark 337 such as a slit or the like formed on the side surface of annular portion 336 stepped and enlarged in diameter in the middle part, with respect to the axial direction, of rotary body 336, is set either at a position where it can be seen or cannot be seen, depending on its angular position.

Next, as shown in FIG. 35, crown 312 is pushed downwards in the axial direction (in the P direction) to start clicking.

As clicking begins, the state changes from FIG. 36(*a*) to FIG. 36(*b*) (clicked state 1: shown by code NK1). Specifically, crown 312 and rotary body 336 start to integrally move forwards as spring element 344 is compressed, so that second cam face 334 of rotary body 336 goes away from second fixed cam face 340 of cam body 342.

As clinking is further continued, first cam face 332 of rotary body 336 abuts first fixed cam face 338 of threaded body 328, at a position out of phase by half of the pitch, as shown in FIG. 36(*b*).

As shown in FIG. 36(*c*), a further pressure is applied from this state of abutment (clicked state 2: shown by code NK2), slope 332*a*1 of tooth 332*a* of first cam face 332 of rotary body 336 moves sliding over slope 338*a*1 of tooth 338*a* of first fixed cam face 338 of threaded body 328 so that rotary body 336 moves forwards whilst rotating in the predetermined direction until wall 332*a*2 of the tooth 332*a* abuts wall 338*a*2 of tooth 338*a* of first fixed cam face 338 (shown in FIG. 36(*c*)). During this, crown 312 itself will not rotate since rotary body 336 is attached to crown 312 in a rotatable manner.

With the rotation of rotary body 336 at the time of clicking, threaded rod 330 that penetrates through variant-sectional hole 346 located at the front end of rotary body 336, can axially move but is restricted from rotating relative to rotary body 336, integrally rotates with rotary body 336. Since threaded rod 330 is screw-fitted with threaded part 348 of threaded body 328, the threaded rod moves forwards with piston body 350 so as to dispense the content of reservoir 324.

From this state, clicking is released.

Release of clicking is performed as spring element 344 disposed inside threaded body 328 moves up rotary body 336, as shown in FIG. 36(*d*) (click-released state 1: shown by code UNK1). At this time, since tooth 340*a* of second fixed cam 340 of cam body 342 is located out of phase from second cam face 334 of rotary body 336 by half of the pitch, the second cam face 334 starts turning in the predetermined rotational direction and moving rearwards.

As release of clinking is further continued, second cam face 334 of rotary body 336 abuts second fixed cam face 340 of cam body 342 (click-released state: shown by code UNK2), as shown in FIG. 36(*e*), then slope 334*a*1 of tooth 334*a* of second cam face 334 of rotary body 336 is moved by pushup force of spring element 344, sliding over slope 340*a*1 of tooth 340*a* of second fixed cam face 340 of cam body 342 so that the rotary body rotates and retracts to the position where wall 334*a*2 of tooth 334*a* of second cam face 334 abuts wall 340*a*2 of tooth 340*a* of second fixed cam face 340. Also during this rotation, threaded rod 330 being rotated as above, moves forwards with piston body 350 to dispense the content.

When the above clicking operation is repeated, mark 337 such as the slit or indentation and projection provided on the side surface of annular portion 336*b* in the middle part, with respect to the axial direction, of rotary body 336 becomes invisible by a clicking operation when it was seen through window 329 and becomes visible when it was not seen, as shown in FIGS. 37(*a*) to (*c*). For example, when the mark is seen at the initial state (FO) in FIG. 36(*a*) (FIG. 37(*a*)), rotary body 336 begins rotating (FIG. 37(*b*)) by clicking or applying pressure on crown 312 (clicked state 2 in FIG. 36(*c*)) and then crown 312 returns to the initial state (FO) and mark 337 disappears from window 329 (FIG. 37(*c*)) when the pressure is released or in unclicked state (click-released state 2 in FIG. 36(*e*): UNK2).

From the above, when an operational test of the dispensing mechanism is carried out at assembly etc., it is possible to achieve the operational test simply by visual observation with a few times of clicks.

It should be noted that the clicking type dispensing container of the present invention is not limited to the above embodiment. It is, of course, possible to make various changes therein without departing from the scope of the gist of the invention.

Though in the fourth embodiment the window is formed with a via hole, part or whole of the side wall of the threaded body may be formed to be transparent so that the inside mark is visible.

Further, each part is preferably formed of a resin molding. It is preferable that the barrel body is formed of PP, the rotary body of POM, the cam body of ABS, the threaded body of ABS and the crown of PC.

Also, in the fourth embodiment, first cam face 332 of rotary body 336 and first fixed cam face 338 of threaded body 328 as well as second cam face 334 of the rotary body and second fixed cam face 340 of cam body 342, are all formed with a plurality of teeth arranged with the same pitch. However, the present invention is not limited to this configuration. One of the first cam face and the first fixed cam face may be formed of a plurality of first teeth which each have a slope inclined forwards relative to the predetermined rotational direction of the rotary body and are arranged with an identical pitch along the predetermined rotational direction while one of the second cam face and the second fixed cam face may be formed of a plurality of second teeth which each have a slope inclined rearwards relative to the predetermined rotational direction of the rotary body and are arranged with an identical pitch along the predetermined rotational direction. That is, the present invention may include a configuration in which one of the opposing cam faces is formed with a plural teeth while the other is formed with a single tooth or plural teeth.

Industrial Applicability

The clicking type dispensing container of the present invention can be used for various kinds of dispensing containers for dispensing liquid cosmetics, other fluids, fluid medicines, application liquids such as paints, adhesive, etc., and solid contents of stick types etc., by clicking the crown at the rear end of the barrel body.

Description of Reference Numerals

10 barrel body
10*a* barrel body's front end part
10*b* fitting portion
10*c* rib
12 crown
14 joint
16 pipe joint
18 pipe
20 front barrel
22 brush head
24 reservoir
26 cap
28 threaded body
28*a* cylindrical part at the threaded body's front end
28*b* cylindrical portion
28*c* slit
28*d* fitting portion
28*e* groove
28*f* rib
30 threaded rod
30*a* male thread
30*b* fitting part
32 first cam face
32*a* first cam face' tooth
32*a*1 first cam face' tooth slope
32*a*2 tooth wall
34 second cam face
34*a* second cam face' tooth
34*a*1 second cam face' tooth slope
34*a*2 second cam face' tooth wall
36 rotary body
38 first fixed cam face
38*a* first fixed cam face' tooth
38*a*1 first fixed cam face' tooth slope
38*a*2 first fixed cam face' tooth wall
40 second fixed cam face
40*a* second fixed cam face' tooth
40*a*1 second fixed cam face' tooth slope
40*a*2 second fixed cam face' tooth wall
42 cam body
44 spring element
46 variant-sectional hole
48 threaded body's threaded part
50 piston body
50*a* main part
50*b* cylindrical part
50*c* fitting part A Mechanical assembly for transforming pressing force into rotational force

110 barrel body
110*a* barrel body's front end part
110*b* barrel body's fitting portion
110*c* barrel body's rib
112 clicking body's rear end
114 joint
116 pipe joint
118 pipe
120 front barrel
122 brush head
124 content reservoir
126 cap
128 threaded body
128*a* male thread
128*b* fitting portion

130 clicking part's cam face
130*a* cam face slope (inclined surface)
132 clicking part
132*a* insert part
132*b* projected portion
132*c* slit
132*d* step
134 rotary body's first cam face
134*a* first cam face' slope (inclined surface)
136 rotary body's second cam face
136*a* second cam face' slope (inclined surface)
138 rotary body
138*a* rotary body's variant-sectional hole
138*b* step inside the rotary body
140 threaded body's cam face
140*a* rearward-inclined surface (slope) of the threaded body's cam face
140*b* forward-inclined surface (slope) of the threaded body's cam face
142 threaded part
144 threaded body
144*a* threaded body's fitting projection
144*b* threaded body's groove
144*c* threaded body's slit
146 spring
148 piston
148*a* piston's main part
148*b* piston's cylindrical support
148*c* piston's fitted part
1A Mechanical assembly for transforming pressing force on the end of the clicking body into rotational force
L rotational direction
θ1 inclined angle
θ2 inclined angle
210 barrel body
210*a* barrel body's front end part
210*b* fitting portion
210*c* rib
212 crown
214 joint
216 pipe joint
218 pipe
220 front barrel
222 brush head
224 reservoir
224*a* agitating ball
224*b* seal ball
226 cap
226*a* inner cap
226*b* spring for urging the inner cap at the rear end
226*c* stopper
228 threaded body
228*a* cylindrical part at the threaded body's front end
228*b* cylindrical portion
228*c* slit
228*d* fitting portion
228*e* groove
228*f* rib
230 threaded rod
230*a* male thread
230*b* fitting portion
232 first cam face
232*a* first cam face' tooth
232*a*1 first cam face' tooth slope
232*a*2 tooth wall
233 step
234 second cam face
234*a* second cam face' tooth
234*a*1 second cam face' tooth slope
234*a*2 second cam face' tooth wall
236 rotary body
236*a* fitting portion
238 first fixed cam face
238*a* first fixed cam face' tooth
238*a*1 first fixed cam face' tooth slope
238*a*2 first fixed cam face' tooth wall
239 step
240 second fixed cam face
240*a* second fixed cam face' tooth
240*a*1 second fixed cam face' tooth slope
240*a*2 second fixed cam face' tooth wall
242 cam body
244 spring element
246 variant-sectional hole
248 threaded body's threaded part
250 piston body
250*a* main part
250*b* cylindrical part
250*c* fitting part
2A clicking mechanical assembly for transforming pressing force into rotational force
310 barrel body
310*a* barrel body's front end part
310*b* fitting portion
310*c* rib
312 crown
312*a* engaging portion
314 joint
316 pipe joint
318 pipe
320 front barrel
322 brush head
324 reservoir
324*a* agitating ball
324*b* seal ball
326 cap
326*a* inner cap
326*b* spring for urging the inner cap at the rear end
326*c* stopper
328 threaded body
328*a* cylindrical part at the threaded body's front end
328*b* cylindrical portion
328*c* slit
328*d* fitting portion
328*e* groove
328*f* rib
329 window
330 threaded rod
330*a* male thread
330*b* fitting portion
332 first cam face
332*a* first cam face' tooth
332*a*1 first cam face' tooth slope
332*a*2 tooth wall
334 second cam face
334*a* second cam face' tooth
334*a*1 second cam face' tooth slope
334*a*2 second cam face' tooth wall
336 rotary body
336*a* fitting portion
336*b* annular portion
337 mark (marker)
338 first fixed cam face
338*a* first fixed cam face' tooth

338*a*1 first fixed cam face' tooth slope
338*a*2 first fixed cam face' tooth wall
340 second fixed cam face
340*a* second fixed cam face' tooth
340*a*1 second fixed cam face' tooth slope
340*a*2 second fixed cam face' tooth wall
342 cam body
344 spring element
346 variant-sectional hole
348 threaded body's threaded part
350 piston body
350*a* main part
350*b* cylindrical part
350*c* fitting part
3A clicking mechanical assembly for transforming pressing force into rotational force

The invention claimed is:

1. A clicking type dispensing container that can dispense the content inside a reservoir by a user operating a crown disposed at the rear end of a barrel body, and has a structure, including a mechanical assembly that transforms the pressing force acting on the crown by user operation into rotational force, a threaded body fixed to the barrel body, a threaded rod screw-fitted into the threaded body and a piston body fitted on the front end of the threaded rod, and dispensing the content by advancing the threaded rod by means of the threaded body by turning the threaded rod with the rotational force transformed by the mechanical assembly, characterized in that the mechanical assembly for transforming pressing force into rotational force includes:

a rotary body that is provided with the crown that is rotatable and restrained from axial movement relative to the rotary body, has an annular configuration having a first cam face directed forwards and a second cam face directed rearwards, and is arranged so as to be rotatable and movable in the axial direction relative to the barrel body; and, a first fixed cam face and a second fixed cam face that oppose the first cam face and second cam face, respectively, and are disposed and fixed to the barrel body with respect to the axial direction and the rotational direction, and is constructed such that at least one of the first cam face and the first fixed cam face, has a plurality of the first teeth, each having a forward-inclined slope relative to the predetermined rotational direction of the rotary body, and arranged with an identical pitch along the predetermined rotational direction, at least one of the second cam face and the second fixed cam face, has a plurality of the second teeth, each having a rearward-inclined slope relative to the predetermined rotational direction of the rotary body, and arranged with an identical pitch along the predetermined rotational direction, and in a state where the first cam face of the rotary body is put in mesh with the first fixed cam face by the pressing force, as the first cam face is guided along the forward-inclined slope of the tooth, the rotary body moves forwards and turns in the predetermined direction, whereas, as the aforementioned pressing force is released, the second cam face of the rotary body being kept in mesh with the second fixed cam face is guided along rearward-inclined slope of the second fixed cam face, the rotary body moves rearwards and turns in the predetermined direction, thereby, the threaded rod is rotated by rotation of the rotary body, wherein the piston body is integrally moved with the threaded rod in the axial direction by rotation of the threaded rod, and said rotation causes the piston body to advance inside the reservoir to dispense liquid content as the content.

2. The clicking type dispensing container according to claim 1, wherein the first cam face has a projected step in front of the slope that is inclined forwards relative to the predetermined rotational direction of the rotary body and the first fixed cam face has a recessed step in front of the slope that is inclined forwards relative to the predetermined rotational direction of the rotary body, and when the first cam face is guided along the slope of the first fixed cam face, the steps formed along the slopes of the first cam face and the first fixed cam face abut each other so as to produce a clicking sound and a clicking sensation.

3. The clicking type dispensing container according to claim 2, wherein the second cam face of the rotary body and the second fixed cam face are each formed with steps directed rearwards so as to produce a clicking sound and a clicking sensation by the steps when the second cam face and the second fixed cam face mesh each other at the time of release of pressing.

4. The clicking type dispensing container according to claim 3, wherein, in the state where the first cam face of the rotary body is put in mesh with the first fixed cam face, the second cam face on the rotary body side and the second fixed cam face are set in such a relationship as to be shifted part of one cam tooth out of phase from each other with respect to the rotational direction, and in the state where the second cam face on the rotary body side is put in mesh with the second fixed cam face, the first cam face on the rotary body side and the first fixed cam face are set in such a relationship as to be shifted part of one cam tooth out of phase from each other with respect to the rotational direction.

5. The clicking type dispensing container according to claim 4, wherein the phase shift in the rotational direction is half of one cam tooth.

6. The clicking type dispensing container according to claim 5, wherein a spring element that urges the rotary body rearwards so as to bring the second cam face in the rotary body into contact and in mesh with the second fixed cam face in the state of the pressing being released.

7. The clicking type dispensing container according to claim 6, wherein the rotary body is formed with a variant-sectional hole, the threaded body having a threaded part of a female thread and the first fixed cam face is fixed to the barrel body, and in the state where the threaded rod, having a sectional shape that fits with the variant-sectional hole of the rotary body, and formed with a male thread on the outer peripheral side thereof, is screw-fitted to the threaded part of the threaded body and the threaded rod is fitted through the variant-sectional hole of the rotary body, the threaded rod is rotated by rotation of the rotary body.

8. The clicking type dispensing container according to claim 7, wherein when the threaded rod is rotated so as to advance a content thrusting member by rotation of the rotary body with markers that can be easily seen from the outside, integrally formed on the outer peripheral surface thereof, at intervals of twice the distributed pitch of, and arranged in phase with, the first teeth, and the motion of the markers on the outer surface of the rotary body can be observed through windows formed of via-holes or transparent parts in the threaded body or a barrel cylinder at positions distributed at the same angles as the distributed angles of the cam to be used for rotation, whereby advancement of the threaded rod with rotation of the rotary body can be confirmed by the motion of the markers.

9. A clicking type dispensing container that can dispense the content by pressing a rear end part of a clicking body arranged at the rear end of a barrel body, forwards in the axial direction and has a structure, including a mechanical assembly that transforms the pressing force acting on the rear end part of the clicking body into rotational force, and dispensing the content by advancing a threaded rod by the transformed rotational force, characterized in that the clicking body includes a cam face having serrated notches and projections formed on the front face of the clicking body, and arranged in the barrel body so as to be slidable in the axial direction in accordance with the pressing at the rear end of the clicking body and restrained from moving in the rotational direction, the mechanical assembly for transforming the pressing force at the rear end of the clicking body into rotational force includes:

the cam face of the clicking body;

a rotary body, having an approximately annular rotational configuration in which a first cam face having notches and projections directed rearwards in the axial direction and a second cam face having notches and projections directed forwards in the axial direction, and being arranged such that the first cam face opposes the cam face of the clicking body;

a threaded body as a whole, having an approximately cylindrical configuration having a cam face having notches and projections directed rearwards in the axial direction and a threaded part formed in a bore to which a threaded rod is screw fitted, and fixed to the barrel body so as to oppose the second cam face of the rotary body; and, a spring disposed between the clicking body and the rotary body so as to constantly urge the second cam face of the rotary body against the cam face of the threaded body to keep the cam faces in mesh with each other, at least one of the cam face of the clicking body and the first cam face of the rotary body and at least one of the second cam face of the rotary body and the cam face of the threaded body, are formed with a first slope and a second slope, respectively, which are each inclined to one side in the axial direction relative to the predetermined rotational direction of the rotary body, the inclined angle of the first slope and the inclined angle of the second slope are made different from each other, and, when the clicking body is pushed to advance, the rotary body rotates in the predetermined rotational direction while the first cam face of the rotary body slides along the cam face of the clicking body and the second cam face slides along the cam face of the threaded body, due to the difference between the inclined angles of the first slope and the second slope.

10. The clicking type dispensing container according to claim 7, wherein the variant-sectional hole has an oval shape.

11. The clicking type dispensing container according to claim 8, wherein the markers comprise one or more of slits, indentations, or projections.

* * * * *